US012753543B2

(12) United States Patent
Rensing et al.

(10) Patent No.: US 12,753,543 B2
(45) Date of Patent: Oct. 6, 2026

(54) AUTONOMOUS LAUNDRY HEAT PUMP SYSTEMS AND METHODS OF USE

(71) Applicant: Monotony.ai, Inc., Allston, MA (US)

(72) Inventors: Noa M. Rensing, West Newton, MA (US); Jesse Sielaff, Norfolk, MA (US); Wynand Groenewald, Hartbeespoort (CA); Benjamin D. Bixby, Newton Highlands, MA (US)

( * ) Notice: Subject to any disclaimer, the term of this patent is extended or adjusted under 35 U.S.C. 154(b) by 700 days.

(21) Appl. No.: 18/172,628

(22) Filed: Feb. 22, 2023

(65) Prior Publication Data

US 2023/0265599 A1 Aug. 24, 2023

Related U.S. Application Data

(60) Provisional application No. 63/312,643, filed on Feb. 22, 2022.

(51) Int. Cl.
*D06F 58/20* (2006.01)
*D06F 25/00* (2006.01)
(Continued)

(52) U.S. Cl.
CPC ..... *D06F 58/206* (2013.01); *D06F 25/00* (2013.01); *D06F 31/00* (2013.01); *D06F 34/26* (2020.02);
(Continued)

(58) Field of Classification Search
CPC ..... D06F 58/206; D06F 25/00; D06F 31/00; D06F 34/26; D06F 37/04; D06F 39/04;
(Continued)

(56) References Cited

U.S. PATENT DOCUMENTS 3,050,867 A 8/1962 Friedman
4,036,365 A 7/1977 Rosenfeld
(Continued)

FOREIGN PATENT DOCUMENTS

CN 103237937 A 8/2013
EP 3031974 A1 6/2016
(Continued)

OTHER PUBLICATIONS

Aaon, "Value in the Air—Why Direct Drive Backward Curved Plenum Fans?", Technical brochure, retrieved from: https://www.aaon.com/library/Value%20in%20the%20Air, Jul. 2011, (36 pages).
(Continued)

*Primary Examiner* — David J Laux
(74) *Attorney, Agent, or Firm* — Myers Bigel, P.A.

(57) ABSTRACT

An energy efficient autonomous laundry system includes a plurality of combination washing and drying machines each one of which includes heated and cold side heat exchangers disposed in series within a dedicated closed air loop at each machine, a heat pump providing separate streams of heated and cooled fluid to the heat exchangers, one or more sensors disposed in the closed air loop, and a controller in operative communication with all of these system components. The controller is configured to receive an output signal of one or more air sensors in the closed air loop, analyze the output signal, determine, based on the analysis, whether the at least one air characteristic is within a range of values for at least one of air temperature, air flow, and air humidity, and adjust one or more controls, including controls for adjusting at least one of air temperature, air flow, and air humidity.

16 Claims, 23 Drawing Sheets

(51) Int. Cl.

| | |
|---|---|
| ***D06F 31/00*** | (2006.01) |
| ***D06F 34/26*** | (2020.01) |
| ***D06F 37/04*** | (2006.01) |
| ***D06F 39/04*** | (2006.01) |
| ***D06F 58/04*** | (2006.01) |
| ***D06F 58/24*** | (2006.01) |
| ***D06F 58/26*** | (2006.01) |
| ***D06F 95/00*** | (2006.01) |
| ***D06F 103/32*** | (2020.01) |
| ***D06F 103/34*** | (2020.01) |
| ***D06F 103/36*** | (2020.01) |
| ***D06F 105/20*** | (2020.01) |
| ***D06F 105/22*** | (2020.01) |
| ***D06F 105/24*** | (2020.01) |
| ***D06F 105/26*** | (2020.01) |
| ***D06F 105/28*** | (2020.01) |
| ***D06F 105/32*** | (2020.01) |

(52) U.S. Cl.
CPC ..... *D06F 37/04* (2013.01); *D06F 39/04* (2013.01); *D06F 58/04* (2013.01); *D06F 58/24* (2013.01); *D06F 58/26* (2013.01); *D06F 95/00* (2013.01); *D06F 2103/32* (2020.02); *D06F 2103/34* (2020.02); *D06F 2103/36* (2020.02); *D06F 2105/20* (2020.02); *D06F 2105/22* (2020.02); *D06F 2105/24* (2020.02); *D06F 2105/26* (2020.02); *D06F 2105/28* (2020.02); *D06F 2105/32* (2020.02)

(58) Field of Classification Search
CPC ..... D06F 58/04; D06F 58/24; D06F 58/26; D06F 95/00; D06F 2103/32; D06F 2103/34; D06F 2103/36; D06F 2105/20; D06F 2105/22; D06F 2105/24; D06F 2105/26; D06F 2105/28; D06F 2105/32; D06F 2103/68; D06F 2105/30; D06F 58/34
See application file for complete search history.

(56) References Cited

U.S. PATENT DOCUMENTS

| | | | | |
|---|---|---|---|---|
| 4,195,498 | A | 4/1980 | Pellerin | |
| 4,509,345 | A | 4/1985 | Alio | |
| 4,572,429 | A | 2/1986 | Huffman et al. | |
| 4,885,853 | A | 12/1989 | Mccabe | |
| 6,324,771 | B1 | 12/2001 | Mcallister et al. | |
| 9,022,228 | B2 | 5/2015 | Grunert | |
| 9,080,282 | B2 | 7/2015 | Zambrowicz et al. | |
| 10,435,836 | B2 | 10/2019 | Lundt et al. | |
| 2005/0183209 | A1* | 8/2005 | Costa | D06F 33/42 68/12.02 |
| 2007/0251115 | A1 | 11/2007 | Bringewatt et al. | |
| 2009/0157529 | A1 | 6/2009 | Ehlers et al. | |
| 2009/0215375 | A1 | 8/2009 | Hagensen | |
| 2012/0292008 | A1* | 11/2012 | Goldberg | D06F 95/00 165/287 |
| 2015/0033779 | A1 | 2/2015 | Seggerman | |
| 2021/0165377 | A1* | 6/2021 | Yoon | D06F 34/04 |
| 2021/0372036 | A1* | 12/2021 | Rensing | D06F 31/00 |
| 2022/0268518 | A1* | 8/2022 | Chudnovsky | F26B 23/005 |
| 2022/0372685 | A1 | 11/2022 | Lee et al. | |
| 2023/0043093 | A1* | 2/2023 | Wu | D06F 29/005 |
| 2024/0117548 | A1* | 4/2024 | Ungoren | D06F 34/05 |

FOREIGN PATENT DOCUMENTS

| | | | |
|---|---|---|---|
| EP | 2267207 | B1 | 8/2016 |
| JP | 2009279700 | A | 12/2009 |
| JP | 4858321 | B2 | 1/2012 |
| JP | 2019041969 | A | 3/2019 |
| WO | 2017153511 | A1 | 9/2017 |
| WO | 2019137585 | A1 | 7/2019 |

OTHER PUBLICATIONS

Amaris, et al., "Analysis of an R744 typical booster configuration, an R744 parallel-compressor booster configuration and an R717/R744 cascade refrigeration system for retail food applications. Part 1: Thermodynamic analysis", Energy Procedia, 161, 2019, 259-267.
Ambarita, et al., "Performance and Characteristics of Heat Pump Clothes Drier", IOP Conference Series: Materials Science and Engineering, 180: 012027, 2017, (9 pages).
Ambarita, et al., "Performance of a clothes drying cabinet by utilizing waste heat from a split-type residential air conditioner", Case Studies in Thermal Engineering, 8, 2016, 105-114.
Bansal, et al., "A novel design of a household clothes tumbler dryer", Applied Thermal Engineering, 30(4), 2010, 277-285.
Bansal, et al., "Improving the energy efficiency of conventional tumbler clothes drying systems", International Journal of Energy Research, 25(15) (Abstract only), 2001, 1315-1332.
Bassily, et al., "Performance Analysis of an Electric Clothes Dryer", Drying Technology: An International Journal, 21(3), 2003, 499-524.
Bendt, Paul, "Are We Missing Energy Savings in Clothes Dryers?", ACEEE Summer Study on Energy Efficiency in Buildings, 2010, 9-41-9-55.
Bouteiller, et al., "Experimental Study of Heat Pump Thermodynamic Cycles Using CO2 Based Mixtures—Methodology and First Results", AIP Conference Proceedings, 1814, 2017, 020052-1-020052-9.
Brown, Mark, "Simulations for thermodynamic analyses of transcritical carbon dioxide refrigeration cycle and reheat dehumidification air conditioning cycle", Graduate These and Dissertations, University of South Florida Scholar Commons, May 5, 2006, (231 pages).
Brunzell, Lena, "Energy Efficient Textile Drying", Karlstads Universitet, Faculty of Technology and Science Environmental and Energy Systems, 2006, (48 pages).
Buisson, et al., "Qualitative and Quantitative Evaluation of Cotton Fabric Damage by Tumble Drying", Textile Research Journal, 70(8), 2000, 739-743.
Cavallini, et al., "Carbon dioxide as a natural refrigerant", International Journal of Low Carbon Technologies, 2(3), Jul. 2007, 225-249.
Cavallini, Alberto, "Properties of CO2 as a Refrigerant", Galileo Study Center Industry & Training; University of Milan Research Center for the Environment and Business. European Seminar., 2004, (17 pages).
Clopema Certh, "Autonomous Active Recognition and Unfolding of Clothes using Random Decision Forests and Probabilistic Planning", YouTube video retrieved from: https://www.youtube.com/watch?v=YpD-ip6g5IY (Video Date: Feb. 3, 2014), (1 page).
Clopema Certh, "Autonomous Folding of Shorts—CloPeMa Robot", Complete Autonomous Folding of Shorts Starting from Random Configuration using the CloPeMa testbed YouTube video retrieved from: https://www.youtube.com/watch?v=mrh4TJK1gdQ (Video Date: Apr. 23, 2014), (1 page).
Gluesenkamp, et al., "An efficient correlation for heat and mass transfer effectiveness in tumble-type clothes dryer drums", Energy, 172, 2019, 1225-1242.
Gluesenkamp, Kyle, "Residential Clothes Dryer Performance Under Timed and Automatic Cycle Termination Test Procedures", Oak Ridge National Laboratory, ORNL/TM-2014/431, Oct. 2014, (63 pages).
Gullo, et al., "State-of-the-art technologies for transcritical R744 refrigeration systems—a theoretical assessment of energy advantages for European food retail industry", Energy Procedia, 123, Sep. 2017, 46-53.
Honma, et al., "Experimental Study on Compact Heat Pump System for Clothes Drying Using CO2 as a Refrigerant", 7th IIR Gustav Lorentzen Conference on Natural Working Fluids, 2006, (8 pages).

(56) References Cited

OTHER PUBLICATIONS

Kim, et al., "Fundamental process and system design issues in CO2 vapor compression systems", Progress in Energy and Combustion Science, 30(2), 2004, 119-174.
Le, et al., "Application of a Biphasic Actuator in the Design of the CloPeMa Robot Gripper", Journal of Mechanisms and Robotics, 7(1), Feb. 2015, 011011-1-011011-8.
Le, et al., "On the Development of a Specialized Flexible Gripper for Garment Handling", Journal of Automation and Control Engineering, 1(3), Sep. 2013, 255-259.
Liu, et al., "Energy-saving performance and economics of CO2 and NH3 heat pumps with simultaneous cooling and heating applications in food processing: Case studies", International Journal of Refrigeration, 73, 2017, 111-124.
Maitin-Shepard, et al., "Cloth Grasp Point Detection based on Multiple-View Geometric Cues with Application to Robotic Towel Folding", YouTube video retrieved from: https://www.youtube.com/watch?v=gy5g33S0Gzo (Video Date: May 17, 2010), (1 page).
Mancini, et al., "Thermodynamic analysis and experimental investigation of a CO2 household heat pump dryer", International Journal of Refrigeration, 34(4), 2011, 851-858.
Merediz, Alberto, "Modeling of Dehydration Processes in Controlled Spinning of Washing Machines", Master's Thesis submitted to Department of Applied Mechanics, Division of Dynamics, Chalmers University of Technology, Goteborg, Sweden, 2009, (56 pages).
Minea, Vasile, "Chapter 1: Industrial Drying Heat Pumps", Refrigeration: Theory, Technology and Applications Larsen, M. E. (Ed). Nova Science Publishers, Inc., 2011, (71 pages).
Neksa, P., "CO2 As Refrigerant for Systems in Transcritical Operation Principles and Technology", SINTEF Energy Research, No. 7465, Trondheim, Norway. EcoLibrium (TM), Oct. 2004, 26-31.
Pal, et al., "Calculation Steps for the Design of Different Components of Heat Pump Dryers Under Constant Drying Rate Condition", Drying Technology: An International Journal, 26(7), Jun. 2008, 864-872.
Patel, et al., "Experimental evaluation and thermodynamic system modeling of thermoelectric heat pump clothes dryer", Applied Energy, 217, May 2018, 221-232.
Pescatore, et al., "High Efficiency, High Performance Clothes Dryer", Final Report to the Department of Energy. Research organization: TIAX LLC, Mar. 31, 2005, (31 pages).
Rony, et al., "Recent Advances in Transcritcal CO2 (R744) Heat Pump System: A Review", Energies, 12(3): 457, 2019, 1-35.
Sahu, et al., "A parametric study of transcritical CO2 simple cooling cycle and combined power cycle", International Journal of Low-Carbon Technologies, 12(4), 2017, 383-391.
Strommen, et al., "Operational Modes for Heat Pump Drying-New Technologies And Production of a New Generation of High Quality Dried Fish Products", International Congress of Refrigeration, Washington, DC., 2003, (8 pages).
Tegrotenhuis, et al., "Affordable Hybrid Heat Pump Clothes Dryer", Pacific Northwest National Laboratory, Richland, WA. Prepared for the U.S. Dept. of Energy, Jun. 2016, (78 pages).
Tegrotenhuis, W., "Clothes Dryer Automatic Termination Evaluation—vol. 2: Improved Sensor and Control Designs", Pacific Northwest National Laboratory, Richland, WA. Prepared for the U.S. Dept. of Energy, Sep. 2014, (46 pages).
Tegrotenhuis, W., "Clothes Dryer Automatic Termination Sensor Evaluation—vol. 1: Characterization of Energy Use in Residential Clothes Dryers", Pacific Northwest National Laboratory, Richland, WA. Prepared for the U.S. Dept. of Energy, Sep. 2014, (42 pages).
Triantafyllou, et al., "Visual Feature Extraction and Topological Analysis for Inferring the Configuration of Hanging Cloth", Retrieved from: https://www.iti.gr/iti/files/document/publications/02_ICCVIP2013.pdf, 2013, (6 pages).
Wei, et al., "Enhancing the Energy Efficiency of Domestic Dryer by Drying Process Optimization", Drying Technologies: An International Journal, 36(7), 2018, 790-803.
Yadav, et al., "Fabric-drying process in domestic dryers", Applied Energy, 85(2-3), 2008, 143-158.
Zhang, et al., "Commercial Clothes Dryers—Codes and Standards Enhancement (CASE) Initiative For PY 2013: Title 20 Standards Development", Analysis of Standards Proposal for Commercial Clothes Dryers, California Energy Commission. Jul. 2013, (57 pages).

* cited by examiner

AUTONOMOUS LAUNDRY HEAT PUMP SYSTEMS AND METHODS OF USE

CROSS-REFERENCE TO RELATED APPLICATIONS

This application claims priority under 35 U.S.C. § 119(e) to U.S. Provisional Patent Application Ser. No. 63/312,643 filed Feb. 22, 2022, titled "Autonomous Laundry Heat Pump Systems and Methods of Use," the entirety of which application is hereby incorporated by reference.

BACKGROUND

The present disclosure is directed to robotic laundry devices, systems, and methods.

Automating and outsourcing mundane, time-consuming household chores to robotic devices is increasingly common. Time saving home robots include, for example, floor vacuuming and floor washing robots. Outsourcing responsibilities include, for example, engaging grocery shopping and delivery services, and manually operated and human-operator dependent laundry washing and dry-cleaning pick up and return services.

Many homes are appointed with a dedicated washer and dryer for family use. Domestic washers and dryers are increasingly sophisticated and include IoT connectivity features and push notifications for alerting users about cycle progress and energy and resource usage. These technologically advanced machines, however, require human interaction and cannot eliminate the time required for processing loads of laundry in the home. Although more modern, "high efficiency" machines are equipped with sensors for metering water usage and dryer temperatures, the efficiency gains are capped by the constraints of sequentially processing single loads of laundry. Fresh water is consumed and grey water is output to the city water and sewer system for mitigation with each load of laundry processed. Energy is consumed with each load of laundry washed and dried.

Households can outsource laundry chores to laundromat facilities for a fee in exchange for time. Laundromats offering residential mixed load laundering services, however, require human interaction for intake and sorting of dirty laundry, transferring loads from washer to dryer, and then manually folding clean laundry. These are costly processes as measured in time, energy consumption, water consumption, and wastewater output, and they rely on human intervention to keep the process running at every transition and throughout several process steps. This invites delays at every stage. Because these processes are human-dependent and inefficient, the costs are passed along to the customers outsourcing their laundry for cleaning. Human-reliant laundering services also require that employees touch the belongings of the customer, potentially exposing the employee to contaminants in the dirty laundry and potentially exposing the clean laundry to transferable pathogens, dust, hair, and other debris emanating from a laundromat employee. In addition to potentially introducing undesirable contact contamination from the employees processing the loads of laundry, a privacy barrier is breached. Outsourcing household laundry to a laundromat involves employees interacting with customers' personal belongings including bodily worn garments.

Industrial laundry services exist for handling uniform business-related items, such as hospital bed sheets, medical scrubs, and hotel sheets and towels. Such industrial machines are tailor-made to accept one type of laundry item of one size or style. For example, unique folding machines exist to accept washed flat sheets, fitted sheets, hotel towels, and hotel bathrobes. These machines require human operators to load the washed article into its dedicated machine, which is sized and designed to fold that one or a small range of types and sizes of article. This type of process line relies on a human operator for properly aligning and loading the clean article into the machine, which could introduce bodily contaminants, bacteria, and viral matter into the clean articles. Like laundromat services, these industrial services rely on human intervention and potentially introduce bio-contaminants into clean loads of laundry. Because these services are only profitable by processing large volumes of like items, these industrial processors are generally subscription-based services for large clients like hotels and hospitals producing standard-size, repeat laundry articles and are not available to consumers at an individual household level. Additionally, these services are configured to combine laundry from more than one source and are not configured to isolate and process separate loads for individual households.

Autonomous robotic devices are provided to process loads of household laundry. Such devices eliminate human contact with deformable laundry articles. As such, the devices need to be designed to be time, energy, and resource efficient and reliable for replacing the common, human-dependent chore of laundry.

SUMMARY

In one example, an energy efficient autonomous laundry system includes a plurality of autonomous washing and drying machines each configured to wash and dry a plurality of loads of laundry. Each one of the plurality of autonomous washing and drying machines includes a cold side heat exchanger and a heated side heat exchanger disposed at each of the plurality of autonomous washing and drying machines, and a closed air loop including an exhaust duct configured to direct cold moist air from the drum to the cold side heat exchanger and an inlet duct configured to direct warm, dehumidified air from the heated side heat exchanger into an inlet of the drum. The cold side heat exchanger is configured to cool exhausted humid air below a dew point to condense moisture from the exhausted humid air and the heated and cold side heat exchangers being disposed in series along the closed air loop. The system includes a variable speed fan disposed in the closed air loop. The fan is configured to draw process air from the drum, through the cold side heat exchanger, heated side heat exchanger, and into the inlet of the drum. The system includes a condensate outlet disposed in the exhaust duct for directing the condensed moisture out of the exhaust duct, one or more air sensors configured to measure at least one characteristic of process air in at least one of the exhaust duct and inlet duct and output a signal indicative of the at least one air characteristic, and at least one heat pump configured to heat a heated stream of fluid disposed in a heating conduit in thermal communication with the heated side heat exchanger of each one of the plurality of washing and drying machines and cool a cooled stream of fluid disposed in a cooling conduit in thermal communication with the cold side heat exchanger of each one of the washing and drying machines. In implementations, the at least one heat pump is an electric heat pump.

The system includes a controller in operative communication with the one or more air sensors, one or more variable speed pumps configured to circulate the heated stream of fluid and cooled stream of fluid, the variable speed fan, and the heat pump. The controller is configured to receive the output signal of the one or more air sensors, analyze the at least one air characteristic associated with the one or more air sensors, the at least one air characteristic including one or more of air temperature, air flow rate, and air humidity, determine, based on the analysis, whether the at least one air characteristic is within a range of values for at least one of air temperature, air flow, and air humidity, and adjust, in response to determining at least one air characteristic is not within a range of values, one or more controls for at least one of air temperature, air flow, and air humidity at one or more locations of the system. The one or more controls include at least one of fan speed and pump speed of the one or more variable speed pumps configured to circulate the heated stream of fluid and cooled stream of fluid.

Implementations of the system may include one or more of the following features.

In examples, the heated stream of fluid and cooled stream of fluid each include at least one of at least one of water, carbon dioxide, CFC or HCFC, ammonia, a mixture of water and propylene glycol.

In examples, the heated stream of fluid includes at least one of water, carbon dioxide, CFC or HCFC, ammonia, a mixture of water and propylene glycol and the cooled stream of fluid includes another of at least one of water, carbon dioxide, CFC or HCFC, ammonia, a mixture of water and propylene glycol.

In examples, the heat pump includes a cooling tower configured exhaust heat during cooling of the cooled stream of fluid.

In examples, the heat pump is configured to heat and cool ducted refrigerant including at least one of carbon dioxide, CFC, HCFC, propane, and ammonia. The heat pump can include a condenser and the refrigerant includes carbon dioxide. In examples, the heat pump includes therewithin a heat exchange between a portion of the refrigerant cooled by the heat pump in thermal communication with the cold side heat exchanger and a portion of the refrigerant heated by the heat pump and the cooled stream of fluid and the heated stream of fluid in thermal communication with the heated side heat exchanger of each of each of the plurality of washing and drying machines. In examples, a brazed plate disposed within the heat pump is configured to effect indirect thermal transfer between the cooled refrigerant and the conduit having disposed therein the cooled stream of fluid. In examples, a brazed plate disposed within the heat pump is configured to effect indirect thermal transfer between the heated refrigerant and the conduit having disposed therein the heated stream of fluid.

In examples, the heating conduit includes a closed loop extending between the heat pump and the heated side of the heat pump and the cooling conduit includes a closed loop extending between the heat pump and the cold side of the heat exchanger. In examples, the closed loops of the heating conduit and the cooling conduit each include a plurality of branches in fluid communication with each heated side heat exchanger and cold side heat exchanger of the plurality of autonomous washing and drying machines. In examples, the system further includes at least one of a valve and a pump disposed along each one of the plurality of branches between each of the heating conduit and cooling conduit and corresponding ones of the cold side and heated side heat exchanger. The at least one of the valve and the pump of each of the cold side and heated side can be in operative communication with the controller for controlling the rate of fluid delivery to the heat exchanger.

In examples, both the cold side heat exchanger and the heated side heat exchanger include one or more indirect heat transfer chambers disposed in series.

In examples, the heated side heat exchanger and cold side heat exchanger include coil-fin units, the coil-fin units including conduit in fluid communication with one of the heating conduit and cooling conduit. The fan can be disposed between the cold side heat exchanger and the one or more heat transfer chambers of the heated side heat exchanger. The fan is configured to pull the dehumidified air from the cold side heat exchanger into the heated side heat exchanger. In examples, the heated side heat exchanger includes two or more heat transfer chambers in series along a flow of process air and the fan being disposed between two of the two or more heat transfer chambers, and the fan can be disposed between the one or more heat transfer chambers of the heated side heat exchanger and the drum.

In examples, the at least one of a valve and a pump of each of the cold side heat exchanger and heated side heat exchanger are in operative communication with the controller for controlling the rate of fluid delivery to at least one of the cold side and heated side heat exchangers. The valve can include a proportional valve and the pump can include a local speed controlled circulation pump configured to adjust the fluid flow rate at least at the heated side heat exchanger wherein reducing a flow rate of the heated stream of fluid reduces air temperature in the inlet duct of the air loop.

In examples, the variable speed pump is configured to adjust the fluid flow rate at least at the heated side heat exchanger wherein reducing a flow rate of the heated stream of fluid reduces air temperature in the inlet duct of the air loop.

In examples, the one or more indirect heat transfer chambers of the heated side heat exchanger includes a plurality of heat transfer chambers. The system can further include one or more valves disposed between the plurality of heat transfer chambers and in communication with the controller for selectively controlling which of the plurality of chambers are actively heated, thereby raising or lower the air temperature in the inlet duct of the air loop.

In examples, the fan disposed in the closed air loop can be in operative communication with the controller, wherein increasing an operating speed of the fan increases air flow rate in the closed air loop and reduces air temperature in the inlet duct.

In examples, the system further includes one or more auxiliary electrical heaters disposed at each one of the plurality of washing and drying machines. The one or more auxiliary heaters can be in operative communication with the controller and configured to at least one of directly heat air in the closed air loop and raise a temperature of an incoming heated stream of fluid disposed in the heating conduit.

In examples, the heating conduit and the cooling conduit each include a loop including a delivery line and a return line. The delivery line of the heating conduit is configured to deliver heated fluid to the heated side heat exchanger, heated fluid being a range of between about 65 C-85 C, and the return line of the heating conduit includes fluid in a range of between about 50-75 C, and wherein heated air from the heated side heat exchanger includes a temperature in a range of between about 75-80 C and less than 15% relative humidity.

In examples the delivery line of the cooling conduit is configured to deliver cooled fluid to the cold side of the heat exchanger, cooled fluid being a range of between about 5 C-20 C, and the return line of the cooling conduit includes fluid in a range of between about 15 C-35 C. At least one of the return lines of the heating and cooling conduit can be configured to supply a corresponding one of heat or cold to one or more facilities processes. The facilities processes include at least one of heating process water for delivery into the washing and drying machine during a washing cycle, heating steam for steam cleaning or disinfection, and heating or cooling air in communication with building HVAC. In examples, the system further includes one or more insulated buffer tanks configured to hold and selectively disperse at least one of heated process water, cooled process water, heated fluid for introduction into the heated stream of fluid, and cooled fluid for introduction into the cooled stream of fluid.

In examples, the system further includes a lint filter disposed in the closed air loop, the lint filter being configured to capture lint from process air circulating through the closed air loop between the exhaust duct and the inlet duct.

In examples, the cold side heat exchanger includes one or more finned heat exchanger chambers disposed in series, each of the one or more chambers being oriented such that the fins of the one or more chambers are angled relative to the direction of airflow and disposed higher that the condensate outlet such that an air path of process air moving in the closed air loop is upwards from the condensate outlet to the cold side heat exchanger. The system can further include a rinse nozzle disposed within the closed air loop above the cold side heat exchanger, the rinse nozzle being in operative communication with the controller for selectively delivering rinse water to the fins of the cold side heat exchanger to rinse lint off the fins.

In examples, each washing and drying device is configured to pivot from a substantially upright position to a substantially inverted position. A length of the inlet duct can be in a range of between about 30 percent longer to twice as long as a direct distance from an outlet of the heated side heat exchanger to the inlet of the drum when the drum of the washing and drying device is disposed between the substantially upright and substantially inverted positions such that an axis of drum rotation is substantially horizontal.

In examples, each washing and drying device is configured to pivot from a substantially upright position to a substantially inverted position, at least one of the inlet duct and the exhaust duct extends from an orifice in rear end of the drum, and when the drum of the washing and drying device is disposed between the substantially upright and substantially inverted positions such that an axis of drum rotation is substantially horizontal, the at least one of the inlet duct and a duct length of the exhaust duct is in a range of between about 50 percent longer to twice as long as a direct distance between the orifice and an air inlet to a first heat exchanger including one of the heated side heat exchanger and the cold side heat exchanger corresponding with the at least one of the inlet duct and exhaust duct, wherein the orifice is a corresponding one of an air inlet and an exhaust outlet.

In one example, a method of treating air disposed in a plurality of closed air loops associated with a corresponding plurality of combination washing and drying machines includes signaling a fan disposed in one of the plurality of closed air loops to pull the air through an exhaust conduit extending between a drum of one of the plurality of combination washing and drying machines and a cold side heat exchanger and through a heated side heat exchanger into an inlet conduit extending between the heated side heat exchanger and an air inlet of the drum, the cold side heat exchanger being configured to lower the air below a dew point and the heated side heat exchanger being configured to provide heated dehumidified air to the air inlet of the drum, providing cooled fluid from a heat pump to the cold side heat exchanger to cool the air flowing therethrough; and providing heated fluid from the heat pump to the heated side heat exchanger to heat the air flowing therethrough.

Implementations of the method may include one or more of the following features.

In examples, providing the cooled fluid includes continuously pumping the cooled fluid to the cold side heat exchanger. In examples, providing the heated fluid includes pumping the heated fluid to the heated side heat exchanger at least one of continuously and on demand. At least one of providing the cooled fluid and providing the heated fluid can further include signaling at least one of a valve or a pump disposed along piping for each of the cooled and heated fluid to allow fluid to flow to at least one of the cold side heat exchanger and heated side heat exchanger. Treating air in at least one of the plurality of closed air loops can include an indirect thermal transfer between fluid from the heat pump and air in the closed air loop.

In examples, the method further includes instructing the fan to turn off upon receiving a signal indicative of drying completion. The received signal can include one or more signals output from one or more sensors configured to detect one or more air characteristics indicative of drying completion, the air characteristics including at least one of air temperature, air humidity, and rate of change of at least one of air temperature and air humidity.

DETAILED DESCRIPTION

This disclosure relates to autonomous robotic devices, systems, and methods for handling residential loads of laundry and energy efficiencies of the washing and drying processes. The system includes one or more autonomous process lines comprising a plurality of autonomous robotic devices configured to work in concert to process a plurality of dirty loads of household laundry comprising dirty, non-uniform articles and individually separate and fold cleaned laundry articles. The plurality of autonomous robotic devices operate without human intervention to efficiently and effectively launder a customer's dirty items. This disclosure relates to autonomous robotic devices configured to wash and dry loads of deformable laundry articles automatically introduced and automatically removed from a combined washer dryer for introduction to a clean laundry separating robot. Laundry articles are collected from households and delivered to the process line for cleaning. The autonomous processes are time and cost efficient, eliminate human intervention-based delays, eliminate line workers and associated potential introduction of human contaminants introduced by line workers, and eliminate any concerns with having private personal items handled by strangers.

Additionally, methods and systems described herein with regard to implementations comprise features dedicated to reducing energy and resource consumption while effectively and efficiently laundering loads of residential laundry across a plurality of washing and drying robots serviced by a centralized heat pump. At each washing and drying robot, a fan circulates a closed loop of process air, drawing moist, warm air from the drum of the washing and drying robot. The moist warm air passes through a cold side heat exchanger to lower its temperature below the dew point to remove water through condensation, and then passes through a hot heat exchanger where it is reheated and returned to the drum to continue drying one or more laundry articles disposed within the drum. The system comprises a closed air loop such that heated process air used in the drying cycle is not vented to ambient and instead is pulled through a series of local heat exchangers such that energy from the process air is reclaimed for reuse by a central heat pump.

Figure 1:
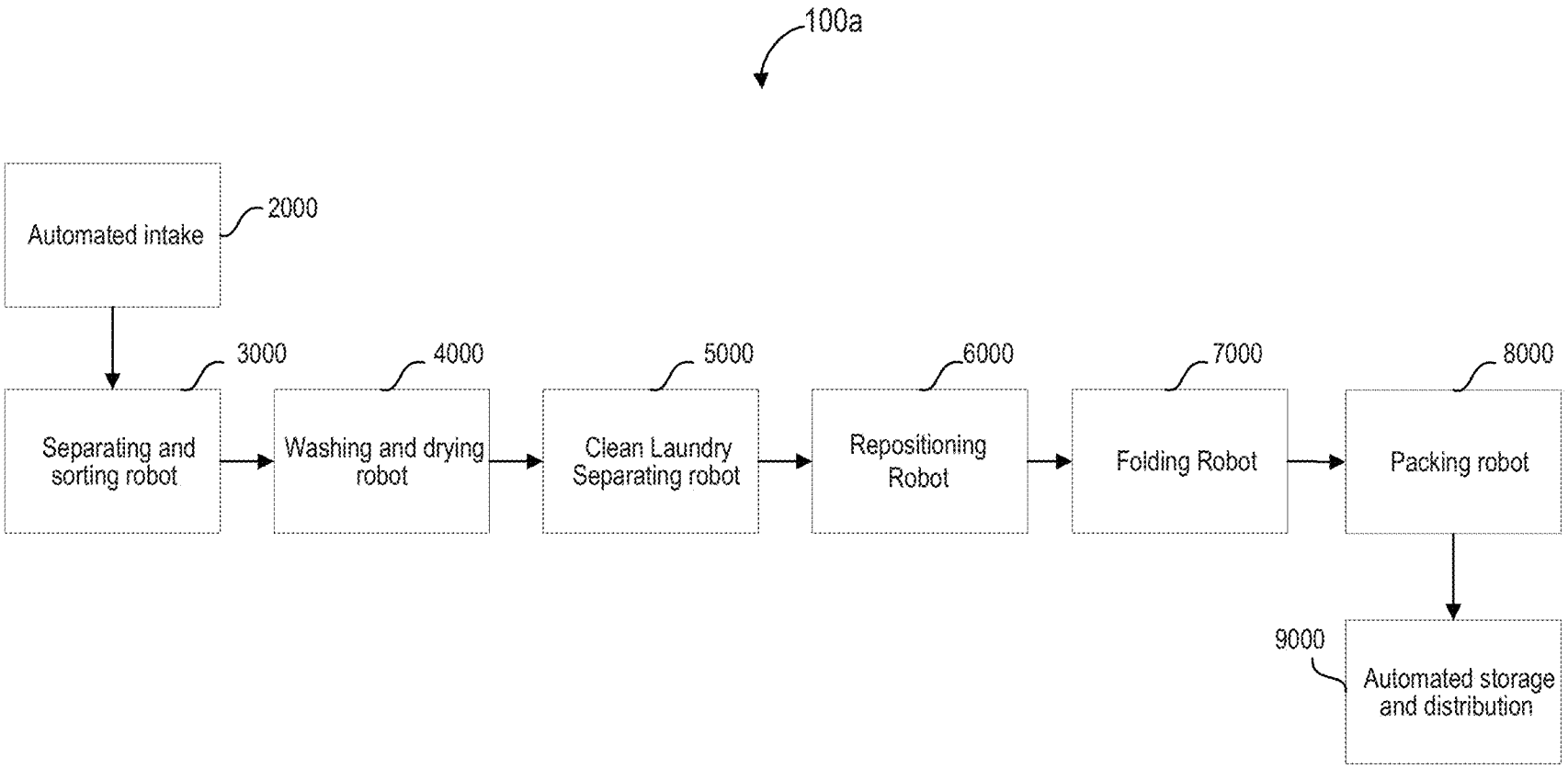
FIG. 1 depicts a schematic of an example autonomous robotic laundry process line.

As shown in FIG. 1, in implementations of the system, a process line 100*a* comprises a plurality of autonomous robots configured to operate in series without human intervention to process and transport dirty laundry through the cleaning process, and fold and repackage the clean laundry for return to a household. In one implementation, the process line 100*a* comprises an automated intake robot 2000 for receiving a load of dirty household laundry comprising a plurality of deformable laundry articles. The deformable laundry articles can be non-uniform in type, size, shape, color, and fabric. For example, the plurality of deformable laundry articles can include items commonly laundered in homes, such as sheets, towels, tablecloths, and adult and children's garments, for example, tee shirts, pants, socks, undergarments, dresses, dress shirts, and blouses. The autonomous intake robot 2000 is configured to introduce the plurality of deformable laundry articles to a separating and sorting robot 3000 configured to separate out each one of the deformable laundry articles of the plurality of deformable laundry articles. In implementations, the separating and sorting robot 3000 is configured to sort each one of the separated deformable laundry articles into one or more related batches, or loads, for washing. In implementations, the separating and sorting robot 3000 is configured to intelligently batch the separated each one of the deformable laundry articles according to a programmed sorting algorithm based, for example, on criteria including at least one of material color, material type, customer washing preference, water temperature requirements, and load size. In implementations, the separating and sorting robot 3000 is configured to identify and record the number and types of garments in the load of laundry and provide this information to one or more robots in the process line 100*a*.

The separating and sorting robot 3000 outputs one or more intelligently sorted batches of deformable laundry articles to one or more washing and drying robots 4000 for laundering. The one or more washing and drying robots 4000 output the clean laundry articles to a clean laundry separating robot 5000. Implementations of the clean laundry separating robot 5000 can be similar or identical to the separating and sorting robot 3000. The clean laundry separating robot 5000 is configured to separate a load of clean laundry into individual deformable laundry articles for introduction into a repositioning robot 6000. In implementations, the repositioning robot 6000 receives a single deformable laundry article and manipulates and repositions it for automated introduction into a folding robot 7000, which automatically folds the laundry article for introduction to a packing robot 8000. In implementations, the packing robot 8000 automatically and autonomously packs the clean load of laundry comprising the plurality of clean and folded deformable laundry articles in a shipping container for automated redistribution to the customer. In implementations, the shipping container is a reusable container. In implementations, the shipping container is a disposable container. In implementations, the shipping container is a non-deformable container with an ingress protection rating that includes an intrusion protection rating of 5 or 6 and a moisture protection rating of any and all of 1 through 6 in accordance with the Ingress Protection Code, IEC standard 60529.

Figure 2:
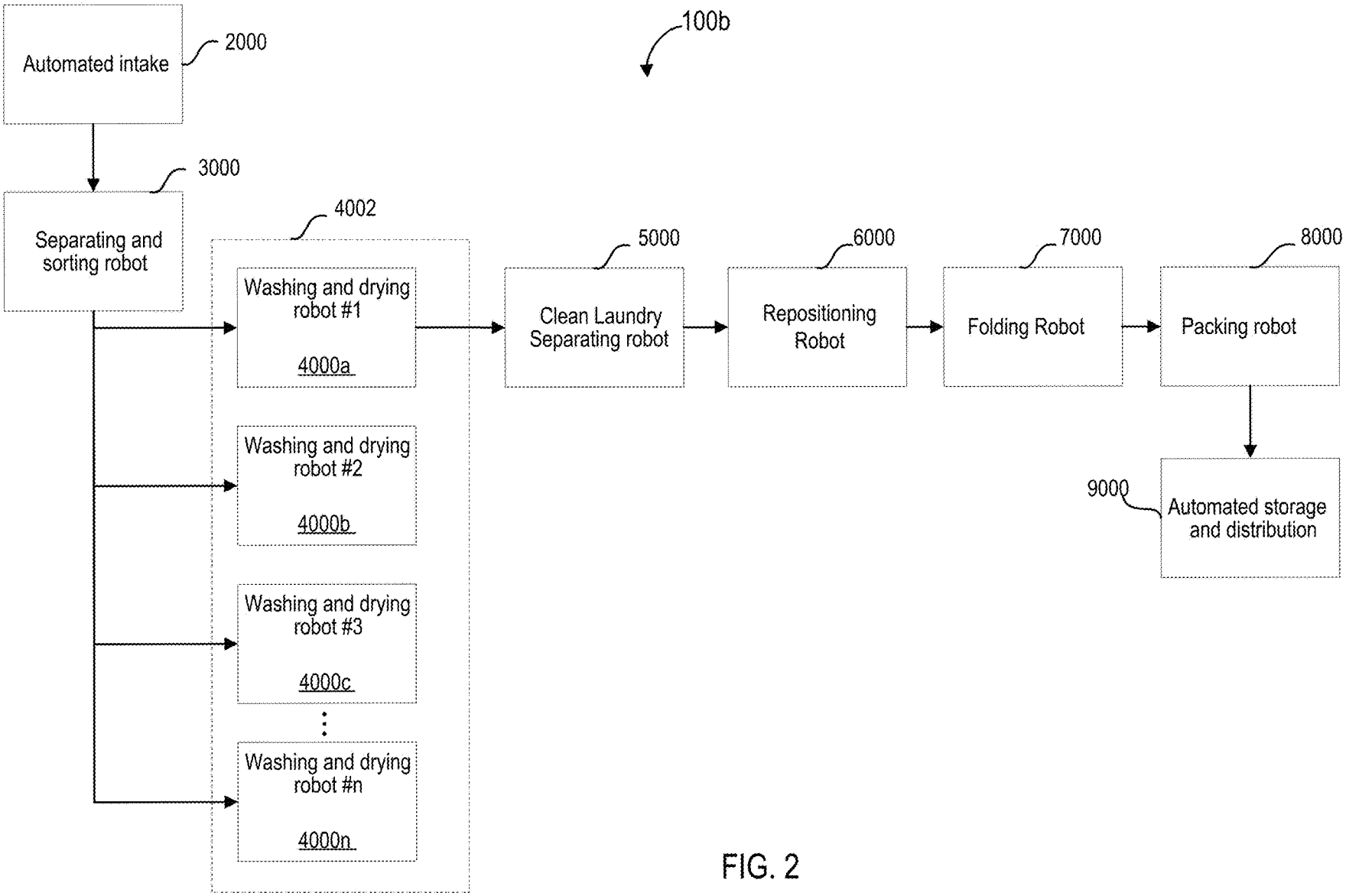
FIG. 2 depicts a schematic of an example autonomous robotic laundry process line including one laundry intake and one laundry output and a plurality of washing and drying robots.
Figure 3:
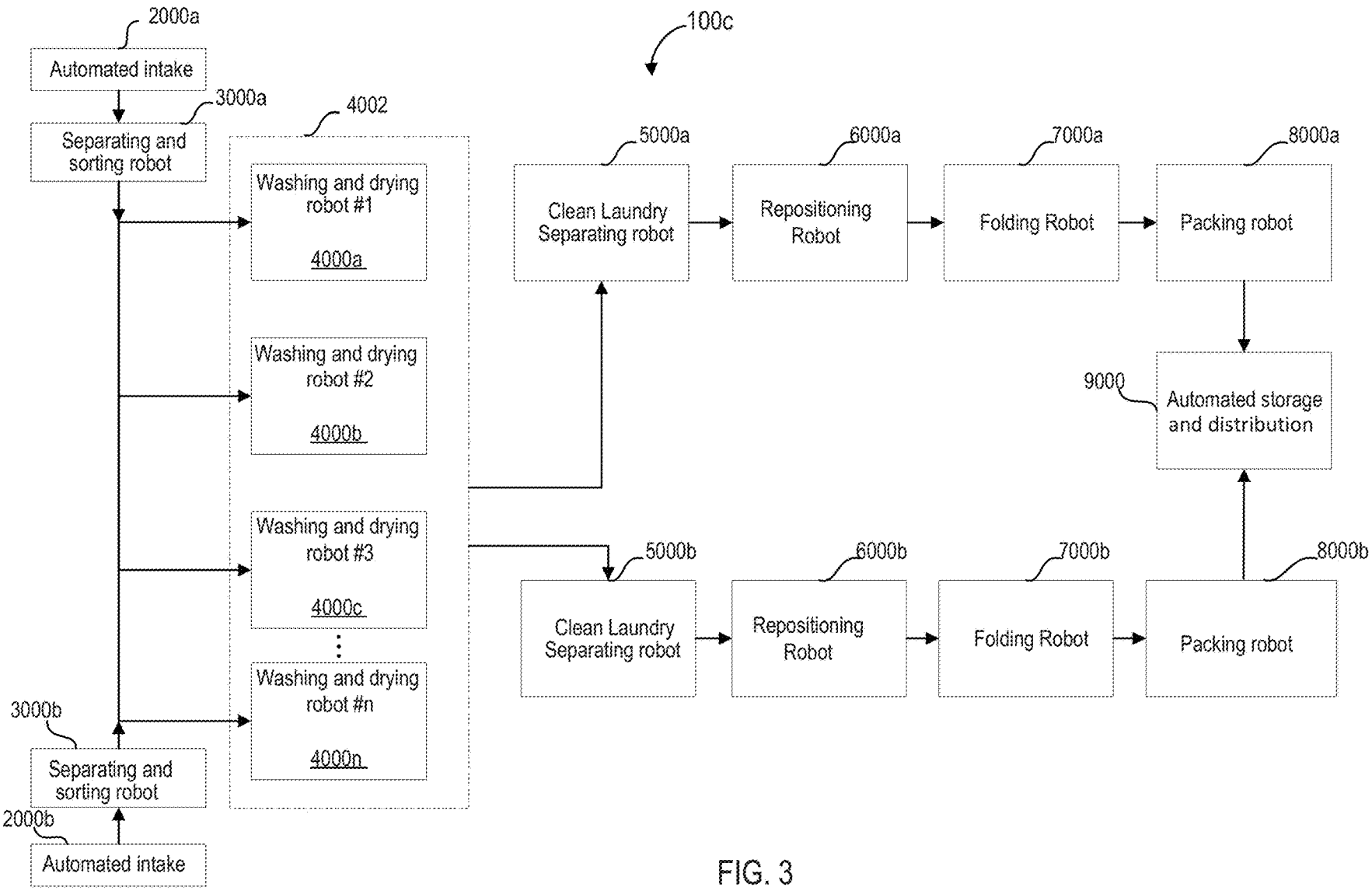
FIG. 3 depicts a schematic of a plurality of autonomous robotic laundry process lines including a plurality of intake processing paths and output processing paths and a plurality of washing and drying robots servicing the plurality intake paths and outputting laundry to the plurality of output processing paths.

Implementations of the process line 100*a* of household laundry cleaning robots can comprise one or more of each of the robots depicted in FIG. 1. For example, as shown in FIG. 2, each autonomous process line 100*b* can include a cluster 4002 comprising a plurality of washing and drying robots 4000*a-n*, wherein "n" represents a total number of robots in the cluster 4002. (Throughout the description herein "n" is used to indicate a non-determinative number of units greater than two (2) and is not intended to be limited to the number of elements shown in figures with a limited number of elements.) In implementations, a cluster 4002 comprises a plurality of combination (e.g., dual purpose, single drum) washing and drying robots 4000*a-n* ranging between about 3 to 500 washing and drying robots 4000*a-n*. In implementations, a cluster 4002 comprises between about 6 to 24 washing and drying robots 4000*a-n*. In implementations, a cluster 4002 comprises around 6 washing and drying robots 4000*a-n*. In implementations, a cluster 4002 comprises around 12 washing and drying robots 4000*a-n*. In other implementations, as shown in FIG. 3, the autonomous process line 100*c* includes a cluster 4002 of combination washing and drying robots 4000*a-n* shared by two or more sets of automated intake robots 2000*a-b* and dirty laundry separating and sorting robots 3000*a-b* and two or more sets of clean laundry separating robots 5000*a-b*, repositioning robots 6000*a-b*, folding robots 7000*a-b*, and packing robots 8000*a-b*.

In implementations, each washing and drying robot 4000, 4000*a-n* comprises a single tub for sequential washing and drying of a single load of laundry without having to remove the load of laundry therein. Additionally, two or more of the robots 1000-9000 can be combined in a single module in alternate implementations. In implementations, one or more of the robots in the process line 100*a-c* are configured to communicate over wired connections or wireless communication protocols. For example, in implementations, one or more robots in the process line 100*a-c* can communicate with another one or more robots in the process line 100*a-c* over a wired BUS, LAN, WLAN, 4G, 5G, LTE, Ethernet, BLUETOOTH, or other IEEE 801.11 standard.

Figure 4:
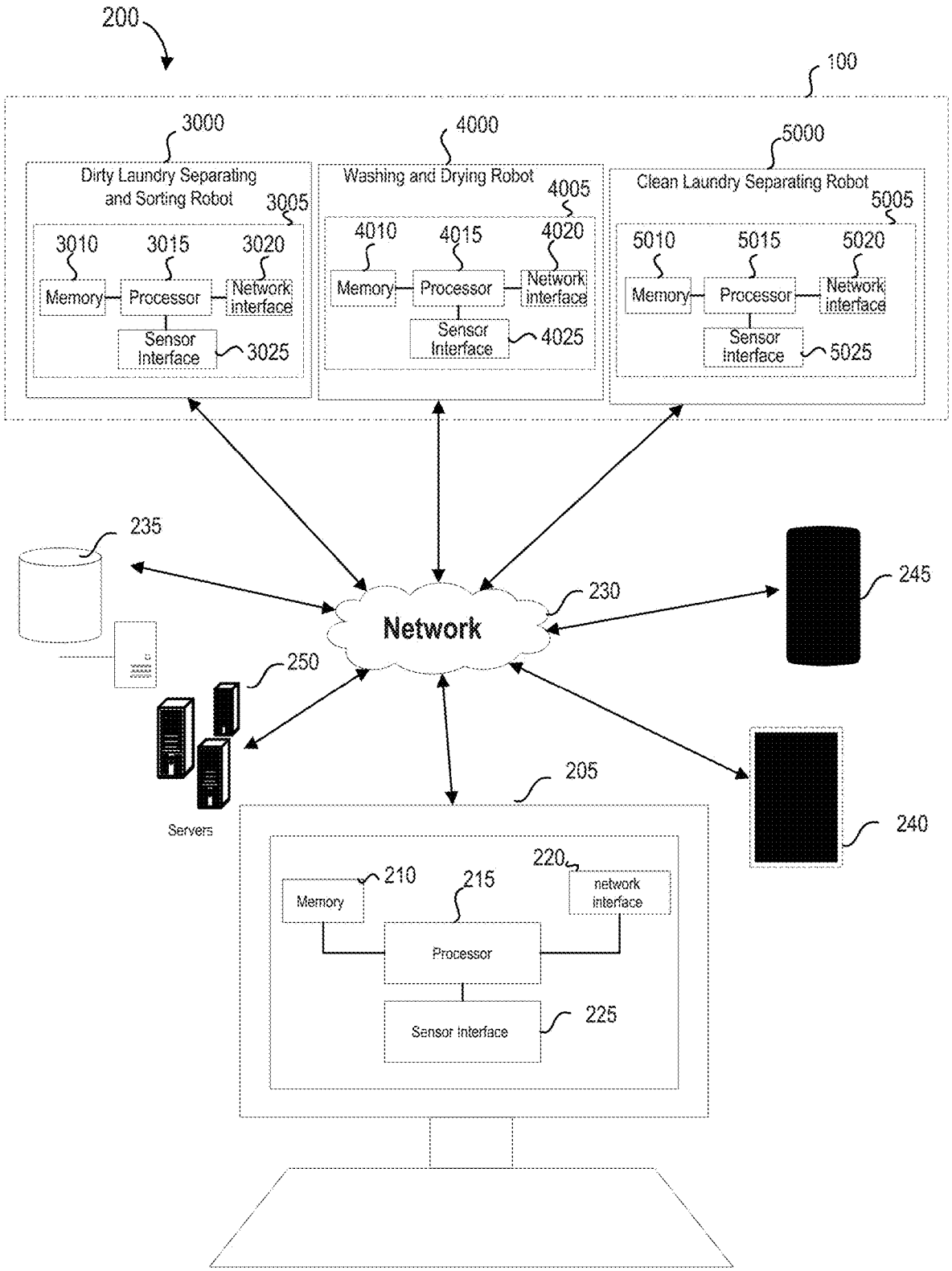
FIG. 4 depicts a schematic example of a system for controlling an autonomous robotic laundry process line.

Referring to FIG. 4, an example of a communication and interoperative control system 200 of operatively connected robots is shown. FIG. 4 depicts a schematic implementation of a portion of an automated robotic process line 100, 100*a-c*. A washing and drying robot 4000 is in operative communication with a dirty laundry separating and sorting robot 3000 configured to provide sorted and batched loads of dirty deformable laundry articles to the washing and drying robot 4000 for washing and drying. The washing and drying robot 4000 is in operative communication with a clean laundry separating robot 5000 and outputs a load of clean laundry for separation by the clean laundry separating robot 5000. Each robot 3000, 4000, 5000 includes a controller 3005, 4005, 5005 configured to operate the associated robot.

For example, in implementations, the washing and drying robot 4000 includes a controller 4005. The controller 4005 includes a processor 4015 in communication with a memory 4010, a network interface 4020, and a sensor interface 4025. The processor 4015 can be a single microprocessor, multiple microprocessors, a many-core processor, a microcontroller, and/or any other general purpose computing system that can be configured by software and/or firmware. In implementations, the memory 4010 contains any of a variety of software applications, data structures, files and/or databases. In one implementation, the controller 4005 includes dedicated hardware, such as single-board computers, application specific integrated circuits (ASICs), and field programmable gate arrays (FPGAs).

A network interface 4020 is configured to couple the controller 4005 to a network 230. The network 230 may include both private networks, such as local area networks, and public networks, such as the Internet. It should be noted that, in some examples, the network 230 may include one or more intermediate devices involved in the routing of packets from one endpoint to another. In implementations, the network interface 4020 is coupled to the network 230 via a networking device, such as a bridge, router, or hub. In other implementations, the network 230 may involve only two endpoints that each have a network connection directly with the other. In implementations, the network interface 4020 supports a variety of standards and protocols, examples of which include USB (via, for example, a dongle to a computer), TCP/IP, Ethernet, Wireless Ethernet, BLUETOOTH, ZigBee, M-Bus, CAN-bus, IP, IPV6, UDP, DTN, HTTP, FTP, SNMP, CDMA, NMEA and GSM. To ensure data transfer is secure, in some examples, the controller 4005 can transmit data via the network interface 4020 using a variety of security protocols including, for example, TLS, SSL or VPN. In implementations, the network interface 4020 includes both a physical interface configured for wireless communication and a physical interface configured for wired communication. According to various embodiments, the network interface 4020 enables communication between the controller 4005 of the washing and drying robot 4000 and at least one of the plurality of robots 2000, 3000, 5000, 6000, 7000, 8000, 9000 of the process line 100, 100*a-c*.

Additionally or alternatively, the network interface 4020 is configured to facilitate the communication of information between the processor 4015 and one or more other devices or entities over the network 230. For example, in implementations, the network interface 4020 is configured to communicate with a remote computing device such as a computing terminal 205 (alternatively referred to herein as "CPU 205"), database 235, server 240, smartphone 245, and server farm 250. In implementations, the network interface 4020 can include communications circuitry for at least one of receiving data from a database 235 and transmitting data to a remote server 240, 250. In some implementations, the network interface 4020 can communicate with a remote server over any of the wired protocols previously described, including a WI-FI communications link based on the IEEE 802.11 standard.

In some examples in accordance with FIG. 4, the network 230 may include one or more communication networks through which the various autonomous robots and computing devices illustrated in FIG. 4 may send, receive, and/or exchange data. In various implementations, the network 230 may include a cellular communication network and/or a computer network. In some examples, the network 230 includes and supports wireless network and/or wired connections. For instance, in these examples, the network 230 may support one or more networking standards such as GSM, CMDA, USB, BLUETOOTH®, CAN, ZigBee®, Wireless Ethernet, Ethernet, and TCP/IP, among others. In implementations, the network 230 can implement broadband cellular technology (e.g., 2.5 G, 2.75 G, 3 G, 4 G, 5 G cellular standards) and/or Long-Term Evolution (LTE) technology or GSM/EDGE and UMTS/HSPA technologies for high-speed wireless communication.

Although the controller 4005 is described herein in particular, one or more of the plurality of robots 2000, 3000, 5000, 6000, 7000, 8000, 9000 of the process line 100 includes similar components having similar functionality.

Returning to FIGS. 1-3, implementations of a process line 100, 100*a-c* for washing and drying one or more loads of dirty laundry are shown. In implementations, a large-scale, autonomous laundry facility includes a plurality of autonomous washing and drying robots 4000, 4000*a-n* arranged in one or more clusters 4002. The plurality of washing and drying robots 4000*a-n* intake process water, output grey water after washing loads of laundry, intake heated process air to dry the loads of laundry and output cool, humid air. As will be described subsequently with regard to implementations, the intake air can be heated using a centralized heat pump configured to provided heated and cooled fluid to heat exchangers within each closed air loop of each washing and drying robot 4000 of a plurality of washing and drying robots 4000*a-n* for an indirect fluid to air heat transfer. In implementations, the centralized heat pump is an electric heat pump.

Figure 5A:
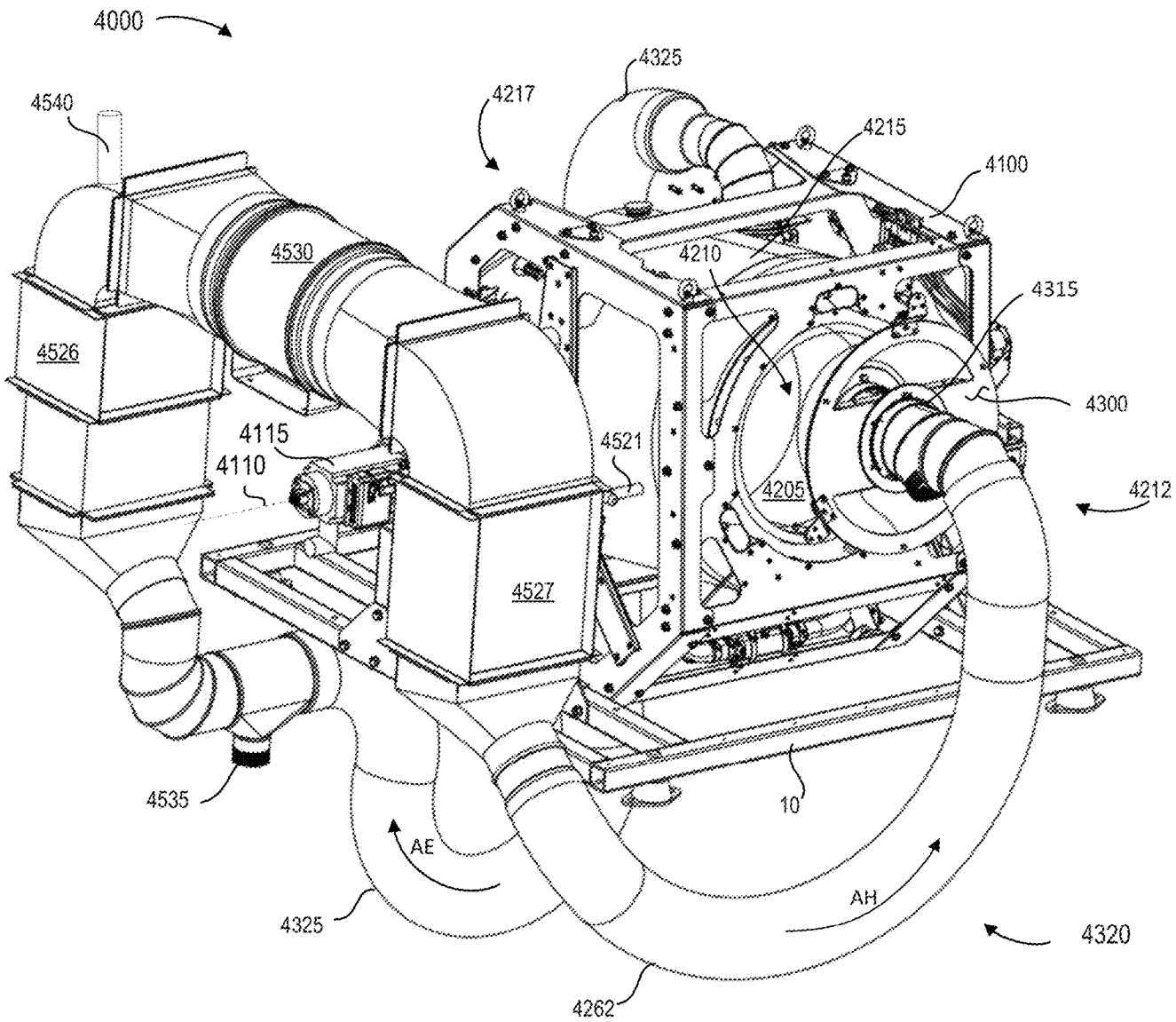
FIG. 5A depicts a front perspective view of a schematic example of an autonomous washing and drying robot and associated closed air loop and air cooling and heating heat exchangers for use in conjunction with a system including a centralized heat pump, for washing and drying laundry in accordance with the process lines of FIGS. 1-3 and system of FIG. 4.
Figure 5B:
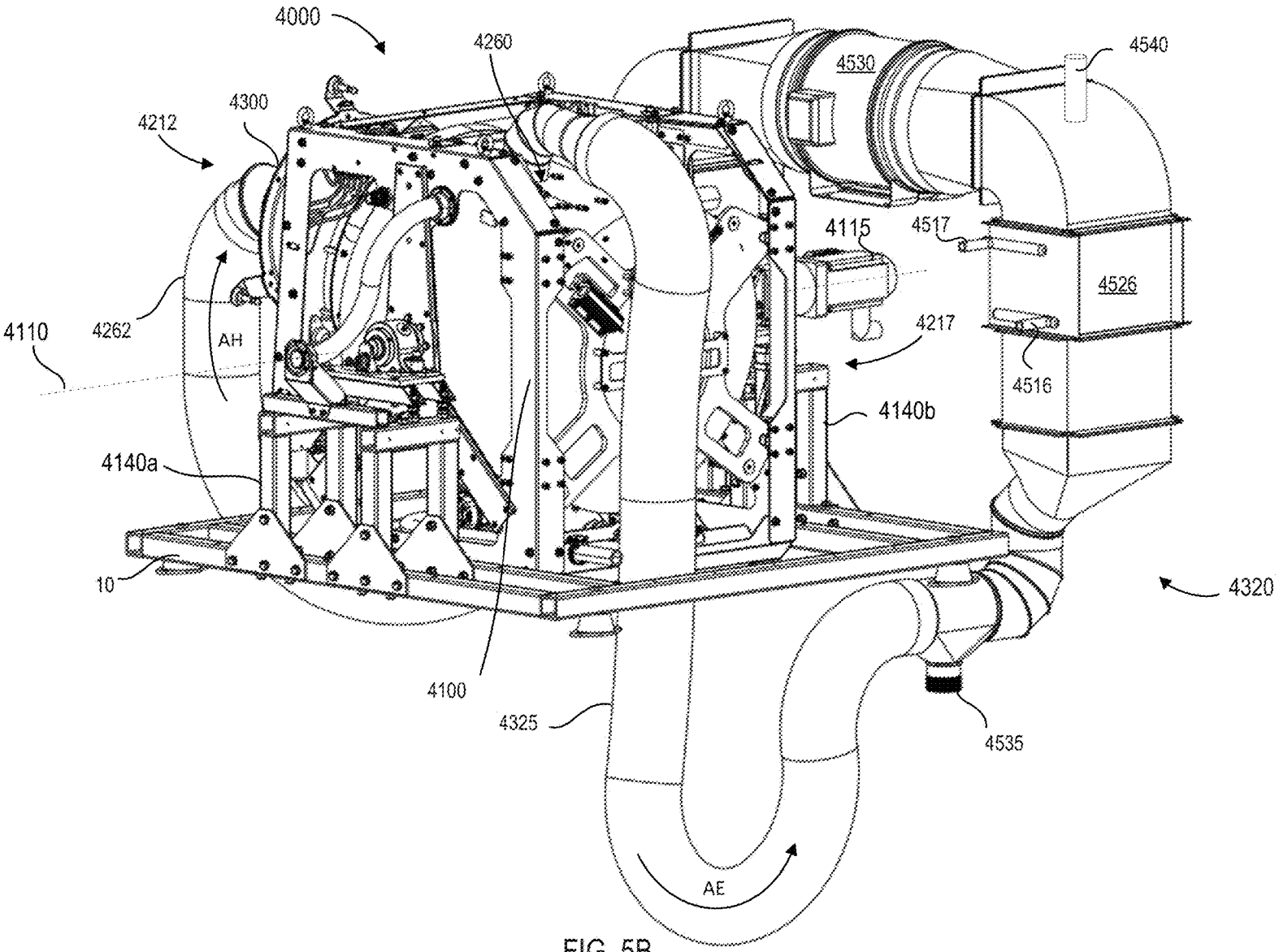
FIG. 5B depicts a rear perspective view of the washing and drying robot of FIG. 5A.

As shown in FIGS. 5A-B, each drying machine, for example a combination washing and drying robot 4000 has a separate, dedicated closed air loop 4320 extending between an air exhaust outlet 4260 disposed adjacent a rear end 4217 of the tub and drum assembly 4200 and an air inlet 4315 of a sealed washing and drying robot 4000. In implementations, an orifice through the door defines the air inlet 3315 to which an inlet duct 4262 attaches. The closed air loop 4320 comprises sections of conduit (e.g., air ducts), heat exchangers, and a sealed drum of the robot 4000 for circulating and treating process air, as will be subsequently described. The exhaust air AE from the robot 4000 is dewatered by cooling below the desired dew point in a local cold side heat exchanger 4526, and then reheated to the intake temperature to be heated, dehumidified air AH by a local heated side heat exchanger 4527 for reintroduction to the robot 4000 via an inlet duct 4262. The water condensed from the exhaust air AE can be drained from a condensate outlet 4535 disposed in an exhaust duct 4325 for directing the condensed moisture out of the exhaust duct 4325, and in implementations, the condensed water can be redirected by conduit (not shown) extending from the condensate outlet 4535 to a local (e.g., within or adjacent the facility housing the robot 4000) water treatment system for recycling and reuse in subsequent washing cycles. Additionally or alternatively, the condensed water can be redirected by conduit to a drain connected to municipal sewer lines.

The air for each washing and drying robot 4000 is circulated through the closed air loop 4320 by a dedicated, variable speed fan 4530, which may be placed either between the cold side heat exchanger 4526 and heated side heat exchanger 4527 or between the heated side heat exchanger 4527 and the drum 4205 of the washing and drying robot 4000. In the implementation of FIGS. 5A-B, the exhaust air AE exits adjacent the rear end 4217 of the washing and drying robot 4000 and the intake air AH enters the front end 4212 of the washing and drying robot 4000. In implementations, the air exhaust outlet 4260 is located on a top surface of the tub 4215 adjacent the rear end 4217 and the air inlet 4315 is located at or near a center of the door 4300 such that airflow through the drum 4205 is diagonal. Although any front-to-back and back-to-front airflow will dry a load of wet laundry disposed within the drum 4205, a diagonal airflow ensures effective mixing of the air in the drum 4205 so that a load of one or more deformable laundry articles disposed therein dries uniformly, with no concentrated hot spots or cold spots. By avoiding a narrow, direct air path through the drum 4205, deformable articles throughout the drum are heated and therefore dried efficiently, avoiding longer drying cycles associated with less distributed heating throughout the drum 4205.

Figure 9:
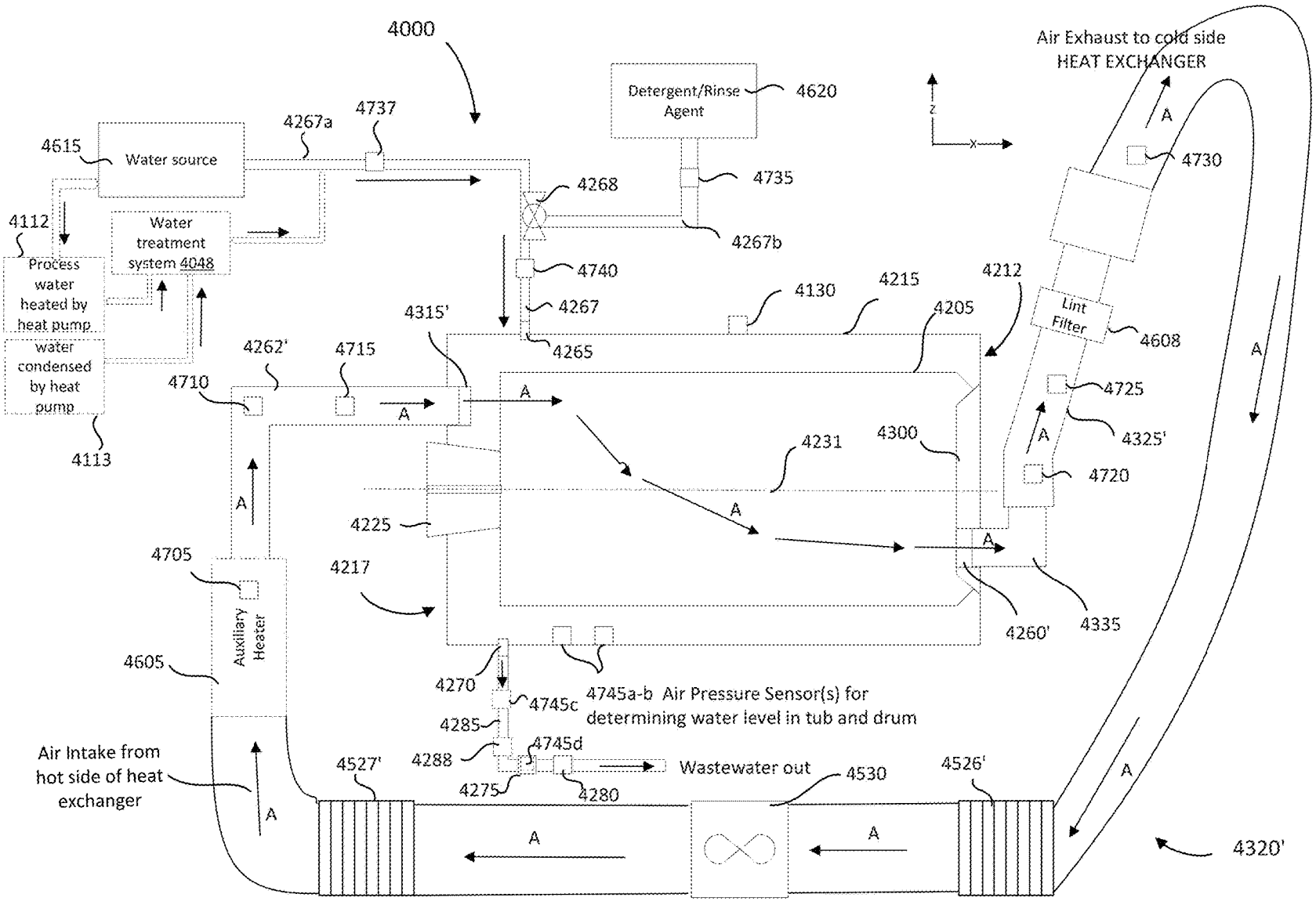
FIG. 9 depicts a side cross section schematic of an implementation of inputs and outputs and sensors measuring process parameters within a closed air loop of an individual autonomous washing and drying device.

In implementations, as shown in the schematic side view cross section of a closed air loop 4320' in FIG. 9, the airflow A within the closed air loop 4320' can be reversed. In this implementation, the order of the heated side heat exchanger 4527' and inlet duct 4262' and cold side heat exchanger 4625' and exhaust duct 4325' are swapped such that heated air AH enters an inlet 4315' at or adjacent the rear end 4217 of the robot 4000 and exhaust air AE exits an outlet 4260' disposed through the front end 4212 of the robot 4000 (e.g., a bore 4315' in a door 4300 configured to selectively seal the drum 4205).

As shown in FIGS. 5A-B and 9, the fan 4530 disposed in the closed air loop 4320, 4320' is configured to draw process air (arrows AE, AH, and A) from the drum 4205, through the cold side heat exchanger 4526, heated side heat exchanger 4527, and into the air inlet 4315, 4315' of the drum 4205. In implementations, as shown in FIGS. 5A-B, a condensate outlet 4535 is disposed in the exhaust duct 4325 for directing the condensed moisture out of the exhaust duct 4325. In implementations, as will be described subsequently in detail with regard to FIG. 9, one or more air sensors disposed in the closed air loop are configured to measure at least one characteristic of process air in at least one of the exhaust duct 4325, 4325' and inlet duct 4262, 4262' and output a signal indicative of the at least one air characteristic to a controller 205 of the system 300 for autonomously controlling process parameters including air temperature, humidity, and airflow rate.

Figure 13B:
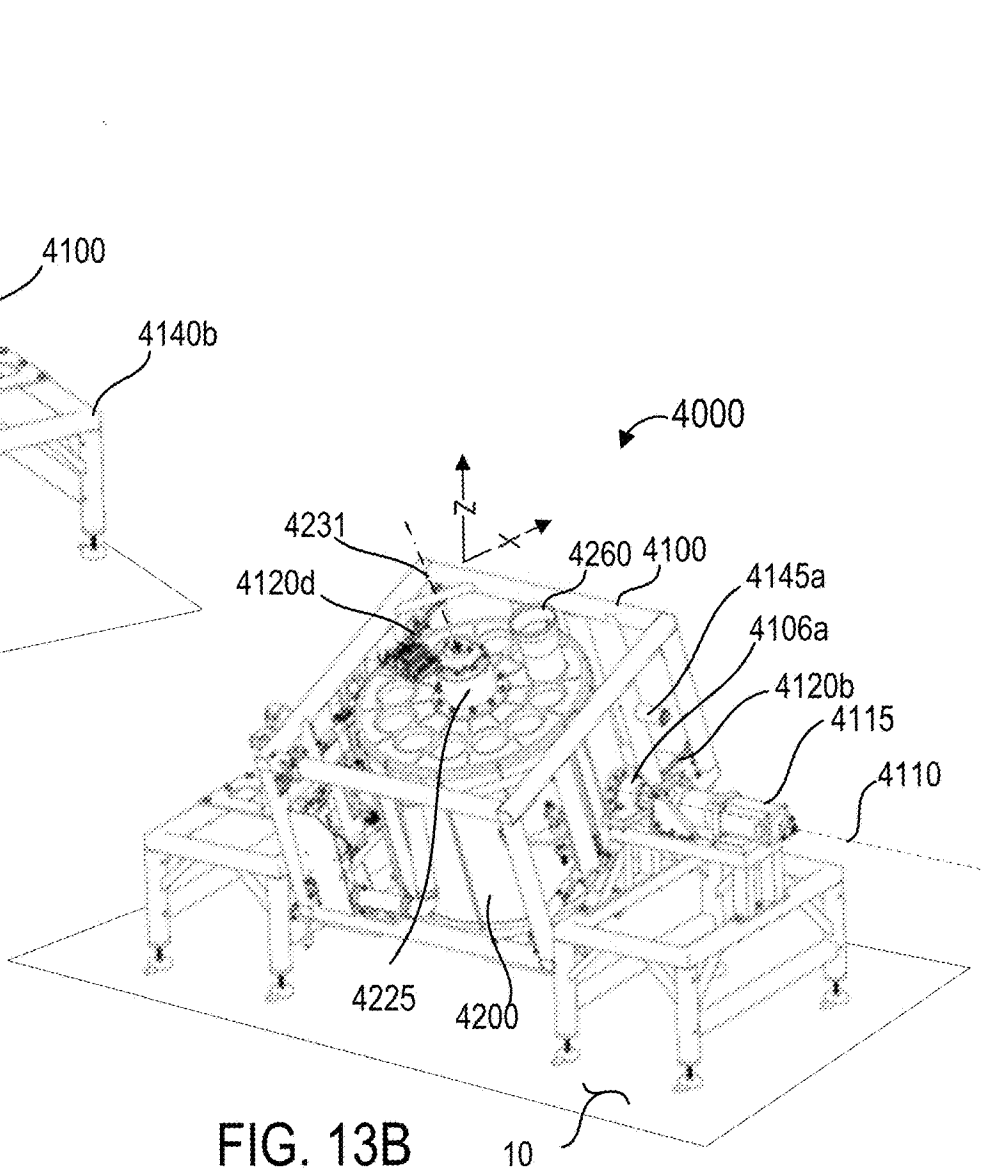
FIG. 13B depicts a front perspective view of the autonomous washing and drying robot of FIG. 13A angled in a vertically downward orientation for autonomous unloading.
Figure 13A:
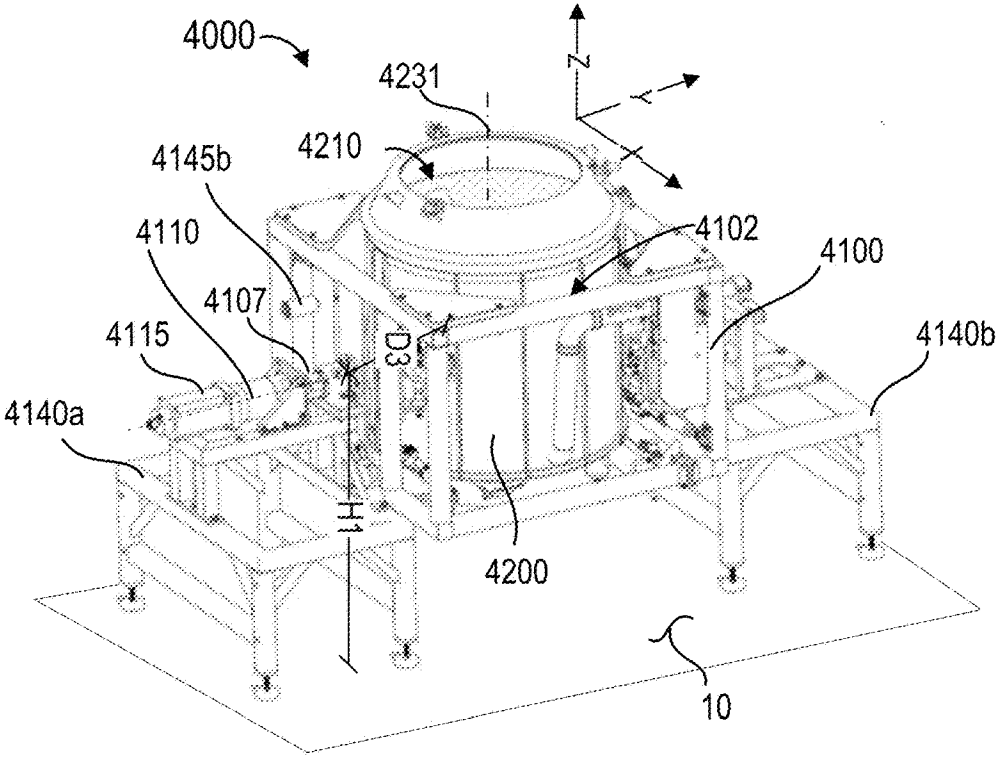
FIG. 13A depicts a front perspective view of an implementation of an autonomous washing and drying robot angled upward in a vertically upright orientation for autonomous loading.

Referring now to FIGS. 6A-8, in implementations, an energy efficient automated laundry system 300, 300', 300" (collectively, system 300) comprises a plurality of combination washing and drying robots 4000, 4000*a-n* (hereinafter alternatively referred to as a "cluster 4002" of washing and drying robots 4000*a-n*), such as the implementation of FIGS. 5A-B. In implementations, an energy efficient automated laundry system 300 comprises between about 3-500 washing and drying robots 4000, 4000*a-n* each comprising a single drum 4205 disposed within a tub configured to sequentially wash and dry loads of laundry. As shown in FIGS. 5A, 9, and 13A, each washing and drying robot 4000 is an autonomously operating machine comprising a selectively sealed tub opening 4210 in a front end 4212 of the tub and drum assembly 4200 for receiving the load of laundry introduced from an automated infeed, a moveable door 4300 configured for selectively sealing the opening 4210, an air inlet 4315, 4315', and an air outlet 4260, 4260'. Subsequently, for clarity, the air inlet 4315 and an air exhaust outlet 4260 will be referred to as shown in FIGS. 5A-B, but in all implementations described herein, the airflow of process air through the closed loop 4320 can be reversed as previously described.

Figure 6A:
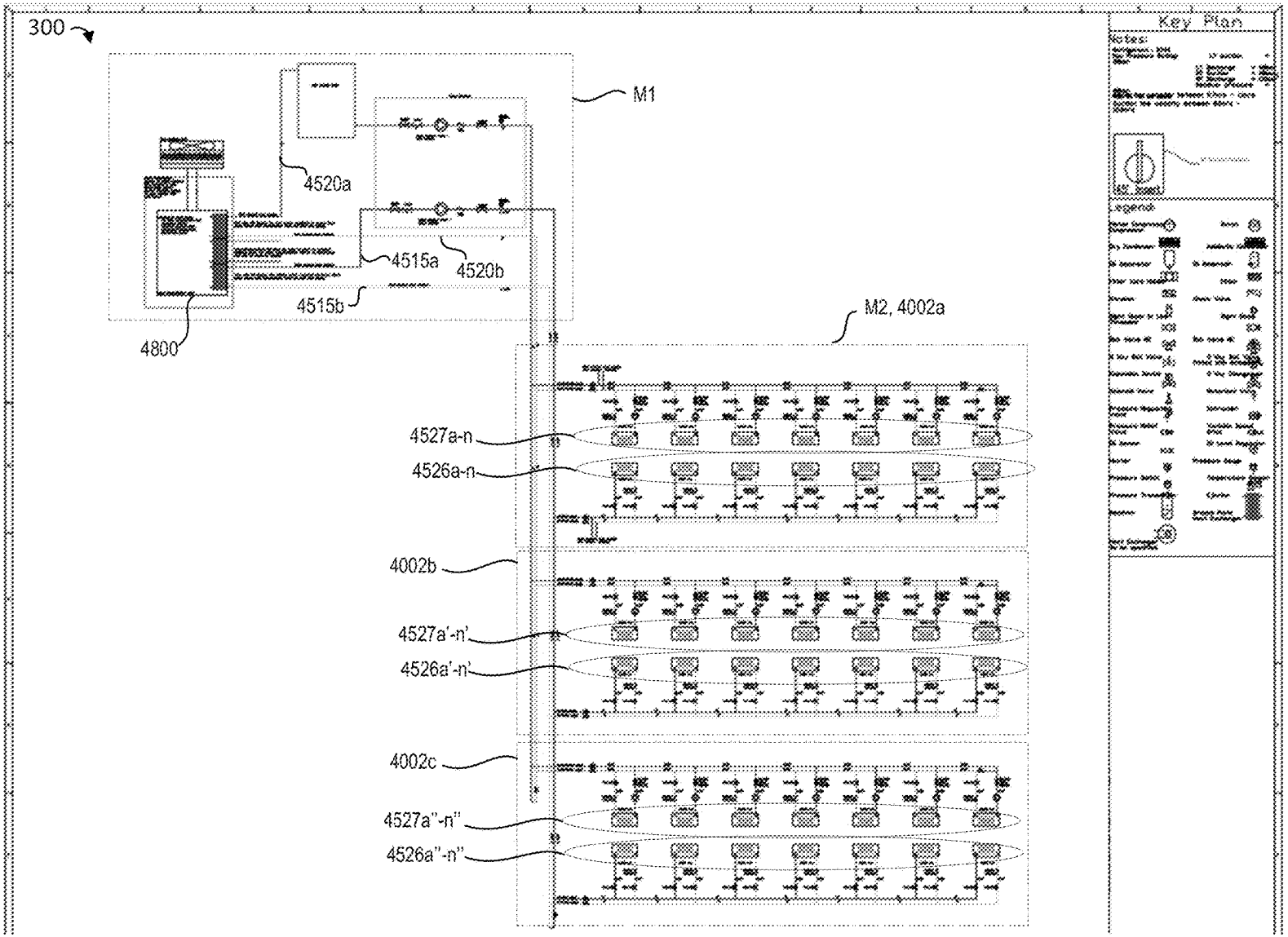
FIG. 6A depicts an example facility layout of an autonomous system including a centralized heat pump servicing pairs of heated side and cold side heat exchangers disposed at a plurality of washing and drying robots.

As previously described with regard to FIGS. 5A-B, each one of the plurality of autonomous washing and drying robots 4000, 4000*a-n* (alternatively referred to herein throughout as washing and drying machines 4000, 4000*a-n*) comprises a cold side heat exchanger 4526 and a heated side heat exchanger 4527 disposed at each one of the plurality of autonomous washing and drying machines 4000 within a closed air loop 4320 connected to inlet and outlet air orifices of the individual washing and drying machine 4000. Accordingly, as shown in FIGS. 6A and 6C, each cluster 4002*a-c* of robots 4000*a-n* comprises a plurality of cold side heat exchangers 4526*a-n, a'-n', a"-n"* and a plurality of heated side heat exchangers 4527*a-n, a'-n', a"-n"*, with one pair of a cold side heat exchanger 4526 and heated side heat exchanger 4527 being dedicated to a single one of each closed air loop 4320 of the plurality of robots 4000. Additionally, as will be described subsequently in more detail, the system 300 comprises at least one heat pump 4800 configured to heat a heated stream of fluid disposed in a heating supply conduit 4520*a* in thermal communication with each heated side heat exchanger 4527, 4527*a-n* of each one of the plurality of washing and drying machines 4000 and cool a cooled stream of fluid disposed in a cooling supply conduit 4515*a* in thermal communication with the cold side heat exchanger 4526 of each one of the washing and drying machines 4000.

As previously introduced, the system 300 comprises the controller (e.g., controller 205) in operative communication with the one or more air sensors, the heat exchangers 4526, 4527, and the heat pump 4800. In implementations, the controller 205 is configured to receive the output signal of the one or more air sensors and analyze the at least one air characteristic associated with the one or more air sensors. In implementations, the at least one air characteristic comprises one or more of air temperature, air flow rate, and air humidity. The controller is configured to determine, based on the analysis, whether the at least one air characteristic is within a range of values for at least one of air temperature, air flow, and air humidity, and adjust, in response to determining at least one air characteristic is not within a range of values, one or more controls for at least one of air temperature, air flow, and air humidity at the one or more locations of the system. The one or more controls can vary depending on measured parameters and/or their rate of change at various stages of a drying cycle, as will be described subsequently with regard to implementations.

Figure 6B:
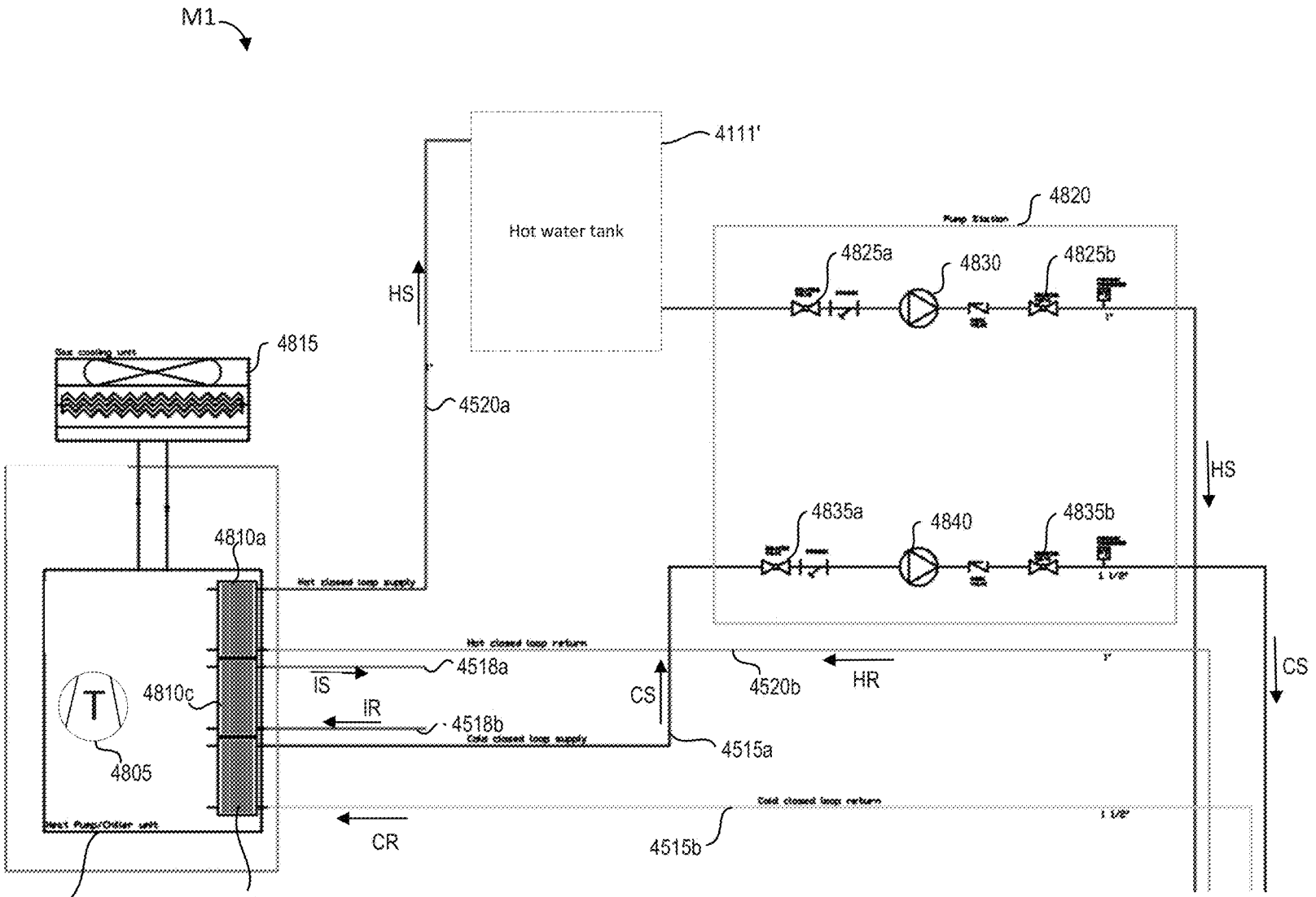
FIG. 6B depicts a magnified view of the heat pump portion of the system of FIG. 6A.
Figure 6C:
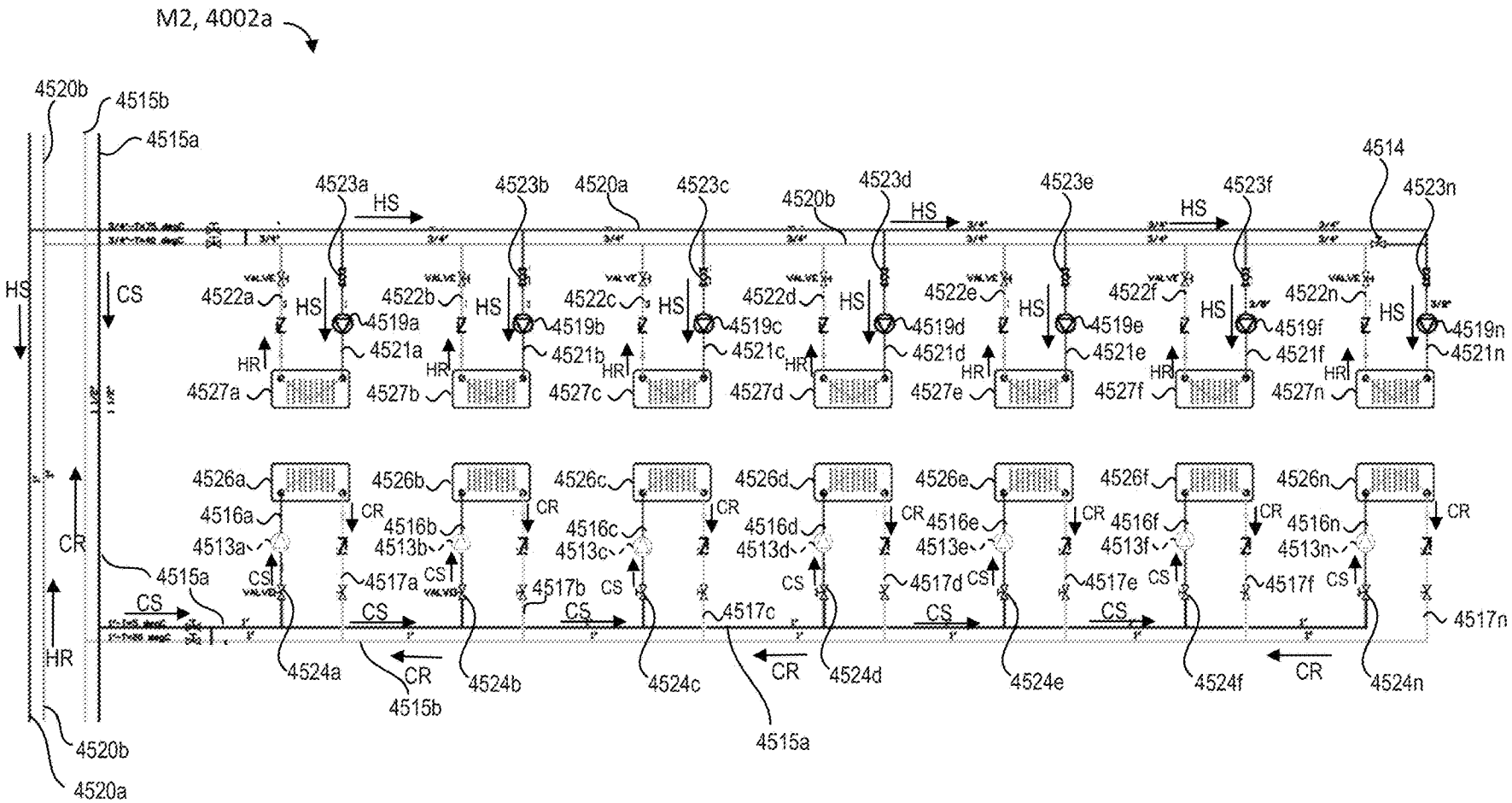
FIG. 6C depicts a magnified view of one of the clusters of paired heated side and cold side heat exchangers of the system of FIG. 6A.

As shown in the facility schematic of FIGS. 6A-C, in implementations during a drying cycle, a heat pump 4800 circulates a supply of heated refrigerant and cooled refrigerant through supply pipes (e.g., conduit) routed throughout the facility to the respective heated side heat exchangers and cooled side heat exchangers located at each one of the plurality of washing and drying robots 4000, 4000*a-n*. The heated and cooled supplies of refrigerant enable the heat exchangers to dehumidify exhaust air AE (e.g., cools below dew point causing the moisture vapor contained therein to condense) and heat process intake air AH in the closed air loop 4320 to a preset process intake temperature required to dry a load of laundry within a drum 4205. As will be described subsequently with regard to implementations, a sensor feedback loop is configured to provide a system controller with measured data representative of process air characteristics for determining dynamic adjustments to temperature and airflow velocity of heated intake air AH throughout a drying cycle. In implementations, dynamic adjustments can include at least one of increasing or decreasing the speed of the closed air loop fan 4530, increasing or decreasing the refrigerant fluid flow in the heating loop 4520*a-b* and cooling loop 4515*a-b* using at least one of booster pumps (e.g., 4519) and controllable valves (e.g., 4323, 4324), controlling the power to a booster heater 4605, and controlling dampers or valves in at least one of the closed air loop 4530 and refrigerant flow paths (e.g., the heating loop 4520*a-b* and cooling loop 4515*a-b*). Instead of running high powered, energy intensive fans to circulate facility wide air ducting around a cluster 4002 or plurality of clusters 4002 in large diameter air ducts, the heat pump 4800 circulates heated and cooled fluid in narrow (e.g. 1 inch, 1.25 inch, 2 inch) conduit 4520*a-b*, 4515*a-b* around a facility for delivery to each pair of machine-dedicated heat exchangers 4627, 4527 of the plurality of washing and drying robots 4000*a-n*. Each loop of conduit 4520*a-b*, 4515*a-b* branches off to each of one of the plurality of washing and drying robots 4000*a-n* in pairs of local heating supply and return conduit 4521, 4522 and pairs of local cooling supply and return conduit 4516, 4617.

The configuration enables the implementation of a relatively short, closed-loop process air loop 4320 and temporally short duration air cycle through the loop 4320 at each washing and drying robot 4000 in a cluster 4002. The shorter air loop 4320 prevents thermal losses associated with extended runs of air ducts. The closed air loop 4320 enables a relatively more precisely temperature and humidity-controlled supply of heated air to a drum 4205 and the particular load of laundry and associated drying cycle changes of that load of laundry within the drum 4205. The system 300 is therefore configured to respond actively to changes in the detected air characteristics throughout the drying cycle, as will be described subsequently.

Additionally, in implementations, the heated air AH, A and/or circulated heated fluid in the heating supply conduit 4520*a* can be heated by at least one of an auxiliary electric resistance heater, gas furnace, geothermal heat, solar heaters, and any external heating means. The exhaust air AE and/or the chilled fluid in the cooling supply conduit 4515*a* may be alternately or additionally chilled by other sources including outside air, incoming process water, local sea or lake water, for example. In implementations, each washing and drying robot 4000, 4000*a-n* comprises an electric combination washing and drying robot 4000 with a single tub 4502 and drum 4205 disposed therein for sequential washing and drying of a single load of laundry. Challenges of minimizing energy expenditure within a facility of washing and drying robots 4000*a-n* serviced by a heat pump 4800 include load balancing temperature, humidity, water use, and water treatment and recycling across the plurality of combination washing and drying robots 4000, 4000*a-n* within a cluster 4002 and/or across a plurality of clusters 4002*a-n*. In implementations, as shown in FIGS. 6A-C, one or more clusters 4002, 4002*a-n* of washing and drying robots 4000, 4000*a-n* are serviced by the centralized heat pump 4800 in fluid communication with the dedicated heat exchangers 4526, 4527 of each one of the plurality of washing and drying robots 4000 in one or more clusters 4002.

Figure 7:
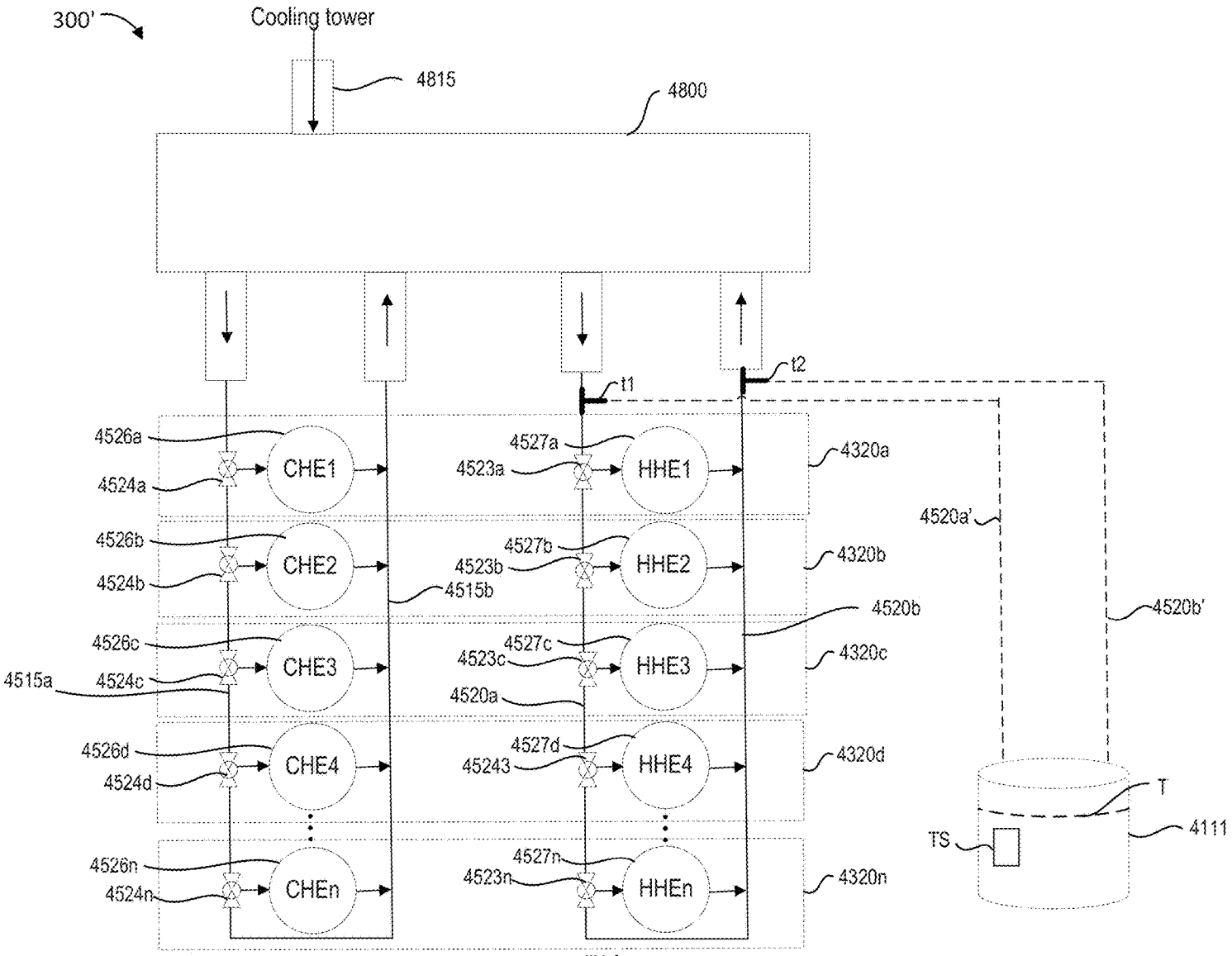
FIG. 7 depicts another schematic example of an autonomous system including a centralized heat pump supplying heated and cooled fluid to a plurality of heat exchangers disposed within closed air loops of a plurality of washing and drying robots.

As shown in the simplified schematic of FIG. 7, the centralized heat pump 4800 is used to cool one stream of fluid and heat another separate stream of fluid in the cooling supply conduit 4515*a* and heating supply conduit 4520*a*, respectively. Each of the cooled and heated streams are disposed within a loop of supply and return cooling conduit 4515*a-b* and a loop of supply and return heating conduit 4520*a-b* respectively. The fluid in each of the heating conduit 4520*a-b* and the cooling conduit 4515*a-b* comprises at least one of water, carbon dioxide, CFC or HCFC (e.g., FREON or R410), ammonia, propane, a mixture of water, and propylene glycol. Each of the heating conduit 4520*a-b* and the cooling conduit 4515*a-b* can contain the same or different mixtures of one or more fluids comprising at least one of water, carbon dioxide, a CFC or HCFC, ammonia, propane, a mixture of water and propylene glycol.

To reduce environmental impact and potential for both environmental damage and contamination of clean laundry should a conduit fail, the fluid in each of the supply and return heating conduit 4520*a-b* and supply and return cooling conduit 4515*a-b* comprises at least one of water and carbon dioxide. Carbon dioxide is an effective, non-toxic refrigerant. While carbon dioxide is a greenhouse gas, the CO2 in heat pumps is originally sourced from the atmosphere, and if there is a leak or some CO2 is released during system maintenance, an equivalent amount will be removed from the atmosphere to create the recharge for the heat pump. Additionally, carbon dioxide heat pumps do not rely on a phase change. The carbon dioxide remains gaseous throughout the cycle, although the pressures and densities change. Because of this, the heat pump 4800 can be designed over a very large temperature range, easily spanning 5 C to 85 C for supplying heating fluid and cooling fluid to the heated side heat exchanger 4527 and cold side heat exchanger 4526, respectively.

As shown in FIG. 7, the heat pump 4800 comprises one or more electrically powered compressors to raise the temperature of a refrigerant (e.g., a CFC, and HCFC, or carbon dioxide) by mechanically compressing it. For some refrigerants and temperature ranges, this step may include a phase change from gas to liquid. The heated refrigerant provides process heat to the washing and drying robots 4000*a-n*, either directly by being circulated throughout the facility, or indirectly by heating a secondary fluid circulated throughout the facility. As described herein with regard to implementations, the secondary fluid comprises at least one of water, a water/propylene glycol mixture, oil, and any other fluid suitable to the temperature range. As shown in the schematics of FIGS. 6A, 6C, and 7 heating and cooling supply and return lines 4520*a-b*, 4515*a-b* are completely independent conduit loops comprising at least one of different flow rates and temperatures.

Returning to the heat pump 4800, in implementations, the compressed, cooler refrigerant passes through a pressure reducing device, such as an expansion valve, cooling the refrigerant further. This cold refrigerant fluid supplies cooling power to the individual cold side heat exchangers 4526*a-n* of the plurality of washing and drying robots 4000*a-n* via the cooling supply conduit 4515*a* (and local offshoot conduit 4516), either directly or by means of cooling a secondary circulating fluid within the cool supply conduit for transit around the facility and deliver to one or more of the cold side heat exchangers 4526. The warmer refrigerant circulates to the compressor to restart the cycle. In implementations, the heat pump 4800 incorporates a cooling tower 4815 or other method to reject excess heat to the environment from the circulating refrigerant. Additionally or alternatively, in implementations as will be subsequently described, the heat pump 4800 comprises an intermediate temperature heat exchanger 4810*c* to utilize the excess heat to heat process water for washing, cleaning, HVAC, domestic hot water, or any other purpose.

In implementations, as shown in FIGS. 6B and 7, the heat pump 4800 comprises two or more heat exchangers 4810*a-c* at different temperatures to provide heat to different processes in the system 300, 300' via a secondary circulating fluid. For example, heated refrigerant output from the compressor is piped through a first heat exchanger 4810*a* configured to heat the fluid in the heated supply conduit 4520*a* which then heats process air in one or more closed air loops 4320*a-n* to a high temperature for drying laundry within one or more drums 4205*a-n*. At a second heat exchanger 4810*b* of the heat pump 4800, cooled refrigerant is piped through the second heat exchanger 4810*b* configured to cool the fluid in the cooling supply conduit 4515*a* for dehumidifying process air circulating through the cold side heat exchanger 4526 in each closed air loop 4320. In implementations, a third (e.g., intermediate temperature) heat exchanger 4810*c* in fluid communication with and disposed between the first and second heat exchangers 4810*a-b* of the heat pump 4800, is configured to circulate somewhat cooler but still warm refrigerant. That refrigerant, at a temperature between those in the first and second heat exchangers 4810*a-b*, is configured to heat a secondary fluid in a warm supply conduit 4518*a* to heat at least one of building air inside the facility and process water used in a wash cycle at each one of the plurality of washing and drying robots 4000*a-n*. As refrigerant heated by the compressor 4805 of the heat pump circulates through the first, the third, and the second heat exchangers, the temperature of the refrigerant drops.

In implementations, more heat is generated by the compressor 4805 of the heat pump 4800 than can be utilized in the drying process and/or in auxiliary processes such as heating wash water, domestic hot water, HVAC, or for other uses, which must be rejected to the environment. For this purpose the heat pump 4800 comprises a condenser to draw excess heat from the compressed gaseous phase of CFC or HCFC refrigerant output from the compressor. In implementations, the refrigerant comprises carbon dioxide (CO2) and the condenser is substituted by a gas cooler because the CO2 remains gaseous. In implementations, the heated and chilled fluid disposed respectively in the heating conduit 4520*a-b* and cooling conduit 4515*a-b* comprises a secondary fluid, such as water. In implementations, the fluid disposed in the heating conduit 4520*a-b* comprises compressed heated CO2 and at least the first heat exchanger 4810*a* can be eliminated from the heat pump 4800. In implementations the heat pump 4800 comprises multiple compressors which may be switched on and off independently depending on the required cooling or heating load of a plurality of washing and drying robots 4000*a-n* and one or more clusters 4002*a-n* of washing and drying robots. In implementations, one or more of the compressors may be powered by a variable speed drive that enables automated, dynamic adjustment of the total compressor output in response to variations in the demand due to load sizes or composition, plant operation considerations, or any other reason. In implementations the system 300, 300' may also comprise storage tanks configured to retain heated or chilled circulating fluid to at least one of: balance the load on the system, to avoid operation during grid peak load periods, and to take advantage of reduced electricity rates at specific times.

Figure 8:
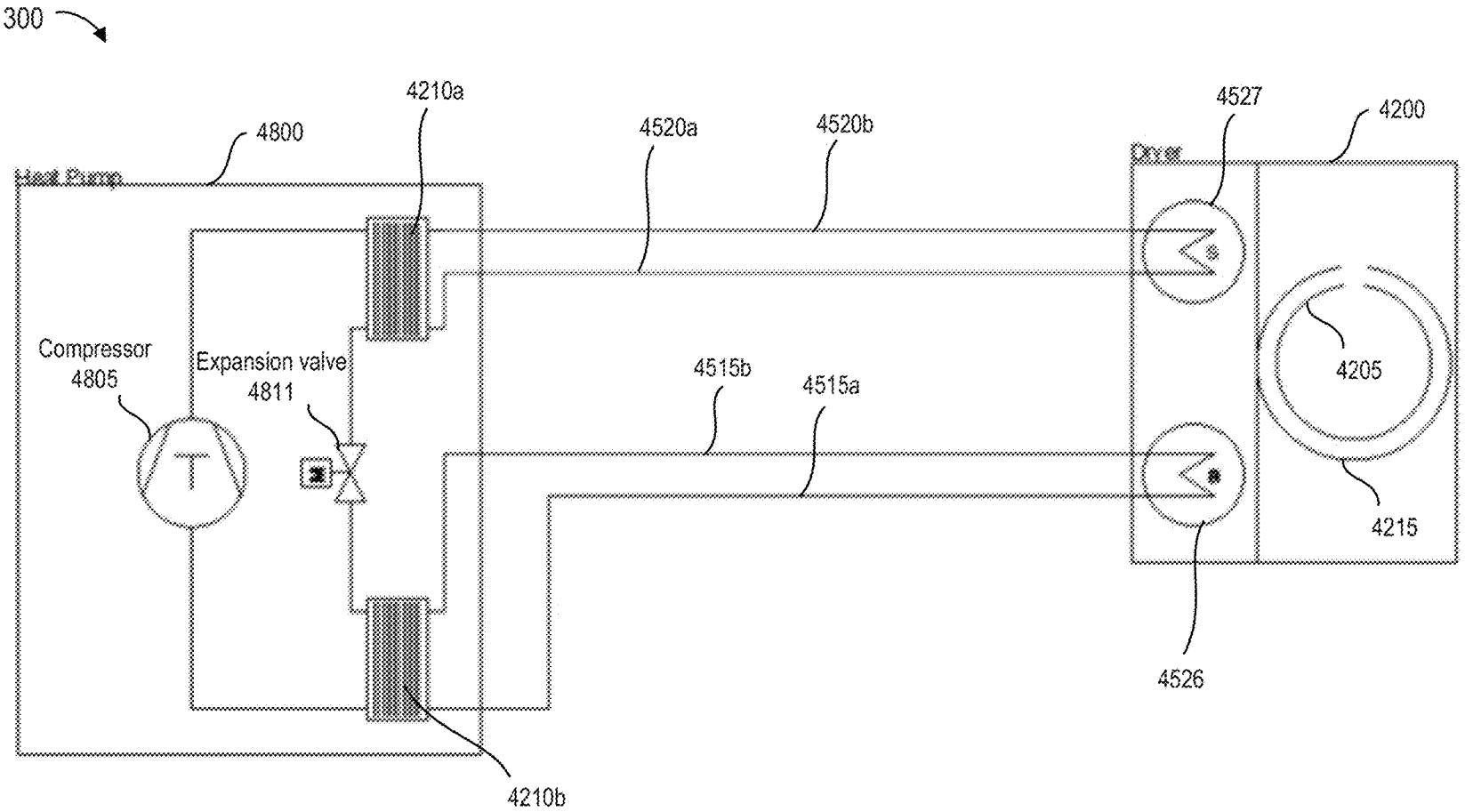
FIG. 8 depicts a schematic example of a single washing and drying robot and associated heating and cold side heat exchangers supplied with heated and cooled fluid by a centralized heat pump.

Taking FIGS. 6C, 7, and 8 together, the cooling supply and return conduit 4515*a-b* comprises a closed loop extending between the heat pump 4800 to the cold side heat exchanger 4526 of each of each one of the plurality of washing and drying machines 4000*a* and back from the cold side heat exchanger 4526*a-n* to the heat pump. The heating supply and return conduit 4520*a-b* comprises a closed loop extending between the heat pump 4800 and a heated side heat exchanger 4527 of each one of the plurality of washing and drying machines 4000*a-n*. The cooling conduit 4515 comprises an outbound supply conduit 4515*a* extending to the cold side heat exchangers of each one of the plurality of washing and drying robots and an inbound return conduit returning from each cold side heat exchanger 4526 to the heat pump 4800 containing a secondary fluid at a warmer temperature than the portion of fluid in the outbound cooling supply conduit 4515*a*. The heating conduit 4520 comprises an outbound supply conduit 4520*a* extending to the heated side heat exchangers 4527 of each one of the plurality of washing and drying robots 4000*a-n* and an inbound return conduit 4520*b* returning from each heated side heat exchanger 4527 to the heat pump 4800 containing a secondary fluid at a cooler temperature than the portion of fluid in the inbound heating supply conduit 4520*a*.

Additionally or alternatively, in implementations, such as that of FIGS. 6B-C and 7, the closed loops of the heating conduit 4520*a-b* and the cooling conduit 4515*a-b* each comprise a plurality of heating supply and return branches 4521*a-n*, 4522*a-n* and cooling supply and return branches 4516*a-n*, 4517*a-n* each in fluid communication with a corresponding one of a cold side heat exchanger 4526*a-n* and a heated side heat exchanger 4527*a-n* of each one of the plurality of autonomous washing and drying machines 4000*a-n*. In implementations, at least one of a valve 4825*a-b*, 4835*a-b* and a variable speed pump 4830, 4840 is disposed between each outbound portion of the heating conduit 4520*a* and cooling conduit 4515*a* and the plurality the cool side heat exchangers 4526*a-n* and heated side heat exchangers 4527*a-n*. Additionally, in implementations, each heating supply branch 4521*a-n* and cooling supply branch 4516*a-n* comprises a valve 4523*a-n*, 4524*a-n* for controlling a delivery rate of secondary fluid respectively to the heated side heat exchanger 4527 and the cold side heat exchanger 4526. Additionally, in implementations, a local, variable speed pump 4519, 4519*a-n* is disposed along at least at each of the heating supply branches 4521*a-n* for controlling the rate of delivery of heated secondary fluid to the heated side heat exchanger 4627.

As will be described subsequently with regard to implementations, the valves 4523*a-n*, 4524*a-n* and the pump 4519, 4519*a-n* of each of the cold side heat exchanger 4526 and heated side heat exchanger 4527 are in operative communication with the controller 205 for controlling the rate of fluid delivery to the respective cold side and heated side heat exchangers 4526, 4527. The pump 4519, 4519*a-n* on the heated side is configured to at least one of control the maximum air temperature of the heated air AH and adjust a flow rate of the secondary fluid in the heating supply branch 4521*a* to optimize the pump energy performance. In implementations, the system 300, 300' additionally comprises an optional pump (not shown) on the cold side in operative communication with the controller 205 for optimization of pump performance.

In implementations, both the cold side heat exchanger 4526 and the heated side heat exchanger 4527 comprise one or more indirect heat transfer chambers disposed in series. In implementations, the one or more indirect heat transfer chambers comprise fin-coil units. For example, as shown in the side view schematic of an implementation of the heated side heat exchanger 4527 of FIG. 11A, the fin-coil units comprising a plurality of segments 4528*a-c* along the air loop 4230 comprise conduit 4529*a-c* running throughout and across the length of the fins, and the fin conduit 4529*a-c* is in fluid communication with a respective one of the heating supply conduit 4520*a* and return conduit 4520*b* extending from the heat pump 4800. As air flows through the heated side heat exchanger 4527, a fluid-to-air heat transfer occurs at each fin. After warming the air flowing through the heat exchanger 4527, the fluid exiting the heat exchanger for return to the heat pump 4800 is cooler than the fluid entering the heated side heat exchanger 4527 from the heat pump 4800 as will be described subsequently in detail. In implementations, such as that of FIG. 11A, the heating supply conduit 4520*a* delivers the heated fluid to the side of the heated side heat exchanger 4527 nearest the inlet to the drum 4205 such that the heated fluid is delivered counter to the airflow through the heated side heat exchanger 4527. In implementations of a single chamber heated side heat exchanger 4527, the same principal and ordered positioning applies to the heating supply and return conduits 4520*a-b* along the length of the heat exchanger 4575 in the direction of airflow.

Similarly, in implementations, the cold side heat exchanger 4526 comprises a plurality of segments of tube-fin heat exchangers, and as air flows through the cold side heat exchanger 4526, a fluid-to-air heat transfer occurs at the fins. The tube spacing and number of rows of fins can be increased or the segments of heat exchangers can be spaced apart such that the humid exhaust air drawn from the drum 4205 of the washing and drying robot 4000 travels across a sufficient length of cooling chambers (e.g. sufficient number of heat transfer fins) such that the process air has time to cool and the water therein has time to condense and fall from the stream of process exhaust air AE. In implementations, the cold side heat exchanger 4526 comprises a plurality of fins in spaced apart at a density of approximately 10 fins per inch and the heated side heat exchanger 4527 comprises a plurality of fins spaced apart a density of approximately 12 fins per inch. Additionally, in implementations, the plurality of fins in the cold side heat exchanger 4526 are coated and the plurality of fins in the heated side heat exchanger 4527 are uncoated. Additionally, the spacing of the refrigerant tubing in the heated side heat exchanger 4527 is approximately 4% further apart than the refrigerant tubing spacing in the cold side heat exchanger 4526. In implementations, the cold side heat exchanger 4526 comprises one or more finned heat exchanger chambers disposed in series, and each of the one or more chambers is oriented such that the fins of the one or more chambers are vertically oriented and disposed higher that the condensate outlet 4535. In implementations, the fins are oriented at an angle in a range of between about 45-70 degrees to the direction of airflow. The process air travels upwards in the closed air loop 4320 to the cold side heat exchanger 4626 and moisture condensed therein falls under gravity to the condensate outlet 4535 where it exits the exhaust duct 4325. In implementations, the condensed water runs along the fins as it descends, entrapping and removing lint in the process. In implementations, the at least one controller 4005, 205 is configured to stopping the fan 4830 for a period in a range of between 10-60 seconds (e.g., 10 seconds, 20 seconds, 30 seconds, 40 seconds, 50 seconds, 60 seconds) to allow condensation to drain from cold side heat exchanger 4526. Additionally, in implementations, the fins and tubes of the cold side heat exchanger 4526 comprises a surface coating that reduces adhesion force and allows drops of condensation to flow off and down to the condensation outlet 4535.

Returning now to the system of FIGS. 6A-8, the fan 4530 disposed in each closed air loop 4230 is disposed between the cold side heat exchanger 4526 and one or more heat transfer chambers 4528*a-c* of the heated side heat exchanger 4527. The fan 4530 is configured to pull the dehumidified air from the cold side heat exchanger 4526 into the heated side heat exchanger 4527. In implementations, the heated side heat exchanger 4627 comprises a single fin-coil unit. In implementations, the heated side heat exchanger 4627 comprises two or more heat transfer segments, or chambers 4528*a-c*, in series along a flow of process air, and the fan 4530 is disposed between two of the two or more heat transfer chambers 4528*a-c*. Additionally or alternatively, the fan 4530 can be disposed between the collective one or more heat transfer chambers 4528*a-c* of the heated side heat exchanger 4527 and the drum 4205 of the washing and drying robot 4000. This placement can enable a better fit within the geometric constraints of the layout of the closed air loop 4530. Additionally, this placement enables any droplets entrained in the process air exiting from the cold heat exchanger, (e.g., moisture that has condensed from the exhaust air AE but has not been deposited because the drops are too small or the air velocity is too high) are re-evaporated and do not impact the blade of the fan 4530, which could cause mechanical damage.

The configuration of the system 300 described above with regard to implementations provides many advantages over implementations requiring long, facility wide stretches of air conduit delivering heated air to each one of a plurality of washing and drying robots 4000, 4000*a-n*. A heat pump 4800 comprising a fluid circulation pump is more compact and energy efficient than air blowers for the same amount of heat energy transported. Fluid circulation lines (e.g., heating supply and return conduits 4520*a-b* and cooling supply and return conduits 4515*a-b*) are more compact than air ducts, and shorter air ducts within the closed air loops 4320, 4320*a-n* local to each washing and drying robot 4000, 4000*a-n* are easier to keep clear of lint. Additionally, as will be described further with regard to implementations, this approach enables fine control of process air temperature independent of air flow rate.

Figure 11A:
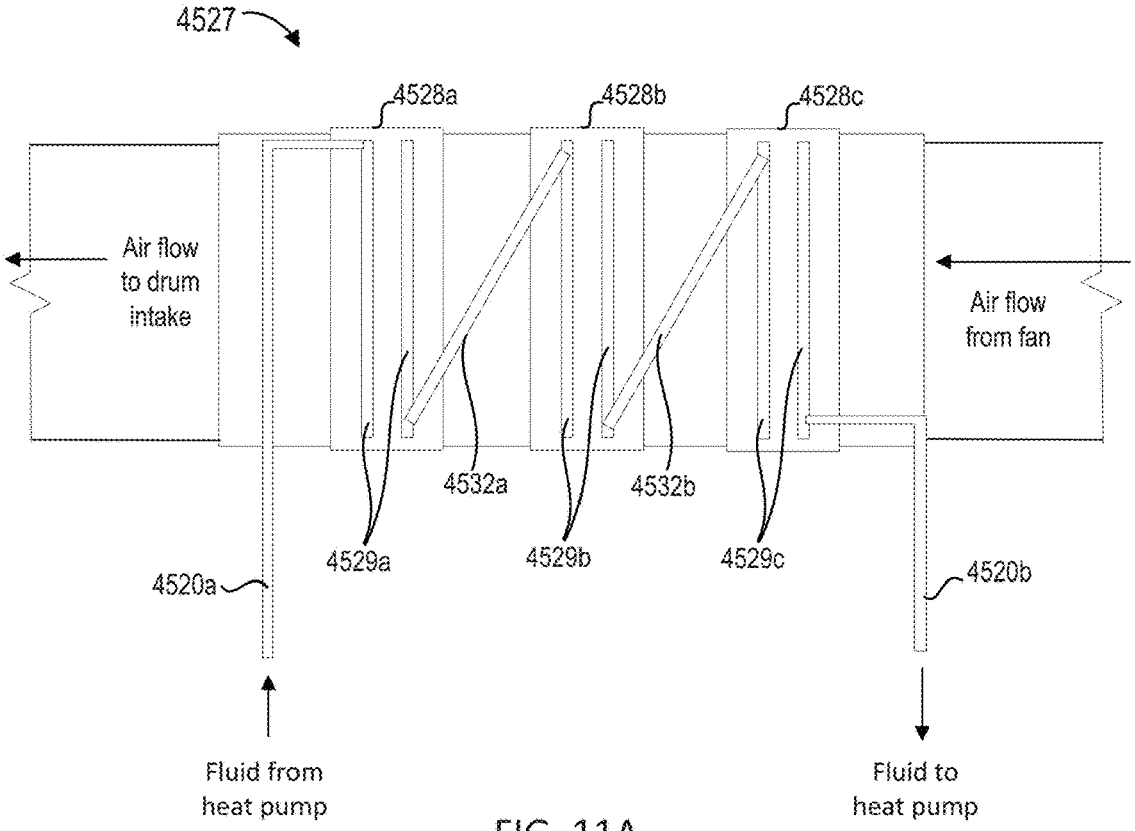
FIG. 11A depicts a schematic side view of an example heat exchanger having three heated side chambers for warming process air flowing therethrough.

The heating fluid supplied to each washing and drying robot 4000 via the heating supply conduit 4520*a* is at a temperature fixed by the output of the centralized heat pump 4800. The heated intake air AH exiting a heated side heat exchanger 4527 in the intake duct 4262, however, can be adjusted to a lower process air temperature. In implementations, a temperature of the heated intake air AH can be lowered by reducing the fluid flow rate in the heating supply conduit 4520*a*, either by the controller 205 controlling and operating at least one of a proportional valve 4523 and a local speed controlled circulation pump 4519 at the supply branch 4521 to each one of the plurality of washing and drying robots 4000, 4000*a-n*. Additionally or alternatively, in implementations as previously introduced, the heated side heat exchanger 4527 can be configured to have multiple segments, or chambers, (e.g., coil and fin heat exchanger units), and valves and/or bypass conduits may be used to control which segments are actively heated. For example, as depicted in FIG. 11A, three chambers 4528*a-c* are active as compared to the implementation of FIG. 11B in which the outer two chambers 4528*a*, 4528*c* are fluidly connected to the heating conduit 4520*a-b*, and the middle chamber 4528*b* is not actively heating air flowing therethrough.

Additionally or alternatively, in implementations, the controller 205 in operative communication with the fan 4530 (e.g., blower) is configured to increase the air flow rate in the closed air loop 4320 by increasing the speed of the fan 4530 disposed in series in the closed air loop 4230 of each washing and drying robot 4000. Increasing the air flow rate in the closed air loop 4320 reduces the temperature of the heated intake air AH entering the washing and drying robot 4000 from a heated side heat exchanger 4526. Cooler air may be desired, for example, if a load of laundry disposed in the washing and drying robot 4000 includes items comprising delicate fabrics and/or the load of laundry is at the end of the drying process at which point the robot 4000 avoids overheating the laundry articles. In implementations, the speed of the fan 4830 may be reduced to decrease the flow of heated air AH. This maintains the heated intake air AH at the temperature of the circulating fluid in the heating supply conduit 4520*a* and decreases the total heat power required to be removed from the fluid in the heating supply conduit 4520*a* to heat the intake air AH because less air is running through the closed air loop 4530 and requiring heating by the fluid in the supply conduit 4520*a*. This mode of operation is desirable, for example, for drying smaller loads because smaller loads cannot effectively use all the supplied intake air AH, for adjusting intake air AH supplied to a load of laundry that is almost dry and therefore does not need so much intake air AH, for balancing plant (e.g., facility) operation scheduling across clusters 4002*a-n*, or for allowing more drums 4205*a-n* to operate simultaneously for a fixed electrical power consumption (e.g., too many drums 4200 are running for the heat pump 4800 to serve at full power).

Figure 10:
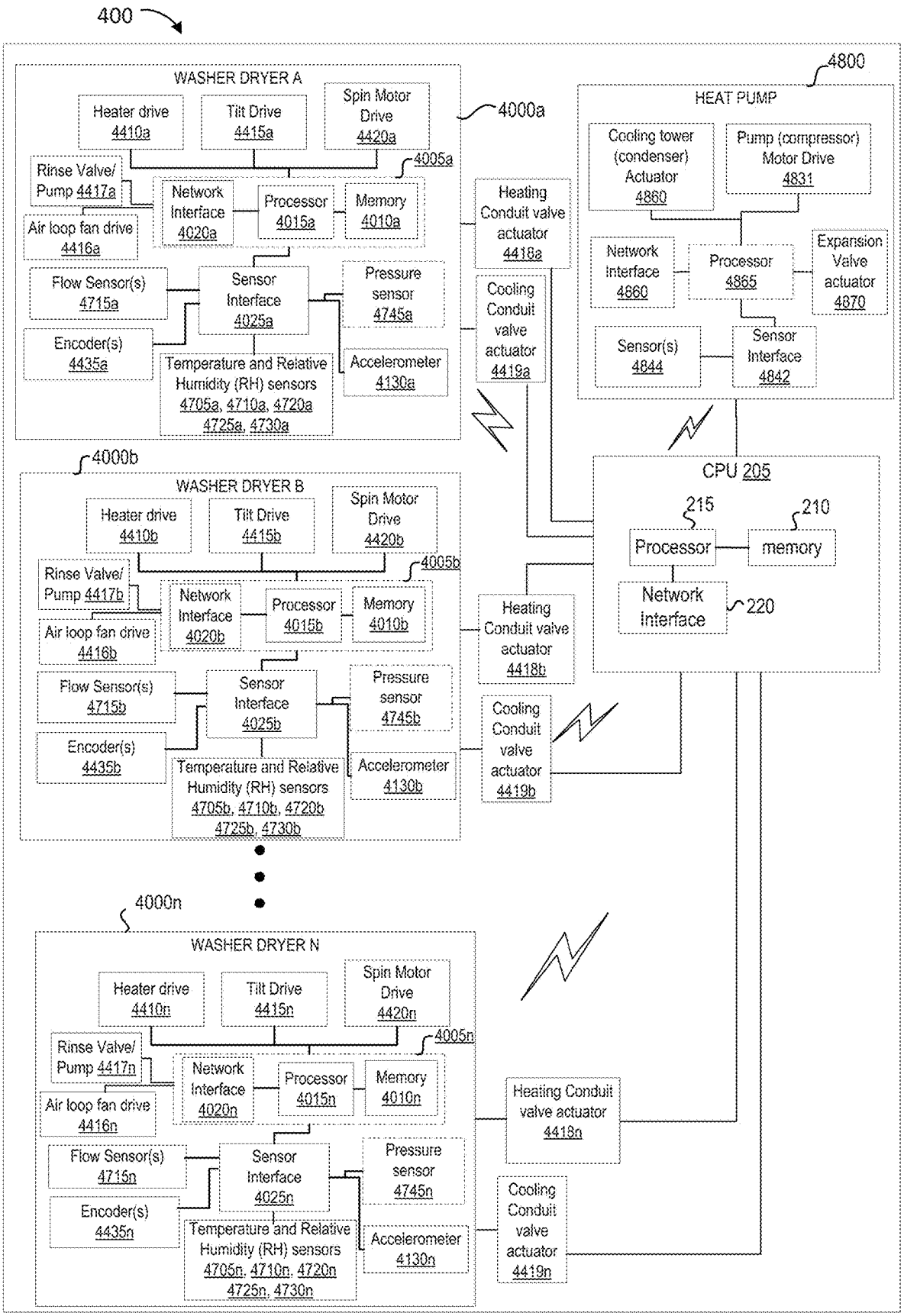
FIG. 10 depicts a schematic example of a controller in operative communication with a plurality of autonomously operating combination washing and drying robots each including a dedicated heat exchanger and a centralized heat pump servicing on demand each one the plurality of dedicated heat exchangers.

Turning now to FIG. 10, a fully autonomous control system 400 includes a centralized controller 205, or CPU, in operative communication with a processor 4835 of the centralized heat pump 4800, local controllers 4005*a-n* of a plurality of washing and drying robots 4000*a-n*, and each dedicated heated side heat exchanger 4527, cold side heat exchanger 4526 and fan 4530 of each of the plurality of associated closed air loops 4320, 4320*a-n*. For simplicity, the following example explanations will describe each element of one of the plurality of washing and drying robots 4000*a-n* without using alphabetical identifiers. It should be understood that each element operates similarly among all of the plurality of washing and drying robots 4000*a-n*.

The local controller 4005 of each washing and drying robot 4000, is in operative communication with the at least one heater drive 4410, at least one tilt drive 4415, and at least one spin motor drive 4420 of each one of the plurality of autonomous washing and drying machines 4000*a-n*, a valve and/or pump actuator 4418 for controlling the application of heated fluid from the heat pump 4800 to the respective heated side heat exchanger 4527, a valve and/or pump actuator 4419 for controlling the application of cooling fluid from the heat pump 4800 to the respective cold side heat exchanger 4527, a fan drive 4416, at least one drive of the heat pump, and one or more air sensors. The controller 4005 is configured to receive the output signal of the one or more air sensors disposed at one or more dedicated locations within the closed air loop 4320. Based on the received output signal(s), the controller 4005 analyzes the at least one air characteristic associated with the one or more air sensors, and determines, based on the analysis, whether the at least one air characteristic at the associated location within the air loop 4320 is within a range of values for at least one of air temperature, air flow, and air humidity, The controller 4005 is configured to adjust autonomously, in response to determining at least one air characteristic is not within a range of target values, one or more controls (e.g., drivers) for at least one of air temperature, air flow, and air humidity at the one or more locations of the system 400. Additionally or alternatively, in implementations, the centralized controller 205 is in operative communication with the local controller 4005 and the centralized controller 205 is configured to perform some or all of the above described controls functions.

Figure 14:
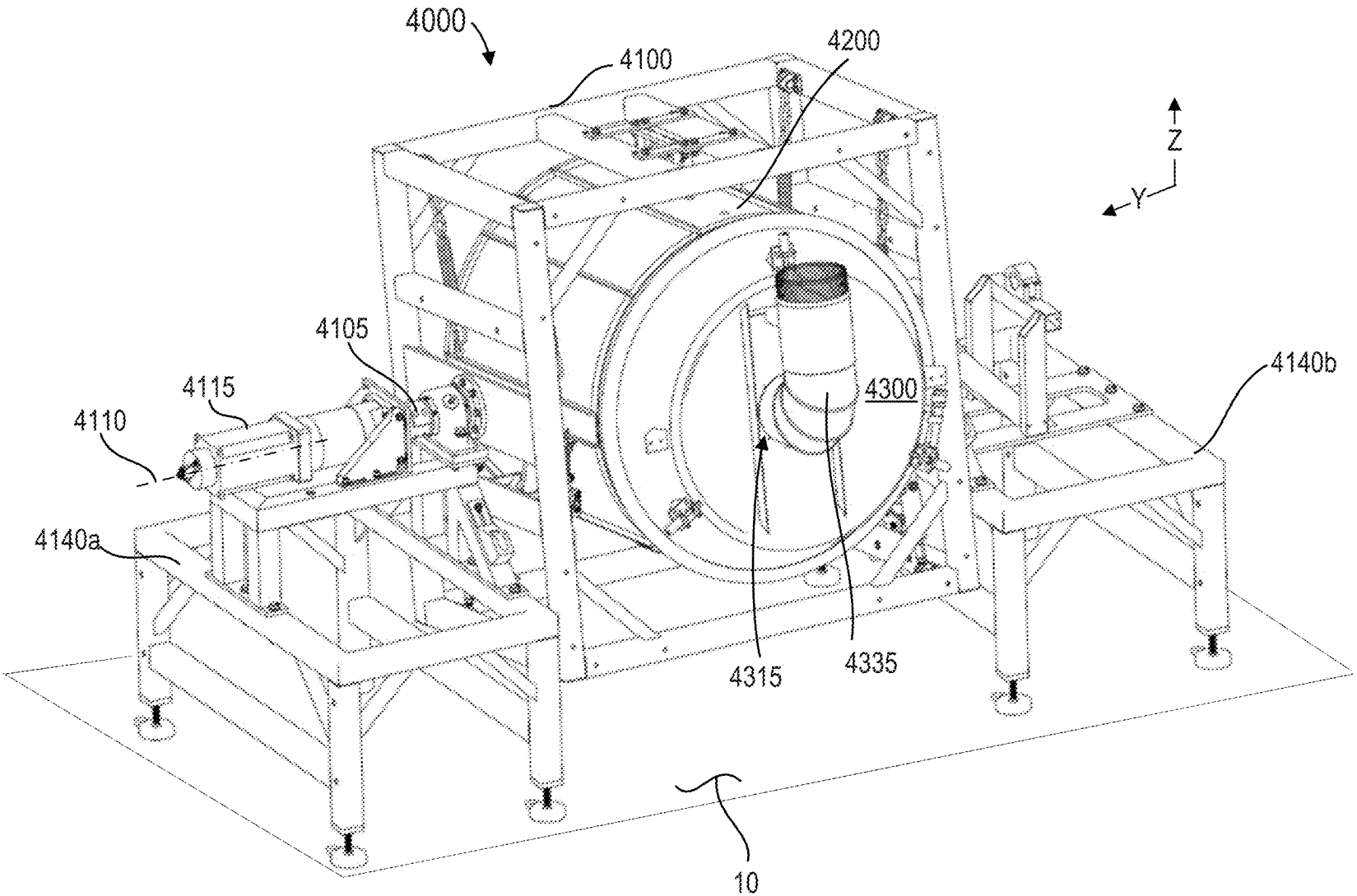
FIG. 14 depicts a front perspective view of the autonomous washing and drying robot of FIG. 13A with a door attached, the robot being angled with its spin axis substantially horizontal for autonomous washing and drying.
Figure 15:
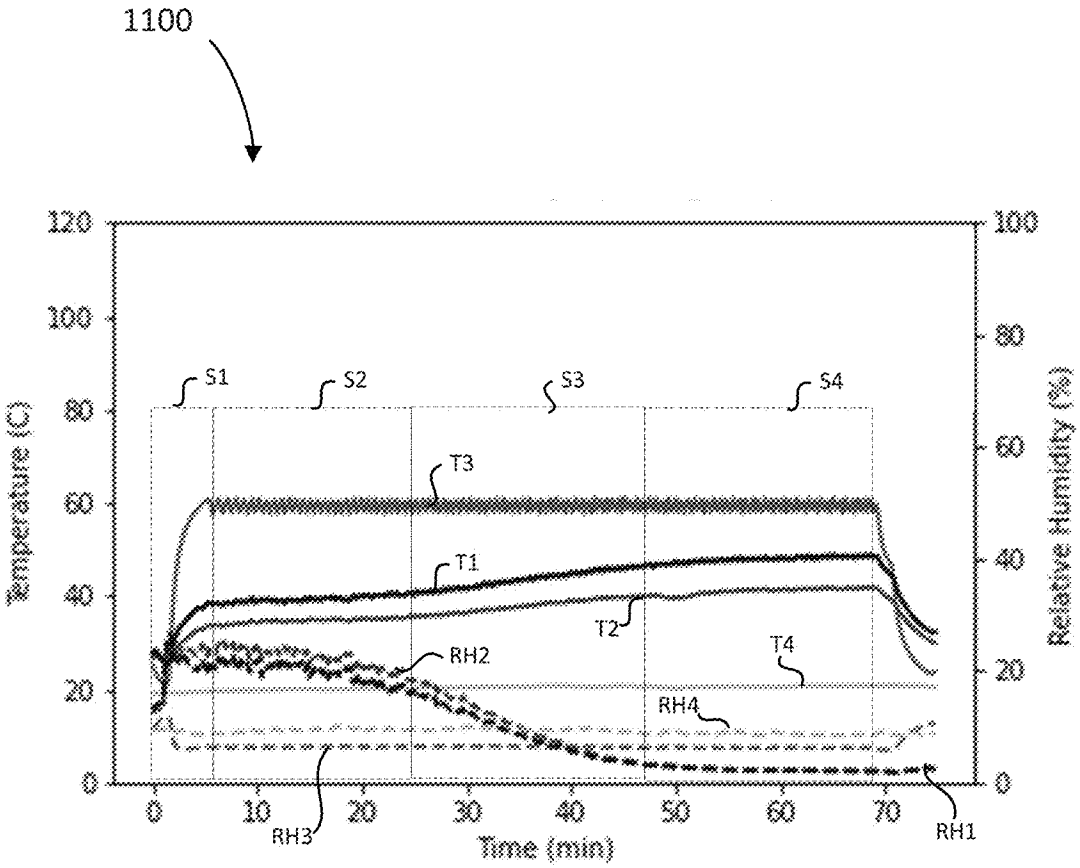
FIG. 15 depicts an example plot of measured drying cycle sensor data for a system including a washing and drying robot.

Each washing and drying robot 4000, 4000*a-n* in the cluster 4002 is in operable communication with at least one of their respective controllers 4005*a-n* and the at least one centralized controller 205 (e.g., CPU 205, FIG. 4) via a wired or wireless network 230 (e.g., network 230, FIG. 4). In implementations, as shown in the system schematic of FIG. 10, each one of the plurality of washing and drying robots 4000, 4000*a-n* comprises a heater drive 4410, a pivot drive 4415, and a spin motor drive 4420 configured to instruct a drive motor rotate the drum 4205 about a spin axis 4231. The drum 4205 is configured to rotate about the spin axis 4231 during washing and drying, either in a continuous direction of rotation or in an alternating pattern of clockwise and counterclockwise rotation about the spin axis to prevent entanglement of laundry articles and promote uniform drying. In implementations, as shown in FIGS. 13A-14, the pivot drive 4415 is configured to instruct a pivot motor 4115 to tip the drum from a vertical laundry loading position (FIG. 13A) to a substantially horizontal washing and drying cycle position (FIG. 14) to an inverted clean laundry dumping position (FIG. 13B).

Taking FIGS. 9 and 10 together, each one of the plurality of washing and drying robots 4000*a-n* comprises a network interface 4020*a-n* configured to communicate data and sensor signals to at least one of the respective processors 4015*a-n* and the at least one controller 4005*a-n*, 205 (via a wireless or wired communication network 230) for processing. The sensor signals comprise output signals from at least one of one or more air flow sensors 4715*a-n*, one or more sensors measuring at least one of temperature and humidity (e.g., RH, relative humidity) 4705*a-n*, 4710*a-n*, 4720*a-n*, 4725*a-n*, 4730*a-n*, one or more pressure sensors 4745*a-n*, one or more encoders 4435*a-n*, and one or more accelerometers 4310*a-n*, as shown in the side view schematic implementation of a closed air loop in FIG. 9. The sensor signals are routed to the at least one of the respective processors 4015*a-n* and the at least one controller 4005*a-n*, 205 via the sensor interface 4025*a-n* of each one of the plurality of washing and drying robots 4000*a-n*.

The at least one controller 4005, 205 is configured to adjust one or more controls within a closed air loop 4320 autonomously for maintaining air flow, air temperature, and air humidity within a range of values at each stage of the drying process. In implementations, each washing and drying robot 4000 comprises at least one pump disposed at the washing and drying robot 4000 for drawing fluid through one or both of the heating and cooling supply conduits 4520*a*, 4515*a* extending from the heat pump 4800. (Throughout FIGS. 6B and 6C, directional arrows HS, HR, CS, CR indicate the direction of supply of heating fluid HS (e.g., heating refrigerant) and cooling fluid CS (e.g., cooling refrigerant) and return of heating fluid HR and cooling fluid CR. Arrows IS and IR indicate the direction of intermediary supply and return fluid.) Additionally or alternatively, in implementations, the system 300, 300' comprises at least two fluid pumps 4830, 4840 and associated valves 4825*a-b*, 4835*a-b* disposed between the heat pump 4800 and the plurality of washing and drying robots 4000*a-n* for controlling the flow of fluid through the supply conduits 4520*a*, 4520*b* as described previously with regard to FIG. 6B. On the hot side, main circulation fluid pump 4830 maintains continuous flow in the hearing supply conduit 4250*a* to ensure that the fluid target temperature supplied by the heat pump 4800 is maintained at the entrance to all heat exchangers 4527*a-n* in the plant (e.g., facility). A bypass valve 4514 (FIG. 6C) disposed at the end of each hot supply and return conduit loop conduit 4520*a-b* assures that a minimum flow level can be maintained in the loop of conduit 4520*a-b* even in the case that the individual heated side exchangers are all set to minimal flow and/or individual valves 4523*a-n* are turned off. This ensures that the temperature of the fluid in the heating supply conduit 4520*a* set by the heat pump 4800 is available to the last (e.g., furthest) heat exchanger 4527*n* on a branch 4521*n*.

Additionally, in implementations, the at least one controller 4005, 205 instructs at least one of the local, variable speed pump 4519 and adjustable valve 4523 in each branch 4521*a-n* to adjust the flow through individual heated side heat exchangers 4527, 4527*a-n* based on one or more of the intake air AH temperature, intake air AH flow velocity, return conduit 4520*b* fluid (e.g., hot water) temperature, and overall plant (e.g., facility) operations requirements, including plant processing capacity ratio and energy costs. The more slowly the heated fluid flows from the supply conduit 4520*a* through the heat exchanger 4527 (e.g., by slowing down the speed of the local branch pump 4519), the more heat per unit volume of heating fluid is delivered to the air passing through the heated side heat exchanger 4527 and the lower the temperature of the refrigerant fluid returning to the heat pump 4800 in the return conduit 4520*b*. Similar controls may be implemented on the chilled refrigerant side (e.g., the cooling supply and return loop 4515*a-b*). In implementations, each branch 4516 of the cooling supply conduit 4515*a* optionally comprises a local, variable speed pump (4513) similar to the variable speed pump 4519 of each branch 4521 of the heating supply conduit 4520*a*. (The optional pumps 4513*a-n* are shown in broken line on FIG. 6C to indicate their optionality.) This allows the at least one controller 4005, 2005 to adjust the air parameters and balance between the energy flows on the hot side (e.g., 4810*a*) and cold side (e.g., 4810*b*) of the heat pump 4800. The temperature gradients across the supply and return portions of each of the heat exchangers 4810*a-c* and between adjacent ones the two or more heat exchangers 4810*a-c* within the heat pump 4800 are therefore reduced through this balancing of energy flows. Reducing the temperature differential across the heat pump heat exchangers 4810*a-b* allows the heat pump to operate more efficiently.

Additionally or alternatively, to the controls within the heating supply and return loop 4520*a-b*, the cooling supply and return conduit 4515*a-b*, and the local branch pump 4519 and valves 4523, 4524 at least one of the centralized controller 205 and local controller 4005 of the washing and drying robot 4000 is configured to output a control signal to the closed air loop fan 4530 to operate whenever hot air is required by the drum 4205. Additionally or alternatively, as previously described with regard to in implementations, at least one of the centralized controller 205 and washing and drying robot controller 4005 can signal a local valve actuator 4418, 4419 (FIG. 10) to open or close a valve 4524, 4523 (FIGS. 6C and 7) local to the washing and drying robot 4000 to control circulation of the fluid in the cooling and heating supply conduits 4515*a*, 4520*a* to the cold side heat exchanger 4526 and the heated side heat exchanger 4527 respectively. In implementations, valves 4524, 4523 are adjustable flow valves, for example needle valves to allow the flow of heated and chilled refrigerant through the heat side heat exchanger 4526 and cold side heat exchanger 4527 to be controlled without the use of a local booster pump (e.g., heating supply branch pump 4519 and cooling supply branch pump 4513). In implementations, the controller 4005, 205 is configured to turn off valves 4254, 4523 when conditioned air is not required in the drum 4205. This selective sealing closure of the valves 4254, 4523 eliminates energy losses associated with the flow of refrigerant through the supply branches 4521*a-n*, 4516*a-n*.

Optionally, in implementations, a centralized pump 4840 is configured to circulate the cold side fluid disposed in the cooling supply and return conduit 4515*a-b* continuously at a constant rate. Additionally or alternatively, in implementations, the at least one controller 4005, 205 is configured to control circulation fluid control rate of the heated side fluid disposed in the supply conduit branch 4521 by running a local pump 4519 and selectively opening and closing a valve 4523 to provide the desired fluid flow and produce at the heated side heat exchanger 4527 a heated intake air AH with a target range of temperatures. Controlling fluid flow adjusts at least one of air flow, air humidity, and air temperature during a drying cycle at each independently operating washing and drying robot 4000*a-n*. In implementations, the valve 4523 is a proportional valve and locally controlling the valve.

Figure 11B:
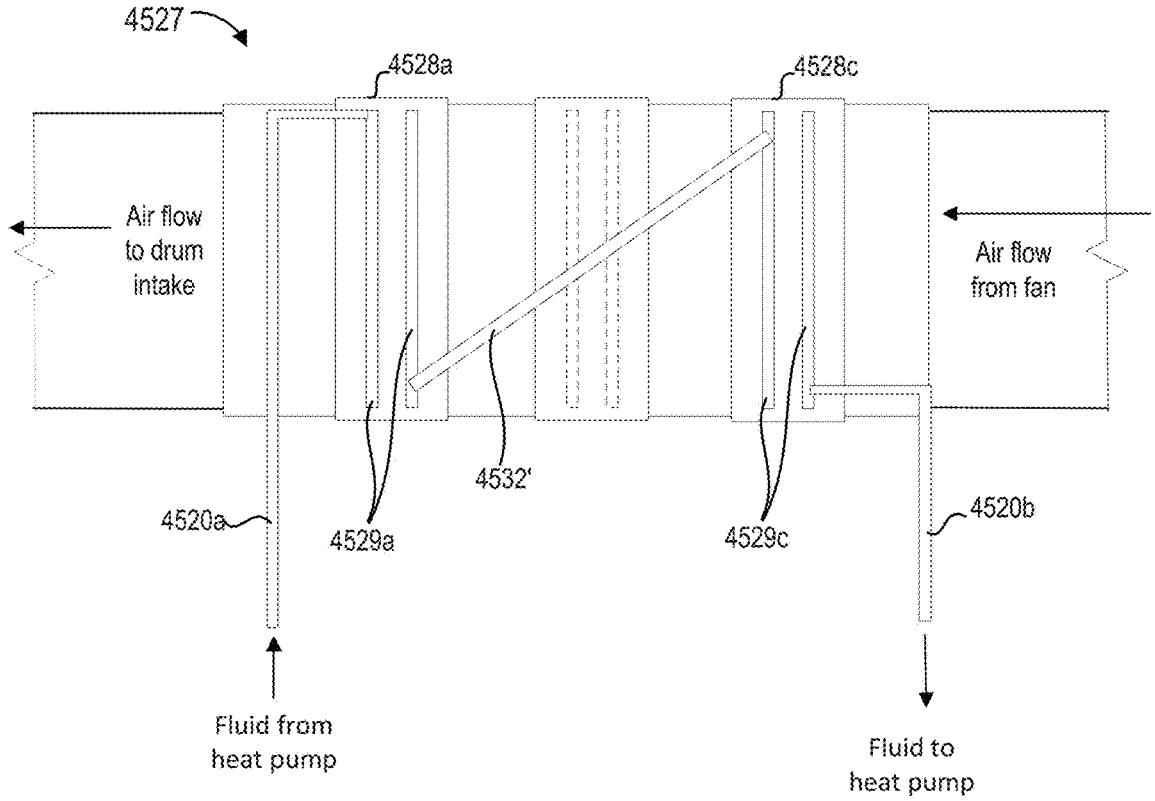
FIG. 11B depicts a schematic side view of the heat exchanger of FIG. 11A utilizing only two of the three chambers heated for warming process air flowing therethrough.

As described previously with reference to the implementation of FIGS. 11A-B, the heated side heat exchanger 4527 comprises a plurality of indirect heat transfer segments 4528*a-c*, or chambers. In implementations, at least one of the centralized (e.g., remote) controller 205 and local controller 4005 is configured to operably instruct one or more valves (not shown) disposed between the plurality of heat transfer chambers 4528*a-c* to open and close, thereby selectively controlling which of the plurality of chambers are actively heated and raising or lower the air temperature in the inlet duct 4226 of the closed air loop 4230. This is represented schematically in FIG. 11B as a direct conduit 4532' connecting the outer segments 4528*a, c* of the plurality of heated side heat exchangers 4528*a-c*.

Additionally or alternatively, adjusting air temperature within the closed air loop 4230 comprises at least one of the centralized controller 205 and local controller 4005 signaling the fan drive 4416 to increase an operating speed of the fan 4530, thereby increasing air flow rate in the closed air loop 4230 and reducing air temperature in the inlet duct 4262. Additionally, in implementations, as shown in the schematic of FIG. 9, the controller 205 is in operative communication with one or more optional auxiliary electrical heaters 4605 disposed at each one of the plurality of washing and drying robots 4000. The one or more auxiliary heaters 4605 is configured to at least one of directly heat air in the closed air loop 4230 and raise the temperature of the incoming heated stream of fluid disposed in the heating supply conduit 4520*a*.

As will be described subsequently with regard to the monitored autonomous drying process, the heat pump 4800 is configured to maintain process air in the closed air loop 4320 within a range of acceptable temperature and humidity values. As previously introduced with regard to FIGS. 6A-8, the heating conduit 4520*a-b* and cooling conduit 4515*a-b* each comprise a loop comprising a supply conduit 4520*a*, 4515*a* and a return conduit 4520*b*, 4515*b*. In implementations, the heating supply conduit 4520*a* delivers heated fluid to the heated side heat exchanger 4527 and the heated fluid comprises a temperature range of between about 60 C-85 C. The heating return conduit 4520*b* comprises fluid in a temperature range of between about 40-75 C following heat exchange with the process air in the heated side heat exchanger 4527. Heated air from the heated side heat exchanger 4527 comprises a temperature in a range of between about 75-80 C and less than 15% relative humidity. In implementations, the cooling supply conduit 4515*a* delivers cold fluid to the cold side heat exchanger 4526 and the cold fluid comprises a temperature range of between about 5 C-25 C. The cooling return conduit 4515*b* comprises fluid in a temperature range of between about 15 C-30 C following heat exchange with the process exhaust air AE in the cold side heat exchanger 4526.

In implementations, the circulating fluid (e.g., at least one of water, carbon dioxide, CFC or HCFC, ammonia, a mixture of water and propylene glycol) in the loops of heating and cooling conduit 4515*a-b*, 4520*a-b* can supply heat or cold to other applications, for example for heating process water 4112 delivered into the tub 4215 and drum 4205 of a washing and drying robot 4000 (FIG. 9), for creating steam for steam cleaning or disinfection, and/or augmenting or supplying heat and cold to a facility building HVAC system. Heat can be drawn either from the supply side heating conduit (e.g., for steam) and/or from the return side of the heating conduit (e.g., for building HVAC) depending on the most energy efficient configuration. Additionally or alternatively, in implementations, an auxiliary chilled water circuit could be installed on either the supply or return chilled water conduits 4515*a-b* depending on the temperatures required. Such an auxiliary circuit could be used for supplying building air conditioning to the facility and/or for refrigeration (e.g., for chemicals used in cleaning processes such as washing, disinfecting, and dry cleaning).

In implementations, the system 300, 300' optionally comprises one or more insulated buffer tanks 4111 (shown in FIGS. 6B and 7 in broken line to indicate optionality) configured to hold and selectively disperse at least one of heated process water, cooled process water, heated fluid for introduction into or mixing with the fluid in the heating supply conduit 4520*a*, cooled fluid for introduction into or mixing with the fluid in the cooling supply conduit 4515*a*, and return fluid from either or both of the fluid in the heating return conduit 4520*b* and the fluid in the cooling return conduit 4515*b*.

For example, as shown in FIG. 7, the system 300' optionally comprises an auxiliary heated fluid loop 4520*a'-b'* configured to deliver and retrieve heated water stored in a buffer tank 4111. In implementations, the buffer tank 4111 comprises at least one tank that temporarily holds fluid (e.g., water) that was directly heated or cooled by the heat pump 4800 before that fluid is circulated through the heating supply conduit 4520*a* or cooling supply conduit 4515*a*. Alternately, in implementations, the tank 4111 comprises at least one water-to-water heat exchanger for indirect heating or cooling of the fluid in the heating supply conduit 4520*a* or cooling supply conduit 4515*a*, depending on whether the tank 4111 stores fluid heated or cooled by the heat pump 4800. Storing at least one of heated and cooled process water in a dedicated, insulated buffer tank provides the system 300' with additional resources for load averaging energy consumption across a plurality of washing and drying robots 4000. Optionally, in implementations, the heat pump 4800 is configured to supply heated fluid (e.g., water) to the storage tank at higher than normal temperatures in a range of between about 80-90 C. Additionally or alternatively, In implementations, the tank 4111 is equipped with a booster heater (not shown) to raise the temperature of the stored fluid disposed therein to a range of between 80-110 C for use in laundry sanitization cycles. If the target temperatures of fluid stored in the buffer tank 4111 are above 100 C, the storage tank 4111 comprises a pressurized storage tank or fluids other than pure water can be used as a stored refrigerant, for example a mixture of water and glycol. (Water at over 100 C has to be stored under pressure to prevent boiling, and the added glycol raises the boiling point and depresses the freezing point of the water.)

In implementations as shown in FIG. 6B, the optional thermal storage buffer tank 4111' is configured to increase the thermal inertia of the system 300 to avoid short cycling of the heat pump 4800 (e.g., prevent the heat pump 4800 from cycling on and off very frequently, which imparts wear and tear). The heated fluid for the heating supply conduit 4520*a* is drawn from the tank 4111', and its temperature is the average temperature of the volume of fluid stored in the storage buffer tank 4111'. The heated fluid passes through the hot heated side heat exchanger 4527 at a washing and drying robot 4000, giving up heat, which reduces its temperature. The return conduit 4520*b* brings the fluid back through the heat pump 4830 and back into the storage buffer tank 4111', where it reduces the average temperature in the tank 4111'. The heat pump 4830 does not turn on until that average temperature drops below a setpoint as detected by a sensor in the tank in communication with the at least one controller 4005, 205 and/or the processor 4865 of the heat pump 4800. Because the tank 4111' contains a lot of fluid (e.g., water), the heat pump 4830 turns on less frequently and stays on longer each time, which is favorable for efficient operation of the heat pump compressor 4805. In this configuration, however, the temperature of the fluid in the heating supply conduit 4520*a* will fluctuate in a range determined by preset system control parameters monitored by the at least one controller in communication with one or more parameter measurement sensors. This configuration of an optional buffer tank 4111' is configured to store heat for several hours.

Figure 20:
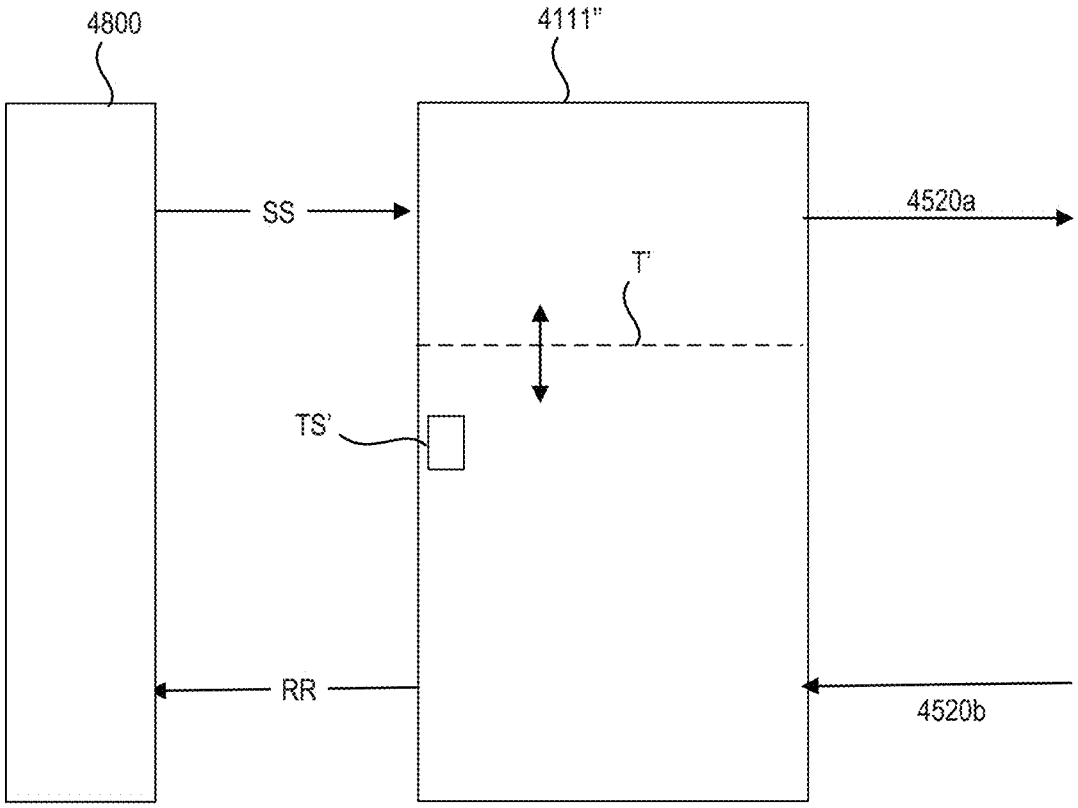
FIG. 20 depicts an example refrigerant buffer tank configured as an energy storage tank for the purpose of load balancing heat pump usage.

In implementations, as shown in FIG. 20 the buffer tank 4111" may be configured as an energy storage tank for the purpose of load balancing, time shifting operation to periods when energy is more available or less expensive, or for any other purpose. In implementations, a heat pump supply SS and return RR conduit and the heating supply conduit 4520*a* and return conduit 4520*b* are connected to a buffer tank 4111" configured to establish a thermal gradient within the tank 4111". The supply conduit 4520*a* sources water from the tank buffer near the top, and the return conduit feeds the tank at a connection near the bottom of the tank 4111", while the heat pump 4800 feeds the tank with hot water near the top and draws cooler water from the bottom. Because hotter fluid (e.g., water) is less dense than the same fluid when it is hot, a gradient is established with the hot fluid (e.g., water) near the top of the tank, the cooler return fluid at the bottom, and a thermal transition T' between them. When the heat pump 4800 does not operate, hot fluid is drawn from the top of the tank 4111", cooler fluid is returned to the bottom, and the thermal transition moves up the tank 4111". When the heat pump 4800 operates, cooler fluid is drawn from the bottom of the tank 4111" into the heat pump 4800, hot fluid is returned to the top of the tank 4111", and the thermal transition T' moves down in the tank 4111". The at least one controller 4005, 205 is configured to operate the heat pump 4800 by monitoring the position (e.g., height) of the transition T' relative to the conduit positions and triggering operation of the heat pump 4800 when the transition reaches a threshold height. In implementations, a position sensitive thermal sensor TS' detects the position of the transition T' and controls pump cycle of the heat pump 4800. In this buffer tank 4111" implementation, the hot fluid supply has nearly constant temperature. In implementations, the tank 4111" is well insulated and fluid connections to the tank 4111" are designed to minimize any vertical currents or turbulence which would cause mixing to occur.

In implementations as shown in FIG. 7 the gradient heat storage tank 4111 comprises two fluid connections. A first T-line t1 (e.g., conduit connection) connects the heat pump 4800, heating supply conduit 4520*a*, and tank, and a second T-line t2 connects the heat pump 4800, heating return conduit 4515*a*, and tank. When the heat pump 4800 is running, the heating supply conduit draws as much hot water as it needs from the heat pump, and any excess capacity is stored in the tank 4111. When the heat pump 4800 turns off, the flow is redirected so that the heating supply conduit draws directly from the tank 4111 and the heating return conduit runs directly to the tank 4111. In implementations, a position sensitive thermal sensor TS detects the position of the transition T and controls pump cycle of the heat pump 4800.

Turning now to lint mitigation in the closed air loop 4230, as depicted in at least FIGS. 5A-B and 9, during the drying cycle each washing and drying machine 4000 intakes hot process air through inlet 4315, 4315', and exhausts cool humid process air through outlet 4260, 4260'. In implementations, the exhausted process air passes through one or more lint removal devices, such as a lint filter 4608, disposed in the closed air loop 4230 to prevent lint in exhausted humid air from clogging the heat exchangers 4526, 4527. In implementations, the lint filter 4608 comprises a plurality of spray nozzles for entrapping lint in water droplets and draining the lint laden fluid from the lint filter and/or exhaust duct 4325.

Additionally or alternatively, in implementations, at least one of the centralized controller 205 and local controller 4005 is configured to instruct a rinse actuator 4417 of the system to periodically deliver process water to the fins of the cold side heat exchanger 4526 to remove accumulated lint. The lint laden water can be output to and treated by the water treatment system 4048 to remove lint and other contaminants as low volume solid waste and the water reused as process water. As described previously, in implementations, the cold side heat exchanger 4526 comprises one or more finned heat exchanger chambers disposed in series. In implementations, each of the one or more chambers is oriented such that the fins of the one or more chambers are vertically positioned with their leading edges vertically above their trailing edges. In implementations, the fins of the one or more chambers of the cold side heat exchanger 4526 are positioned at an angle of between about 45-70 degrees to the direction of the airflow (e.g., 45-70 degrees from vertical) with their leading edges higher than their trailing edges. The cold side heat exchanger 4526 is disposed higher than the condensate outlet 4535 such that an air path of process air moving in the closed air loop 4230 is upwards and substantially vertical from the condensate outlet 4535 to the cold side heat exchanger 4626. A rinse nozzle 4540 is disposed within the close air loop above the cold side heat exchanger 4526 and serviced by the rinse actuator 4417 (e.g., an actuator of at least one of a valve and a pump) to selectively deliver rinse water to the fins of the cold side heat exchanger 4526 to remove any lint deposited on the fins. The lint laden water descends to the condensate outlet 4535 for a gravity fed drainage of the lint entrapped in the rinse water.

Additionally or alternatively, in implementations, each cold side heat exchanger 4526 can be replaced or augmented with a cold water mist. Incoming water directly or indirectly via the circulating fluid cooled by the heat pump 4800 may be sprayed or atomized into the exhaust air stream in the exhaust duct 4325. The mist cools the exhaust air and also encourages condensation by nucleating water droplets in the humid exhaust air. Lint is trapped in condensate and drains away through the condensate outlet 4535. An advantage of this approach is that there are no fins or coils on which lint collects. The linty condensate would then be processed by the water recycling system to remove lint, and the cleaned and sanitized water recirculated to either the mist generator or the washers for a wash cycle.

Keeping the ducting in the closed air loop 4230 relatively short and contained to a single washing and drying robot 4000 enables efficient lint removal. Although the air ducts are relatively short, each washing and drying robot 4000 is configured to pivot from a substantially upright position, as shown in FIG. 13A, to a substantially inverted position, as shown in FIG. 13B. In implementations, as shown in FIG. 5B, a flexible length of the exhaust duct 4325 is in a range of between about 30 percent longer to twice as long as a direct distance from an inlet of the cold side heat exchanger 4526 to the air exhaust outlet 4260 of the drum 4205 when the drum 4205 of the washing and drying robot 4000 is disposed between the substantially upright and substantially inverted positions (e.g., oriented such that an axis of drum rotation 4321 is substantially horizontal as shown in FIG. 14). The slack in the exhaust duct 4325 accommodates the tilting movement of the washing and drying robot 4000 from the loading position (e.g., vertically upright), to the substantially horizontal washing position, to the inverted emptying position (e.g., downward angled spin axis). Similarly, the inlet duct 4262 is in a range of between about 10 percent longer to 25 percent longer than a direct distance from an outlet of the heated side heat exchanger 4527 to the inlet 4315 in the door 4300 when the washing and drying robot is oriented such that an axis of drum rotation 4321 is substantially horizontal. This slack in the duct 4262 accommodates the motion of the door 4300 when the drum is sealed and unsealed by a suction device that completely removes the door 4300 and pulls it away from a rotational sweep of the robot 4000 to prevent a collision during loading and unloading. In implementations, both exhaust duct 4325 and inlet duct 4262 are insulated to maximize the energy efficiency of the system. As previously described, in implementations as shown in FIG. 9, the direction of the air flow through the drum 4205 is reversed, so that the opening in the inlet is disposed in the back of the tub 4215 and the length of the hot air inlet duct 4626' is configured to accommodate the tilt motion of the washing and drying robot 4000. Correspondingly, the opening in the door 4300 is the exhaust outlet, and the exhaust duct length is configured to accommodate removal of the door.

Turning now to FIGS. 5A-B and 13A-14, an implementation of an autonomously actuated washing and drying device 4000 includes a rigid frame 4100 and a tub and drum assembly 4200 comprising the central spin axis 4231 extending between a front end 4212 and drive end 4217 of the tub and drum assembly 4200. In implementations, the rigid frame 4100 comprises one or more pivot shafts 4105, 4105*a-b* coaxially aligned with a pivot axis 4110. The one or more pivot shafts 4105 comprises a pair of coaxially aligned pivot shafts 4105*a-b* configured to support the weight of the isolation frame 4100 and the tub and drum assembly 4200 from opposite sides.

The one or more pivot shafts 4105 are configured to suspend the rigid frame 4100 above a floor 10, which may be at ground level or which may be a raised platform. The one or more pivot shafts 4105 define a pivot axis 4110 about which the rigid frame 4100 rotates from an upturned orientation to an inverted orientation, with each of a washing orientation, drying orientation, door removal orientation, and door replacement orientation being at one or more rotational positions between the upturned loading orientation and the inverted unloading orientation. In implementations, the front end 4212 of the tub and drum assembly 4200 is higher in elevation than the back end 4217 in an upturned orientation. In implementations, the front end 4212 of the tub and drum assembly 4200 is lower in elevation than the back end 4217 in a substantially inverted orientation. In implementations, the upturned orientation comprises a substantially vertically upright orientation such that the spin axis 4231 is substantially vertical, and the inverted orientation comprises a substantially inverted orientation such that the spin axis 4231 is positioned downward at an angle in a range of between about 60 to 90 degrees relative to horizontal.

For example, in implementations, the rigid frame 4100 can rotate from 0 to 180 degrees, where 0 degrees is a vertically upright position of the spin axis 4231 and 180 degrees is a vertically inverted position of the spin axis 4231. In implementations, the rigid frame can rotate to any rotational position and stop at that angle. For example, the substantially vertically upright position (e.g., FIG. 13A) of the rigid frame 4100 comprises the central spin axis 4231 being in a range of between about 80 to 90 degrees up from horizontal (e.g., 0 to 10 degrees from vertical) and the front end 4212 being at a higher elevation than the back end 4217. For example, the substantially vertically inverted position (e.g., FIG. 13B) comprises the central spin axis 4231 being in a range of between about 60 to 90 degrees down from horizontal (e.g., 150 to 170 degrees from vertically upright) and the front end 4212 being at a lower elevation than the back end 4217.

In implementations, the one or more pivot shafts 4105 comprise a pair of coaxially aligned pivot shafts 4105*a-b*, each one of which extends from an opposing side of the rigid frame 4100. A pivot motor 4115 is configured to drive one pivot shaft 4105*a* of the pair of coaxially aligned pivot shafts 4105*a-b* about the pivot axis 4110. As shown in FIGS. 13A-14, a motor side pivot shaft 4105*a* is configured to extend through a bearing holder 4106*a* for constrained rotation and mate with the pivot motor 4115. Additionally or alternatively, in implementations, the pivot shaft 4105*a* is configured to extend through the bearing holder 4106*a* and engage with a coupling 4107 configured to engage with the pivot motor 4115 to transfer rotational movement. In implementations, a gear box 4108 is configured to be disposed between the pivot motor 4115 and the coupling 4107. As shown in FIG. 14, the second pivot shaft 4105*b* is configured to extend through a bearing holder 4106*a* in coaxial alignment with the pivot axis 4110. In implementations, the bearing holders 4106*a-b* are configured to be mounted to corresponding fixed supports 4140*a-b*. The bearing holders 4106*a-b* are configured to receive a respective one of the pair of pivot shafts 4105*a-b* and provide a bearing surface on which the shafts therein rotate. In implementations, the pivot motor 4115 comprises an encoder 4116 for measuring the rotational speed of the pivot shaft 4105 and outputting a signal to the controller 4005 for controlling motion of the pivoting rigid frame 4100. Additionally or alternatively, in implementations at least one absolute encoder is disposed on the bearing holder 4106*b* for the non-motor side pivot shaft 4105*b*. The absolute encoder detects the rotary position (and rotation speed) of the rigid frame 4100 and outputs a signal indicative of the rotary position to the controller 4005. In implementations, the rotation speeds detected and communicated by the pivot shaft encoder 4116 and the absolute encoder 4125 will vary by the ratio of the gear box 4108.

While the pivot motor 4115 rotates the rigid frame 4100 and the tub and drum assembly 4200 suspended therein, all water, air, pneumatic, and electric lines running to the device 4000 also move, flex, or bend to accommodate the range of motion without dislodging from the tub and drum assembly 4200. The schematic implementation of a washing and drying device 4000 of FIG. 9 illustrates exemplary water, air, pneumatic and electrical lines running to the tub 4215 and drum 4205 and an air flow path through one of the plurality of washing and drying robots 4000*a-n* and the closed air loop 4320. Although the implementation depicts airflow from a rear end 4217 of the drum 4205 to a front end 4212 of the drum, in other implementations, the direction airflow and positions of the heat exchangers 4526', 2527' can be reversed as depicted in FIGS. 5A-B.

With the door 4300 sealed in place in the opening of the drum 4205, an airflow A is established through the drum 4205, exhausted to a cold side heat exchanger 4526, through a heated side heat exchanger 4527 pulled by a fan 4530, and supplied to an inlet of the drum 4205 as heated air. As shown in FIGS. 9, in implementations, the sealed door 4300 is configured to fixedly receive an air exhaust conduit 4325' extending therefrom and an orifice through the door defines the air exhaust outlet 4260' from the drum 4205. In implementations, the air exhaust conduit 4325 is flexible to accommodate movement of the door 4300 during attachment and removal to the drum 4205 and to accommodate motion and vibration during the washing and drying cycle. In implementations, the air exhaust outlet orifice 4260' and a rigid conduit 4335 to which the air exhaust conduit 4325' attaches are disposed at or around the center of the door 4300. In implementations, the air exhaust outlet orifice 4260' and rigid conduit 4335 to which the air exhaust conduit 4325' attaches are disposed on a lower half of the door 4300 (e.g., below a spin axis 4231).

In the implementation of FIG. 9, an orifice comprising the air inlet 4315' is disposed through or adjacent to a drive end 4217 of the tub 4215 such that air flows through the drum 4205 from the air inlet 4315' to the air exhaust outlet 4260' as indicated by the arrows of FIG. 9 (e.g., airflow A). Because the air inlet 4315' is positioned adjacent the top of the tub 4215 and the air exhaust outlet 4260' is positioned adjacent the bottom of the tub 4215, the flow of air (e.g., airflow A) travels diagonally downward through the drum 4205 from the drive end 4217 to the front end 4212. Alternatively, the air inlet 4315' could be positioned adjacent the bottom of the tub 4215 and the air outlet 4260' could be positioned adjacent the top of the tub 4215 to achieve an alternate diagonal airflow upward through the drum 4205. Although any front-to-back and back-to-front airflow will dry a load of wet laundry disposed within the drum 4205, a diagonal airflow A ensures effective mixing of the air in the drum 4205 so that a load of one or more deformable laundry articles disposed therein dries uniformly, with no concentrated hot spots or cold spots. By avoiding a narrow, direct air path through the drum 4205, deformable articles throughout the drum are heated and therefore dried efficiently, avoiding longer drying cycles associated with less distributed heating throughout the drum 4205.

Figure 12:
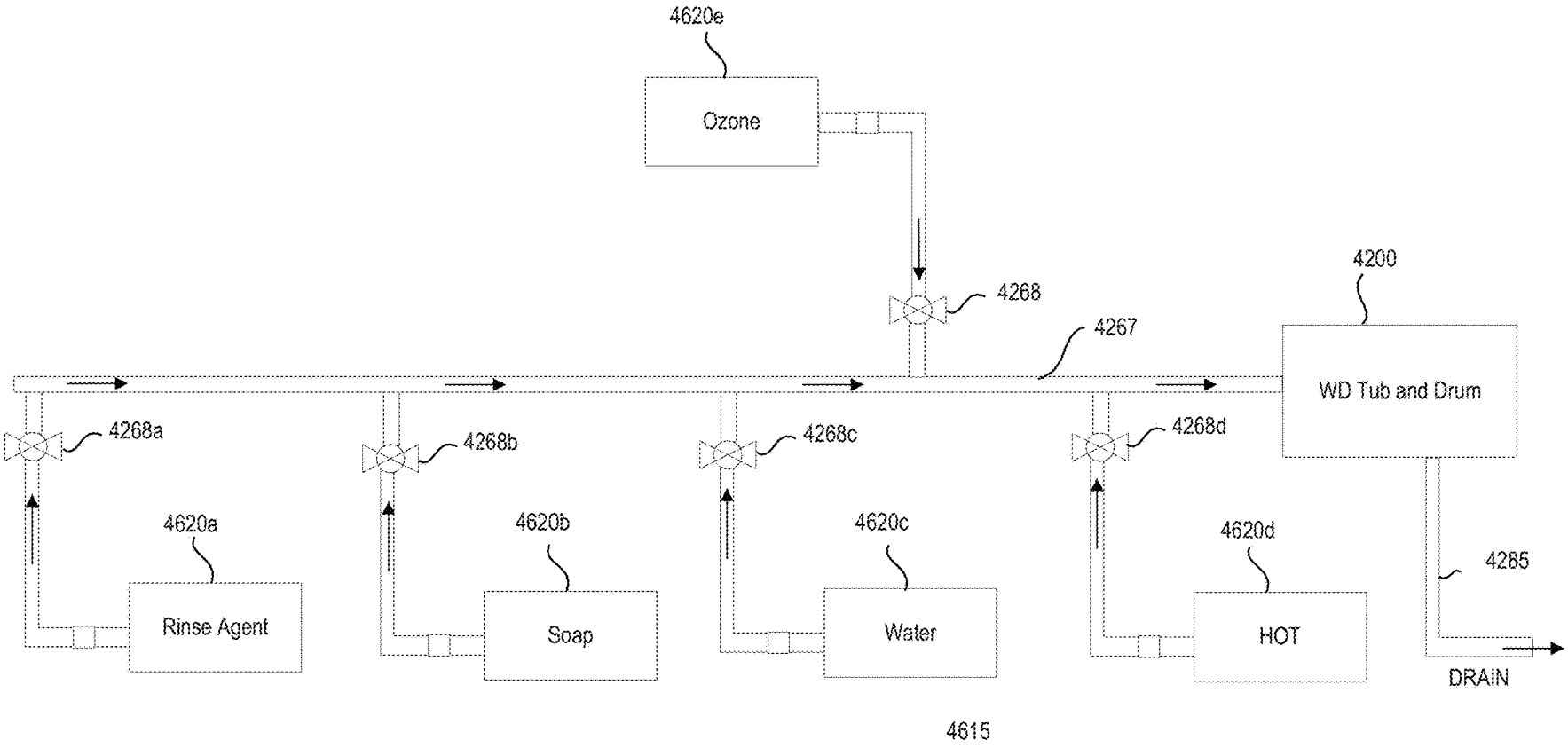
FIG. 12 depicts a schematic example of a portion of the schematic of FIG. 9 including fluid inputs to an autonomously operating combination washing and drying robot.

In implementations, as shown in FIG. 9 in broken lines to indicate optional inclusion in the system, an optional auxiliary heater 4605 further heats the intake air, introducing warm, dry air into the tub 4215 through the inlet 4315' in the drive end 4217 of the tub 4215. In implementations, the orifice comprising the inlet 4315' to the tub and drum assembly 4200 is parallel to the drum spin axis 4231. In implementations, the heated dry air passes through a mesh or perforations in the end wall of the drum 4205 and then passes through the volume occupied by tumbling laundry articles (e.g., at least one deformable article). The air stream passes through the drum 4205 where it absorbs moisture from the at least one deformable article. The moist air is vented from the drum 4205 through a meshed opening (e.g., the air outlet 4260') at the front of the tub 4215. In addition to the air inlet 4315' and air outlet 4260', the tub 4215 comprises a cleaning water inlet 4265 and a wastewater outlet 4270, as shown in FIG. 9. As shown in FIG. 12, the tub 4215 can be supplied with one or more of a rinse agent 4620*a*, soap 4620*b*, tap water 4620*c*, hot water 4620*d* (e.g., heated water supplied from a storage buffer 4111), and ozone 4620*e*. Each additive supplied can be controlled by a corresponding actuatable valve 4268*a-e* in operable communication with the at least one controller 4005, 205, and the at least one controller 4005, 205 can instruct one or more of the actuatable valves 4268*a-e* to open to introduce one or more additives to the drum 4205. In implementations, the heat pump 4800 of the system pipes heated fluid to every washing and drying robot 4000, 4000*a-n* in the supply conduit 4520*a* and the supply conduit can be diverted to heat process water locally at the tub 4215 via a fluid-to-water heat exchanger.

In addition to the air and liquid inlets and outlets to the tub 4215, in implementations as described previously with regard to FIGS. 9 and 10, the washing and drying robot 4000 additionally comprises one or more of temperature, humidity, water level (e.g., air pressure), and flow sensors configured to detect measured characteristics of the air and liquid flowing into and out of the tub and drum assembly 4200 and communicate these measured characteristics to the centralized controller 205 and/or local device controller 4005. For example, as depicted in the schematic of FIG. 9, the device 4000 can include, in implementations, one or more of a temperature sensor 4705 disposed at or on the optional auxiliary heater 4605, and one or both of a temperature and humidity sensor 4710 and airflow sensor 4715 disposed in a heated air conduit 4262 (e.g., inlet duct) mated to the air inlet 4315' of the tub 4215. As described previously, the at least one controller 4005, 205 receiving signals from one or more of these sensors can then control the system heat control elements such fan speed, heating and cooling conduit flow, and power to the optional auxiliary heater for adjusting the air to maintain values within one or more temperature, humidity, and flow rate thresholds. In implementations, the auxiliary heater 4605 comprises an electric resistive element in a rigid duct following the heated side heat exchanger 4527. The auxiliary heater 4605 raises the temperature if the heated air AH above the hot water temperature in the heating supply conduit 4520*a*. This can be useful, for example, to accelerate drying for a particular load of one or more laundry articles or for sanitizing a load of one or more laundry articles. Temperatures could be heated up to 100 C for most fabrics, and possibly higher for all natural fabric materials such as cotton, wool, and linen.

For example, in implementations, the at least one controller 4005, 205 can adjust the inlet air temperature based at least in part on the ambient humidity thereby accommodating local climate conditions and fluctuations that can impact heat losses from the tub 4215 during opening and closing of the door 4300 and potentially from the exhaust duct 4325 and inlet duct 4262, depending on the quality of insulation. The at least one controller 4005, 205 can control the air flow rate based on temperature and humidity of the exhaust air. In implementations, one or more of an airflow sensor (e.g., sensor 4725 can measure airflow parameters alternatively or in addition to measuring temperature and humidity) and one or more of temperature and humidity sensors 4720, 4730 can be disposed in the air vent hose 4325 (e.g., exhaust duct), in close proximity to the door 4300 and within the stream of cooled, humid air exhausted from the drum 4205. The controller 4005 receiving signals from one or more of these sensors can then control fan speed, a power level of an optional auxiliary heater 4605, and pump rates and valve positions of the heating and cooling supply conduits 4520*a*, 4515*a* supplying heated and cold fluid to the heated side heat exchanger 4527 and cold side heat exchanger 4526 to maintain values within one or more temperature, humidity, and flow rate ranges.

In implementations, one or more flow sensors 4735, 4737, 4740 can be disposed in the cleaning water conduits 4267, 4267*a-b*. For example, one or more flow sensors 4735 can be disposed downstream of the detergent/rinse agent source 4620 and provide feedback to the controller 4005 actuating the valve 4268 to introduce a measurable amount of detergent/rinse agent to the tub 4215 and drum 4205. Similarly, one or more flow sensors 4737 can be disposed downstream of the water source 4615 and provide a signal to the controller 4005 to control the rate of flow of water to the tub 4215 and drum 4205, and a one or more flow sensors 4740 can be disposed downstream of the valve 4268 introducing detergent/rinse agent to the water from the water source 4615 and provide a signal to the controller 4005 to control the rate of flow of wash water (e.g., water and detergent and/or rinse agent) to the tub 4215 and drum 4205. Additionally or alternatively, the system comprises one or more water level sensors disposed of in the drum 4205 to sense the water quantity and/or balance the amount of detergent for a particular load size.

As described previously with regard to FIGS. 6A-C and 9, in implementations, one or more sensors 4705, 4710, 4715, 4720, 4725, 4730, 4060 are disposed at one or more locations comprising at least one of the air inlet 4315, 4315' of each one of the washing and drying machines 4000*a-n*, the air outlet 4260' of each one of the washing and drying machine, and the inlet of the at least one heat pump 4800. The one or more sensors 4705, 4710, 4715, 4720, 4725, 4730, 4060 are configured to measure at least one air characteristic such as temperature, air flow velocity, air flow volume, moisture content, and air pressure, and output a signal indicative of at least one air characteristic to the at least one controller 4005*a-n*, 205. In implementations, the one or more sensors comprise at least one of semiconductor, bimetallic, or resistive temperature sensors, polymer or wet bulb humidity sensors, mechanical, hot wire, and pitot tube air velocity sensors.

In implementations, as described with regard to FIG. 9, each of the plurality of washing and drying robots 4000, 4000*a-n* further comprises a water inlet 4265 configured to introduce water to the tub 4215 (e.g., the drum 4205 inside the tub 4215) at a temperature in a range of between about 5 to 60 degrees Celsius. In implementations, as shown in FIG. 9, a water treatment system 4048 receives gray water from the tub and is also configured to receive the drained condensed moisture from the heat pump 4800 and output sanitized water to an inlet line (e.g., cleaning water conduit 4267) for reuse in the tub 4215 of a washing and drying machine 4000. The water inlet of the at least one washing and drying robot 4000 is configured to receive the sanitized output water for use with a subsequent load of laundry received by the tub and drum assembly 4200.

Turning now to the operation of the heat pump 4800 during washing and drying cycles, in implementations, as depicted in the schematics of FIGS. 6A-8 taken collectively, a heat pump 4800 uses electromechanical work to transfer heat from a source stream at lower temperature to a sink stream at higher temperature. These streams may be air, water, or any other fluid. The process of removing heat from the exhaust air AE reduces its temperature and causes the moisture contained in the exhaust to condense. The resulting moisture content is no greater than the saturation moisture content of the air at the reduced temperature of the exhaust air AE portion of the process air in the closed air loop 4320. In implementations, the dehumidification temperature if the fluid in the cooling supply conduit 4515 which is set by the design or controls of the heat pump 4800 and is in a range of between about 5 C and 40 C, but preferably is in a range of between 5 and 20 C and more preferably around about 10 C. The heat pump 4800 is designed to balance the cold side and warm side temperatures of the fluid in the supply conduits 4520*a*, 4515*a* to optimize the overall process of dehumidifying exhaust air AE and heating intake air AH in each closed air loop 43. Lower condenser temperatures result in reduced moisture content in the exhaust air AE but require more heating to achieve the target heated intake air AH temperature.

In implementations, the heat pump 4800 operates on electrical energy to drive a compressor 4805, a coolant circulation pump (not show) for circulating a primary fluid through the heat pump heat exchangers 4810*a-c*, and one or more fluid pumps 4830, 4840 disposed, for example, between the heat pump 4800 and the cold side and heated side heat exchangers 4526, 2527. In implementations, the heat pump 4045 is configured to capture waste heat from the electromechanical components performing the work, such as compressors and pumps to further increase the amount of heat energy provided to the fluid disposed in the heating supply conduit 4520*a*.

In implementations comprising a primary heat pump fluid and a secondary plant circulating fluid, a heat pump compressor 4120 compresses the refrigerant to create a high pressure, high temperature gas. The refrigerant flows through a condenser or a gas cooler (e.g., for a transcritical cycle, such that comprising carbon dioxide (CO2)) where heat transfers from the heat pump heat exchangers 4810*a-c* to the circulating secondary fluid in the heating and cooling supply conduits 4520*a*, 4515*a*. The secondary fluid can be, for example, at least one of water and a water and propylene glycol mixture. Following heat transfer, the cooler gas (e.g., gasified primary fluid), still at high pressure, then passes through an expansion valve 4811 which lowers both pressure and temperature and creates a mixture of gas and liquid. This mixture then passes through the evaporator which absorbs heat from the cold stream of primary fluid to rechill it for use in the cold side of the process. This results in a low pressure, moderate temperature gas as the input to the compressor 4805 as the cycle restarts.

Optionally, in implementations, instead of heating and cooling a secondary fluid for circulation to the clusters 4002*a-n* of washing and drying robots 4000*a-n*, at least one of the compressed, hot CO2 gas and the chilled CO2 liquid-gas mixture may be pumped through high pressure supply lines to at least one of the heated side heat exchangers 4527*a-n* and cold side heat exchangers 4526*a-n* of individual washing and drying robots 4000, 4000*a-n* for direct heating and/or cooling of process air in each individual closed air loop 4320, 4320*a-n*. The fluid-to-fluid heat exchange at the heat pump 4800 is thus eliminated, and the heated and cooled refrigerant (e.g., primary fluid) can be routed in supply and return conduit throughout a facility to a plurality of washing and drying robots 4000*a-n*. For example, instead of CO2 being cooled by the heat pump 4800 and then cooling water in the cooling supply conduit 4515*a* and heating water in the heating supply conduit 4520*a*, the heat pump 4800 can cool and, as by product of the cooling process, heat CO2 circulating directly from the heat pump 4800 throughout the one or more clusters 4002, 4002*a-n*. Piping heat pump refrigerant around a facility eliminates a pair of heat exchangers and results in a direct refrigerant to air heat exchange at the heat exchangers 4526, 4527 at each washing and drying robot 4000. In implementations, the refrigerant comprises one of CO2, CFC, HCFC, propane, and ammonia.

As compared to circulating water, circulating refrigerant requires smaller heat exchangers and smaller pumps because of the refrigerant's greater heat capacity relative to water. As previously described with regard to implementations, a portion of the heat output of the heat pump 4800 can be optionally utilized for heating the process water 4112 to be introduced to a tub 4215 of the same or another robot 4000 of the at least one of the plurality of washing and drying robots 4000*a-n* during a wash cycle. In implementations, the water heated by the heating supply conduit 4520*a* can be stored in an insulated holding tank 4111 (FIGS. 6B and 7) within the facility for later use by at least one of a plurality of washing and drying robots 4000, 4000*a-n*. In implementations, a portion of the heat can be introduced to the process water 4112 introduced to a tub 4215 during a final rinse cycle. Operating a final rinse cycle in warm or hot water (e.g., water in a range of between about 20 to 40 degrees Celsius) heats up the load of already-washed deformable laundry articles and the metal drum 4205 and tub 4215 of a washing and drying robot 4000 and thereby shortens the subsequent drying cycle time by at least 5 and by as much as 10 minutes off of a drying cycle time averaging between about 60 to 100 minutes.

The at least one controller 4005, 205 of the system 300, 300' is configured to receive sensor signals throughout the closed air loop at various stages of the washing and drying processes and autonomously operate inputs to the system to balance several serially occurring thermodynamic processes within the tub 4215 and drum 4205 (e.g., the tub and drum assembly 4200) of the washing and drying robot 4000. These thermodynamic processes can include the following: cool or warm wash water can cool or heat the metal tub and drum and the plurality of laundry articles therein, heated air heats the plurality of laundry articles therein, water evaporates from the plurality of laundry articles and cools the air and the clothing Additionally, lint is freed from the plurality of laundry articles by the mechanical motion of the washing and drying process.

Figure 16:
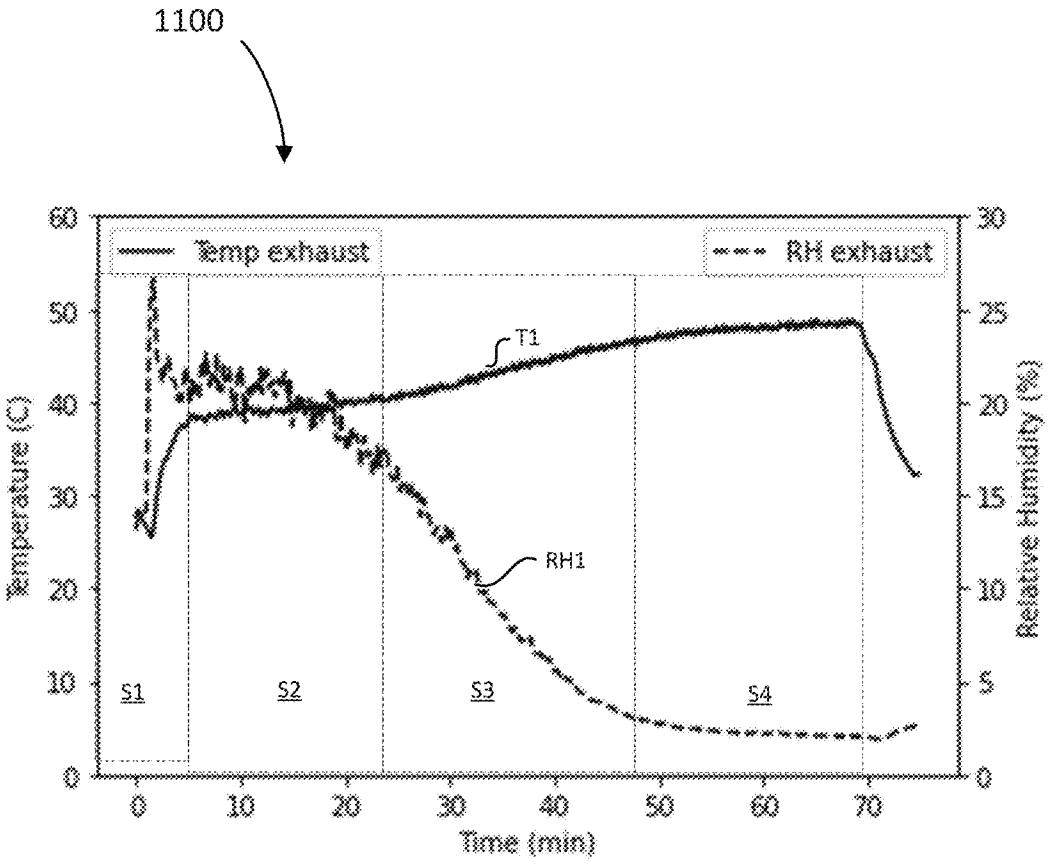
FIG. 16 depicts portions of the example plot of FIG. 15 showing exhaust air temperature and relative humidity over time during a drying cycle of an autonomous washing and drying device.
Figure 17:
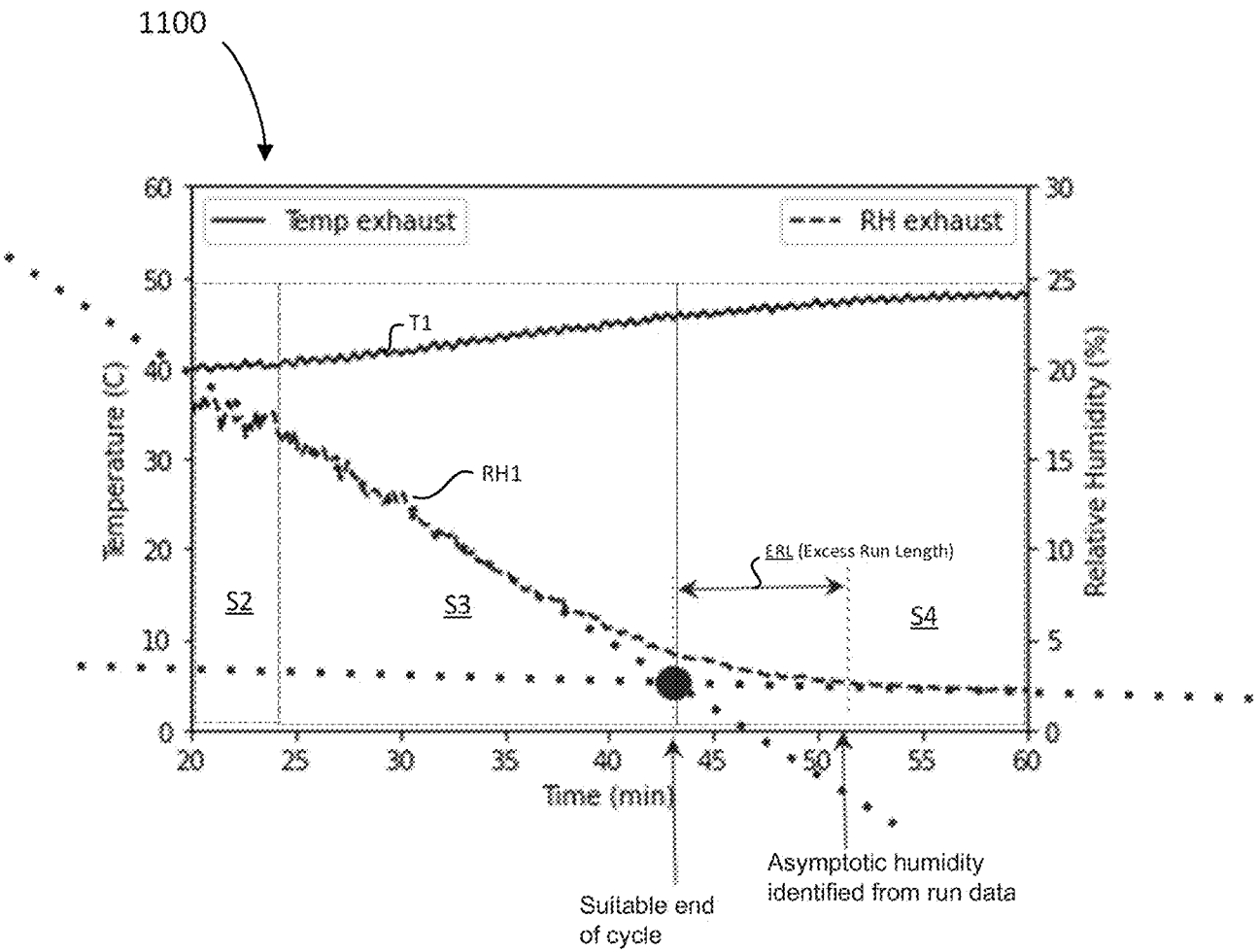
FIG. 17 depicts an enlarged portion of the plot of FIG. 16.

FIG. 16 depicts a plot of measured temperature and humidity sensor process parameters for a combination washing and drying robot 4000. Four temperature (T1-T4) and humidity (RH1-RH4) sensors are located (1) at the exhaust duct 4325 near the door 4300, (2) at the lint trap 4608, (3) just prior to the air inlet 4315 to the tub 4215, and (4) external to the tub 4215, monitoring the ambient conditions. FIG. 17 depicts portions of the plot 1100 of FIG. 16. As depicted in FIG. 17, drying proceeds in several stages over time as indicated by the temperature and relative humidity values measured over time at the exhaust duct 4325. The initial temperatures of the tub 4215 and the load of laundry articles are determined by at least one of the ambient temperature and humidity conditions, the prior processing step (e.g., the temperature of the final rinse water), and heat loss to the ambient air. During a first stage S1, the temperature T1 of the exhaust slowly rises as the intake air heats the drum 4205 of the washing and drying machine 4000 and fabric items disposed therein. In the second stage S2, the temperature T1 and humidity H1 of the exhaust air are roughly constant, with the values depending on the load size (e.g., small, medium, and large), the temperature, humidity, and flow rate of the intake air and the thermodynamics of the drying process.

This second stage S2 lasts while the fabric(s) of the laundry articles in the drum 4205 are damp enough that the fabric surfaces are always saturated. The thermodynamic driver is thus the evaporation of free moisture from the surface. During the third stage S3, not enough moisture remains in the fabrics of the articles in the drum 4205 to keep the fabric surfaces saturated. The thermodynamic processes are dominated by the rate of the migration of moisture trapped within the fabric to the surface of the fabric, where evaporation occurs. The third stage S3 is characterized by a slow, roughly linear decline RH1 in exhaust humidity and a slow, roughly linear increase in exhaust temperature T1. During the fourth stage, S4, the fabric is dry and the temperature and humidity of the exhaust air asymptotically approach the temperature and humidity of the intake air, limited by losses to the ambient through the walls of the drum 4205 and tub 4215 and other structures attached to the washing and drying robot 4000.

The closed air loop 4320 allows for the one or more 4005, 205 of the system 300 to control process parameters. In a closed air loop 4320, the process air moisture content is set by controlling the condenser temperature of the heat pump 4800 and therefore the temperature of the secondary fluid in the cooling supply conduit 4515*b*, which creates repeatable process conditions. As described previously with regard to FIGS. 9 and 10, at least one controller 4005, 205 can monitor sensor signals for sensors detecting temperature, humidity, and airflow parameters for set points. The set points can be, for example, sequences of ranges of values for at least one of air temperature, air flow, and air humidity. The at least one controller 4005, 205 is configured to accurately determine drying cycle completion and reduce the need for an extended drying period to ensure drying completion.

Figure 18:
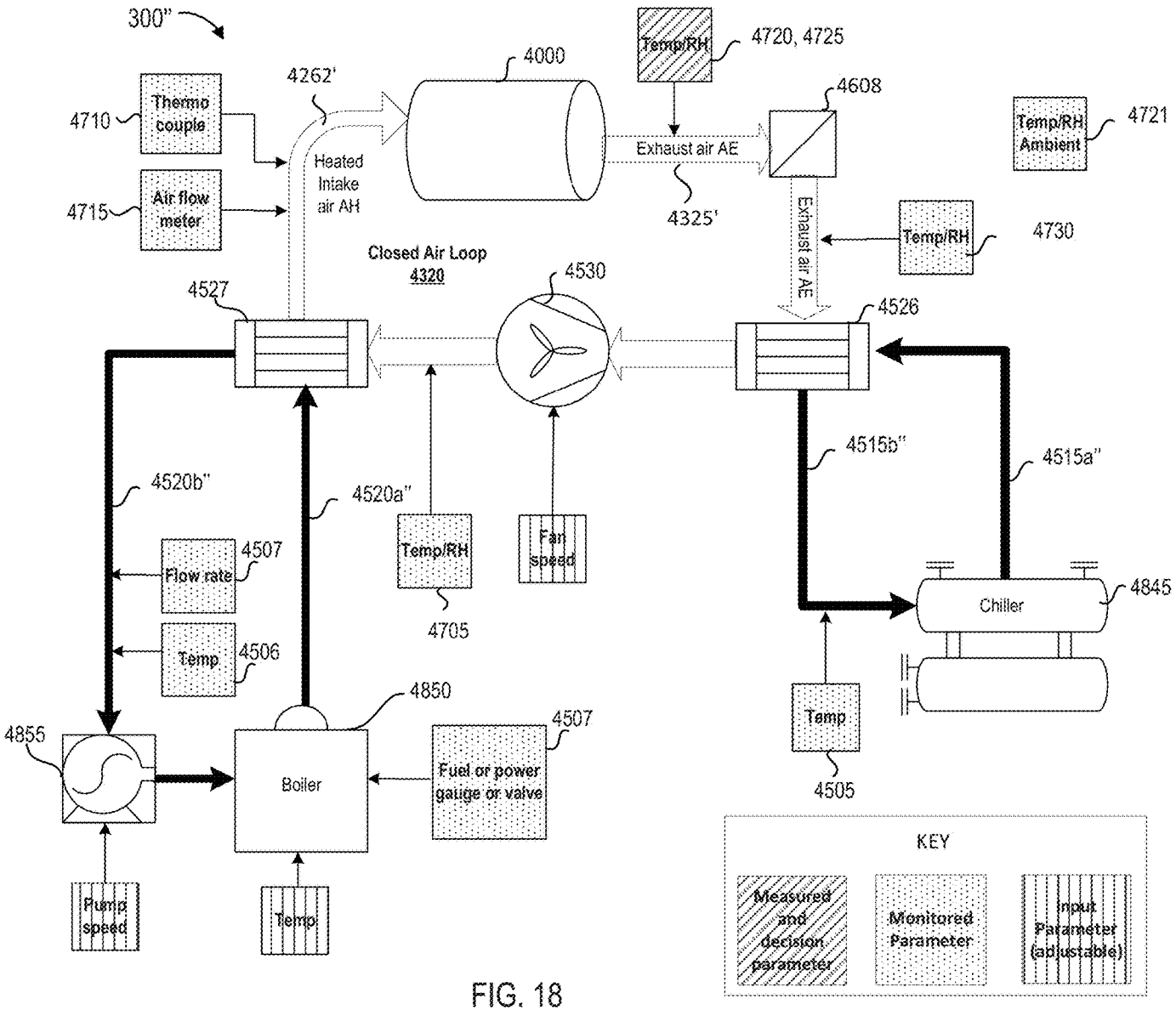
FIG. 18 depicts an alternate implementation of an autonomous system for washing and drying laundry in accordance with the process lines of FIGS. 1-3 and system of FIG. 4.

In implementations, as depicted in the plot 1100 of FIG. 17, in a drying cycle for which the intake air is at a temperature at 60 C, the exhaust temperature T1 (Celsius, plot y-axis) during the process may range from 35 to 45 C over time (minutes, plot x-axis), and only exceed 45 C once the load of wet laundry in the drum 4205 is adequately dry. Thus the controller 4005, 4005*a-n* in operable communication with a heat control unit (e.g., intake manifold 4075) of a washing and drying robot 4000 may stop the process (e.g., close the dampers 4077*a-n*) as soon as the exhaust temperature T1 measurement exceeds 45 C. Additionally or alternately, as depicted in FIG. 18, in implementations, the controller 4005, 4005*a-m* can be configured to detect that a load of laundry in the drum of the washing and drying robot 4000, 4000*a-n* is adequately dry and stage 3 S3 is completed when the exhaust humidity RH1 measurement falls below 10%, and the process may be stopped once humidity below 10% is detected. The values of the threshold temperature (for example 45 C) and threshold humidity (for example 10%) depend on the moisture content of the intake process air and can therefore be reliably established for a closed loop cycle but not for an open loop cycle.

In implementations, the at least one controller 4005, 205 is configured to determine an end of cycle by at least one of: Monitoring relative humidity of the exhaust air AE and determining a value below a threshold; Monitoring relative humidity of the exhaust air AE over time and calculating its rate of change, then determining the rate of change has leveled out (e.g., applying a spline fit, finding a minimum of first derivative (where maximum slope is equal to the maximum rate of dropping), then waiting until derivative is 50% (or 25% or 10%) of the minimum); Monitoring temperature of exhaust air AE and determining a detected value is above a threshold; If alternating drum tumbling direction, determining a reduction in difference in the relative humidity of the exhaust air measured during clockwise and counterclockwise directional rotation; Monitoring relative humidity of process air at the fan 4530 and determining a drop in measured value; and Monitoring the temperature of the fluid in the cooling return conduit 4515*b* and identifying a drop in temperature. Instead of setting a timed drying cycle and potentially wasting energy, the at least one controller 4005, 205 therefore is configured to accurately assess the end of a drying cycle and conclude the process without unnecessary wasted energy. Additionally or alternatively, terminating the cycle in response to sensor input avoids overheating the laundry articles and minimizes damage to the fibers.

Additionally or alternatively, based on one or more output signals of a plurality of sensors (e.g., airflow, temp, and humidity sensors 4705, 4710, 4715, 4720, 4725, 4730, 4060 of FIG. 5) the controller 4005 or a GPU 205 in communication with a cluster 4002 of washing and drying robots 4000*a-n* can pre-determine at least one of the temperature of the intake air, the moisture content of the intake air, and the air flow rate through the drum 4205 so as to minimize the drying time, minimize the total energy consumed, and/or to minimize damage to the fiber items of a load of laundry articles. To enable determining at least one of the pre-programmed values, one or more characteristics of the load of laundry articles can be provided by a preceding robot (e.g., automated intake robot 2000 and/or separating and sorting robot 3000) in communication with at least one of the controller 4005 and GPU 205 over the communication network 230. The one or more characteristics can include at least one of load size, fabric type, fabric finishes, wash cycle temperature, and article type (e.g., thick, water retaining items such as towels and jeans and thinner fabric items such as t-shirts and underwear). In implementations, a small load size comprises a weight up to about 3 kg, a medium size load comprises a weight in a range of between about 3-5 kg, and a large size load comprises a weight in a range of between about 5-10 kg.

In implementations, faster drying time is associated with high air flow rates and higher temperature, for example, airflow rates between 250 and 750 m3/hr and temperatures in a range of between about 70 C and 90 C for a drum 4205 comprising a volume 0.2 m3 (cubic meters). Energy conservation is associated with high air flow rates and lower temperatures, for example, airflow rates between 250 and 750 m3/hr (cubic meters per hour) and temperatures in a range of between about 45 C and 60 C. Minimizing damage to fibers and fabric finishes such as printing, embossing, embellishments, elastic, or other elements of fabric items requires balancing the tradeoff between lower temperatures and shorter drying times. While high temperatures are known to contribute to damaging fiber items, for example by promoting shrinking, matting, and possible chemical structure changes to synthetics or inks and other embellishments, longer tumbling times may also cause damage through rubbing or removal of material in the form of lint. In implementations, therefore, at least one of the controller 4005 and GPU 205 autonomously determines optimum conditions based on two or more of the following load characteristics: the size of the load of laundry relative to a size of a drum of a washing and drying robot 4000*a-n*, the fiber composition and fabric type (e.g., weave/knit type and looseness, length of fibers (staple) from which the fiber/yarn is spun, spin quality of the fiber/yarn, fuzziness, etc.) of one or more articles in the load, fabric finishes of one or more articles in the load, wash cycle temperature, and article type and thickness.

Additionally or alternatively, washing parameters can be selected by a customer for each load of laundry based on input parameters supplied by the customer and associated with each box containing the dirty laundry. Additionally or alternatively, the system 300, 300', 300" can push prompts to a user, such as those visible on a screen app running on a remote device, requesting input as to one or more washing preferences for individual items photographed by one or more robots, such as the separating and sorting robot 3000. The system 300, 300', 300" can store the images and user preferences (e.g., temperature, agitation preference, wash chemical preferences, rise cycle preferences) in a database for subsequent retrieval by the controller 4005. The system 300, 300', 300" can comprise a neural network that learns each customer's preferences for subsequent washing of the same article(s) that therefore reduces the required number of requested interactions with each customer over time.

Additionally or alternatively, in implementations, at least one of the controller 4005 and GPU 205 makes a determination to reduce a total estimated duration of the drying cycle by selecting moderate or high temperatures for some or all of the cycle, for example moderate temperatures in a range of between about 45 C to 55 and high temperatures in a range of between about 65 to 85 C.

For example, as shown in FIG. 16, during the first stage S1 of drying as described above, the function of the hot air is primarily to heat the equipment (e.g., tub 4215 and drum 4205) and fabric of the load of laundry to the steady state process temperature. Very little drying occurs during this stage and it may be desirable, from a laundry facility operating point of view, to accelerate the first stage S1 as much as possible. Any potential heat damage to the fabric would not occur during this first stage S1, because this first stage S1 only lasts as long as the fabric of the laundry is heating up to the target process temperature for drying. This first stage S1 may be accelerated by heating the intake air to a higher temperature, as much as 85 C. This temperature must also take into account the temperature limit of bearing seals, gaskets, and any other components of the washing and drying robot 4000. Alternately, the temperature of the components of the washing and drying robot 4000 and the load of laundry may be increased by increasing the temperature of the final rinse in the wash cycle, or through the use of alternative heaters such as microwave heaters, resistive heaters, and/or infrared heat lamps in the walls of at least one of the door 4300, the tub 4215, and the drum 4205.

In the second stage S2, as shown in FIGS. 16-17, the exhaust temperature and humidity are roughly constant, varying by no more than 10%. During this stage, the fabric items are still damp and the rate of moisture loss is dominated by the evaporation of free surface moisture. In this case, higher air temperatures and higher turbulence of the air in the drum 4205 both accelerate the drying process. During this stage the fabric temperature will generally not exceed the wet bulb temperature of the process air in the drum 4205, which is far lower than the intake temperature. Thus the intake temperature may be chosen to be between 60 and 80 C to accelerate the process. However, running at a higher temperature results in reduced energy efficiency. So if energy efficiency concerns dominate, the intake temperature can be chosen to be between 40 and 60 C.

In the third stage S3, the exhaust humidity RH1 gradually falls and the exhaust temperature T1 gradually rises. During this stage, the drying process is limited by the migration of moisture trapped in the fabric toward the fabric surface. Thus the humidity at the surface may be far lower than the saturation humidity of the process air, and the surface temperature may exceed the wet bulb temperature of the process air. To avoid damaging the fabric of the laundry in the drum 4205 through overheating, the intake process air temperature may be reduced, either as soon as the third stage S3 is detected by sensor signals output to the controller or gradually as the stage S3 progresses (e.g., as fabric temperature increases). For example, the intake temperature may be adjusted so that the exhaust temperature remains constant. Specifically, for example, if during the second stage S2 the intake temperature was 60 C and the exhaust temperature was 45 C, then during the third stage S3 the at least one controller 4005, 205 reduces the flow of heated fluid to the heated side heat exchanger or adjust the valve configuration to eliminate sections of the heated side heat exchanger whenever the exhaust temperature rises above 45 C to maintain the exhaust temperature at around 45 C. Alternately, the intake temperature may be reduced to 45 C at the start of the stage S3.

The fourth stage S4 occurs when the fabric is completely dry, in which case the temperature inside the drum 4205 and the temperature of the fabric continue to increase to the limit of the intake temperature, less any losses to the ambient environment. However, no additional drying is taking place. During this fourth stage S4, the at least one controller 4005, 205 can instruct actuators and controllers of the heat pump 4800, valves 4523, 4524, air loop fan 4530, centralized refrigerant circulation pumps 4830, 4840, and local heating fluid loop pump 4519 and cooling loop pump (not shown) to reduce the intake temperature to the drum 4205 to allow the fabric of the laundry articles in the drum 4205 to cool. Additionally, in implementations, the at least one controller 4005, 205 is configured to instruct the fan drive 4416 (FIG. 10) to reduce the speed of the fan 4530 thereby reducing the air flow and further reducing energy consumption. In implementations, the at least one controller 4005, 205 continues calling for air flow through the drum 4205 and tumbling the drum 4205 until the load of laundry can be removed, thereby reducing or avoiding the creation of any fabric wrinkles.

As discussed previously with regard to implementations, running a drying cycle with a closed air loop 4320 offers an opportunity for implementing a heat pump 4800 for heating the intake air stream using energy reclaimed from the exhaust air stream. However, introducing a heat pump to a single tumble dryer in a closed loop air cycle would introduce inefficiencies due to energy intensive transient states at start up and shut down of the heat pump, as well as idle time while the washing and drying robot 4000 was not in a drying cycle. Furthermore, the maximum availability of energy in the exhaust air AE stream may not coincide with the peak requirement for heat for the air intake AH stream of a single unit. In implementations of the present invention, a single autonomous washing and drying robot 4000 both washes and dries a load of laundry therein, and during the wash cycle, hot air is not required.

Load balancing across a plurality of washing and drying robots 4000*a-n* enables efficient use of the centralized heat pump 4800 because the washing and drying robots 4000*a-n* of a cluster 4002 can each be operating at various stages of a washing and drying process, including being idle. As described with regard to at least FIG. 9, the system 300 includes one or more air sensors configured to measure at least one air characteristic at one or more locations of the system and output a signal indicative of the at least one air characteristic. Each washing and drying robot 4000*a-n* in the cluster 4002 is in operable communication with at least one of their respective controllers 4005*a-n* and at least one centralized controller (e.g., CPU 205) via a wired or wireless network (e.g., network 230).

The cluster 4002 configuration prevents the heat pump 4800 from experiencing inefficiencies associated with having to startup and shutdown intermittently because at any point in time, one or more of the washing and drying robots 4000, 4000*a-n* in a cluster 4002 is operably engaged with the heat pump 4800. For example, when starting up, the heat pump 4800 must initially cool the fluid in the cooling conduit and heat the fluid in the heating conduit. The duration of this period may be 3-10 minutes. Conversely, at shutdown, the cold fluid is cold and the heated fluid is hot. This temperature separation, and therefore potential work, would not be utilized if applied to a single machine because the enthalpy difference would dissipate by the time the combination washing and drying starts the next drying cycle.

In contrast, having a centralized heat pump 4800 service one or more clusters 4002, 4002*a-n* of autonomous washing and drying robots 4000 prevents start up and shut down inefficiencies because at least one washing and drying robot 4000 will require heating and cooling fluid supplied to the heated side heat exchanger 4527 and cold side heat exchanger 4526. Additionally, in implementations, to ensure that at least one washing and drying robot 4000 is calling for serving by the heat pump 4800 at any given time, the cycle start time and duration of a plurality of washing and drying cycles can be staggered by at least one of a controller 4005*a-n* and CPU 205 in communication with each of the washing and drying robots 4000*a-n* in one or more clusters 4002*a-n*.

Furthermore, the size of the heat pump 4800 required to service a cluster of a total number "n" of autonomous washing and drying robots 4000 is significantly less than "n" times the size of a dedicated, local heat pump required to serve a single washing and drying robot 4000. For example, if a single autonomous washing and drying robot 4000 requires a 6 kW heat pump, 100 washer dryers will require less than 600 kW of heat pump capacity. In implementations, depending on the relative proportion of drying time to cycle time, the heat pump 4800 may need 450 kW of capacity or possibly as little as 300 kW. Furthermore, larger heat pumps are more efficient in both operating energy and initial installation cost than smaller heat pumps, resulting in a cost savings in a range of between about 50% to 75% compared to individually paired heat pumps. By staggering cycles between washing and drying robots 4000*a-n* in a cluster 4002 and/or across two or more clusters 4002*a-n*, the load on a centralized heat pump 4800 can be balanced, avoiding losses associated with starting up and shutting down and resulting in efficiencies in both capital equipment and operating costs.

In implementations, in a laundry facility that is not operating at full capacity or at times and locations where energy is expensive, it may be desirable to set the drying process (e.g., drying cycle) for an intake temperature of 45 C for high energy efficiency. In other circumstances or locations, for example where demand is high or local energy costs are low, it may be desirable to set the drying temperature to 80 C for rapid cycles. If minimizing fabric damage (e.g., for delicate wool knits, based on fabric characteristics detected by the sorting and separating robot 3000, for example) is the most critical condition, the at least one controller 4005, 205 is configured to run the drying cycle (e.g., stages S2 and S3) at very low temperatures, for example 35 C. For fabrics that are damaged by long tumbling time, the process may be set to 60 C initially and until approximately 50% of the moisture is removed, and then the temperature lowered to 35 C. The at least one controller 4005, 205 can store in memory one or more threshold conditions for autonomously triggering these temperature control settings. For example, if only 50% of a cluster 4002 is operating, the intake temperature can be set to 45 C and if 50-100% of the cluster 4002 is in use, the intake temperature can be set to 80 C. In implementations the high temperature output of the heat pump 4800 is set to the highest temperature desired in the plant (e.g., facility) and the at least one controller 4005, 205 can adjust the temperature of the intake air AH in individual drums 4205 by adjusting the speed of at least one of the heating supply conduit pump 4519 or the closed air loop fan 4530. Optionally the facility can be configured so that one or more clusters 4002 of robots 4000*a-b* always operates at reduced temperatures to process sensitive items, and the heat exchangers 4526, 4527 for those reduced temperatures clusters are connected to the supply line 4518*a* of the intermediate temperature heat exchanger 4510*c* (e.g., third heat exchanger) instead of to the heating supply conduit 4520*a*.

In summary, the at least one controller 4005, 205 is configured to optimize a drying cycle for each unique load of one or more laundry articles disposed within a drum 4205. The at least one controller 4005, 205 is configured to increase the flow rate in the heating supply conduit 4520*a* and increase the fan 4530 to increase air flow rate in the closed air loop 4320 during a steady state portion of a drying cycle to speed up drying. Similarly, the at least one controller 4005, 205 is configured to reduce airflow during the diffusion part of a drying cycle during which the air flow has less impact on duration of drying and reduce the rate of cooling fluid delivered in the cooling supply conduit 4515*a* to the cold side heat exchanger for the diffusion part of cycle because the exhaust air AE contains less moisture needing to be condensed. Additionally, the at least one controller 4005, 205 is configured to reduce the rate of delivery of heating fluid to in the heating supply conduit 4520*a* as the exhaust temperature of the exhaust air AE starts to heat up, thereby preventing one or more laundry articles in the drum 4205 from overheating. In implementations, the at least one controller 4005, 205 is configured to alternate tumbling directions to reduce tangling and promote uniform drying. Additionally or alternatively, the at least one controller 4005, 205 is configured to adjust drum rotation speed for a size of a load of one or more laundry articles and/or the length of the one or more laundry articles in the load (e.g., long, king sized sheets) to reduce tangling.

Turning to another implementation of the system 300" shown in FIG. 18, the heat pump 4800 can be replaced by a separate centralized chiller 4845 configured to provide cold refrigerant (e.g., water) in cooling supply conduit 4515*a"* to the cold side heat exchangers 4526, 4526*a-n* of each of the washing and drying robots 4000*a-n*. As described previously with regard to implementations, the direction of airflow within the drum can be either from a front end 4212 to a rear end 4217 or vice versa. In the implementation of FIG. 18, a centralized heater 4850 and pump 4855 are configured to provide hot refrigerant (e.g., water) in heating supply conduit 4520*a"* to each of the heated side heat exchangers 4527, 4527*a-n* of the plurality of washing and drying robots 4000*a-n*. In implementations, the centralized heater 4850 is a gas-powered boiler. Alternatively, in implementations, the centralized heater can be an electric heater. In implementation, either the centralized heater or the chiller may be replaced by a natural source of heated or cooled fluid, for example natural bodies of water such as rivers, lakes, or seas or geothermal heat sources such as hot springs.

Similarly, as with other implementations previously described, the at least one controller 4005, 205 is configured to receive outputs from a plurality of sensors 4705, 4710, 4715,4720, 4725, 4730 configured to detect and measure process parameters of the process air in the closed air loop 4320 comprising temperature, humidity, air flow velocity, air flow volume, and from one or more sensors 4721 configured to measure air pressure and ambient temperature and relative humidity in the airspace around the system 300". The at least one controller 4005, 205 is also configured to receive outputs from a plurality of sensors 4506, 4507 configured to detect and measure the flow rate and temperature of the heating return conduit 4520*b"*, and one or more sensors 4505 configured to detect temperature of the cooling return conduit 4515*b"* to the centralized chiller 4845. The at least one controller 4005, 205 is configured to at least one of set and adjust input parameters to the system 300" including speed of the fan 4530, speed of the pump 4855 and temperature of the centralized heater 4850 based on changes in one or more of the measured (e.g., monitored) parameters such that signals output by the more or more sensors are indicative of values falling outside of a preset range of acceptable values for each stage of the drying process.

For example, in the implementation of FIG. 18, the temperature on the cooling return conduit 4515*b"* is a control parameter monitored by a temperature sensor 4505 in order to adjust an input parameter, as necessary. The input parameter(s) comprises at least one of the speed of an optional booster pump (not shown) disposed in the cooling supply conduit 4515*a"*, the position of a valve in a local cooling supply branch (not show), the speed of the fan 4530', and an alarm that triggers an adjustment to a process input if the temperature of the fluid in the cooling return conduit 4515*b"* is sufficiently out of range. In implementations, the inputs to the process 300" comprise turning the cold refrigerant supply conduit 4515*a"* on/off or controlling fluid flow speed at each branch 4516" (not shown), turning the hot refrigerant supply conduit 4520*a"* on/off or fluid flow speed at each branch 4571" (not shown), controlling speed of the fan 4530, and controlling rotational speed and direction of the drum 4205 of the washing and drying robot 4000. The main process sensors configured to signal an adjustment to one or more process parameters are the one or more sensors measuring the temperature and humidity (e.g., sensor(s) 4720, 4725) of the exhaust air AE, the one or more sensors measuring temperature of the intake air AH, and the sensors (4505, 4506) measuring the return temperatures of the hot and cold refrigerant in the heating return conduit 4520*b*″ and cooling return conduit 4515*b*". The remaining sensors in the system 300" detect whether the system is operating within expected parameters or whether some extra intervention is required, e.g., cleaning the lint filter 4608 or rinsing the cold heat exchanger 4626, and at least one of push sensor signals to the controller at a set delivery rate or send output signals of the measured parameters upon request by the controller for monitoring process conditions.

Although the preceding implementations comprise a centralized heat pump and centralized heating and cooling systems for use with a plurality of combination washing and drying robots 4000*a-n*, the centralized heat pump and centralized heating and cooling systems can be configured for use with a plurality of standalone drying machines. Additionally or alternatively, the plurality of standalone drying machines can be manually operated machines rather than autonomous robots.

In implementations, any of the preceding centralized heat pump and heating and centralized cooling systems for use with a plurality of tilting combination washing and drying robots 4000*a-n* can be configured for use with a plurality of stationary, non-tilting combination washing and drying machines. Additionally or alternatively, the plurality of stationary, non-tilting combination washing and drying machines can be manually operated machines rather than autonomous robots.

Although the closed air loop 4320 is described herein with regard to implementations as being dedicated to a single washing and drying robot, in alternative implementations, the closed air loop could be shared among a drum pair or small drum cluster. For example, the heat pump 4800 closed air loop 4320 could be serving one drum while a paired drum is washing. In implementations, a closed air loop can be local to a single washing and drying robot 4000, a plurality of washing and drying robots 4000*a-n*, and a cluster 4002 of washing and drying robots.

Figure 19:
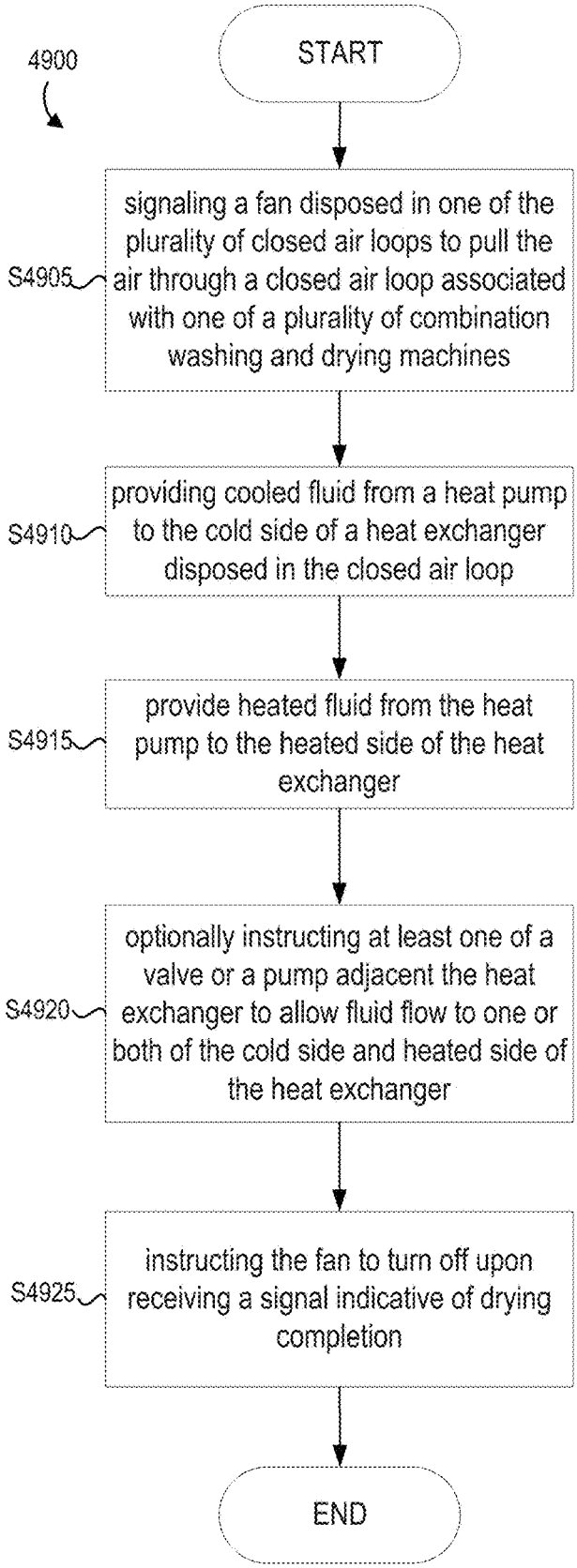
FIG. 19 depicts an implementation of a method of treating air disposed in a plurality of closed air loops associated with a corresponding plurality of combination washing and drying machines and a corresponding plurality of hot and cold heat exchanger pairs disposed in each one of the plurality of closed air loops.

Turning now to FIG. 19, a method 4900 is depicted of heating and cooling a plurality of pairs of heated side heat exchangers and cold side heat exchangers, each pair being disposed with a closed air loop 4320 connected to a corresponding one of a plurality of autonomously operating combination washing and drying machines. Any of the implementations described previously with regard to implementations of the closed air loop heating and cooling system of the washing and drying robots 4000, 4000*a-n* herein are applicable to implementations described herein with regard to the method 4900.

The method comprises signaling S4905 a fan disposed in one of the plurality of closed air loops to pull the air through an exhaust conduit extending between a drum of one or the plurality of combination washing and drying machines and a cold side heat exchanger and through a heated side heat exchanger into an inlet conduit extending between the heated side heat exchanger and an air inlet of the drum. The cold side heat exchanger is configured to lower the air below a dew point and the heated side heat exchanger is configured to provide heated dehumidified air to the inlet for drying clean, wet articles of laundry disposed within a rotating drum of the washing and drying robot 4000. The drum 4205 is configured to rotate about a central spin axis during drying, either in a continuous direction of rotation or in an alternating pattern of clockwise and counterclockwise rotation about the spin axis to prevent entanglement of laundry articles and promote uniform drying. The method comprises providing S4910 cooled fluid (e.g., refrigerant) from a centralized heat pump to the cold side heat exchanger, and providing S4915 heated fluid (e.g., refrigerant) from the heat pump to the heated side heat exchanger.

In implementations, providing the cooled refrigerant comprises pumping the cooled fluid to the cold side heat exchanger at least one of continuously or on demand, and providing the heated refrigerant comprises pumping the heated fluid to the heated side heat exchanger at least one of continuously and on demand. In implementations, at least one of providing the cooling fluid and providing the heating fluid further comprises instructing S4920 at least one of a valve or a pump disposed along local branches of supply conduits for each of the cooling and heating fluid to allow fluid to flow to at least one of the cooled side heat exchanger and heated side heat exchanger.

Treating air in at least one of the plurality of closed air loops comprises an indirect thermal transfer between fluid from the heat pump and air in the closed air loop.

In implementations, the method further comprises instructing S4925 the fan in the closed air loop to turn off upon receiving a signal indicative of drying completion. The received signal comprises one or more signals output from one or more sensors configured to detect one or more air characteristics indicative of drying completion, and the air characteristics comprising at least one of air temperature, air humidity, and rate of change of at least one of air temperature and air humidity. Additionally, through the stages of the drying process, as articles of laundry dehumidify and warm, the at least one controller is configured to autonomously adjust at least one of the speed of the fan in the closed air loop and the rate of distribution of heating and cooling fluid to the heated side heat exchanger and cold side heat exchanger. Additionally or alternatively, the at least one controller is configured to start and stop drum rotation and/or reverse drum direction to improve heat distribution, reduce tangling, and speed drying throughout the deformable articles within the drum 4205. Upon drying completion, the at least one controller 4005, 205 is configured to instruct the autonomous removable of a door of the washing and drying robot. The at least one controller is configured to instruct a drive of the pivot motor to overturn the tub and drum assembly 4200 such that the opening is downwardly oriented and the dried laundry articles there are ejected into a clean collection bin therebeneath for automatic transport to autonomous sorting and folding robots.

All of the methods and tasks described herein may be performed and fully automated by a computer system. The computer system may, in some cases, include multiple distinct computers or computing devices (e.g., physical servers, workstations, storage arrays, etc.) that communicate and interoperate over a network to perform the described functions. Each such computing device typically includes a processor (or multiple processors or circuitry or collection of circuits, e.g. a module) that executes program instructions or modules stored in a memory or other non-transitory computer-readable storage medium. The various functions disclosed herein may be embodied in such program instructions, although some or all of the disclosed functions may alternatively be implemented in application-specific circuitry (e.g., ASICs or FPGAs) of the computer system. Where the computer system includes multiple computing devices, these devices may, but need not, be co-located. The results of the disclosed methods and tasks may be persistently stored by transforming physical storage devices, such as solid state memory chips and/or magnetic disks, into a different state.

Although the subject matter contained herein has been described in detail for the purpose of illustration, it is to be understood that such detail is solely for that purpose and that the present disclosure is not limited to the disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

Other examples are within the scope and spirit of the description and claims. Additionally, certain functions described above can be implemented using software, hardware, firmware, hardwiring, or combinations of any of these. Features implementing functions can also be physically located at various positions, including being distributed such that portions of functions are implemented at different physical locations.

What is claimed is:

1. An energy efficient autonomous laundry system, comprising:

a plurality of autonomous washing and drying machines each configured to sequentially wash and dry a load of laundry in a drum, each one of the plurality of autonomous washing and drying machines comprising a cold side heat exchanger and a heated side heat exchanger disposed at each of the plurality of autonomous washing and drying machines, a closed air loop comprising an exhaust duct configured to direct cold moist air from the drum to the cold side heat exchanger and an inlet duct configured to direct warm, dehumidified air from the heated side heat exchanger into an inlet of the drum, the cold side heat exchanger being configured to cool exhausted humid air below a dew point to condense moisture from the exhausted humid air and the heated and cold side heat exchangers being disposed in series along the closed air loop, a variable speed fan disposed in the closed air loop, the fan configured to draw process air from the drum, through the cold side heat exchanger, heated side heat exchanger, and into the inlet of the drum, a condensate outlet disposed in the exhaust duct for directing the condensed moisture out of the exhaust duct, and one or more air sensors configured to measure at least one characteristic of process air in at least one of the exhaust duct and inlet duct and output a signal indicative of the at least one air characteristic;

at least one heat pump configured to heat a heated stream of fluid disposed in a heating conduit in thermal communication with the heated side heat exchanger of each one of the plurality of washing and drying machines and cool a cooled stream of fluid disposed in a cooling conduit in thermal communication with the cold side heat exchanger of each one of the washing and drying machines; and a controller in operative communication with the one or more air sensors, one or more variable speed pumps configured to circulate the heated stream of fluid and cooled stream of fluid, the variable speed fan, and the heat pump, the controller being configured to receive the output signal of the one or more air sensors, analyze the at least one air characteristic associated with the one or more air sensors, the at least one air characteristic comprising one or more of air temperature, air flow, and air humidity, determine, based on the analysis, whether the at least one air characteristic is within a range of values for at least one of air temperature, air flow, and air humidity, and adjust, in response to determining at least one air characteristic is not within a range of values, one or more controls for at least one of air temperature, air flow, and air humidity at one or more locations of the system, the one or more controls comprising at least one of fan speed and pump speed of the one or more variable speed pumps configured to circulate the heated stream of fluid and cooled stream of fluid.

2. The system of claim 1, wherein the heated stream of fluid and cooled stream of fluid each comprise at least one of at least one of water, carbon dioxide, CFC, HCFC, ammonia, a mixture of water and propylene glycol.

3. The system of claim 1, wherein the heat pump is configured to heat and cool ducted refrigerant comprising at least one of carbon dioxide, CFC or HCFC, propane and ammonia.

4. The system of claim 3, wherein the heat pump comprises a condenser and the refrigerant is carbon dioxide.

5. The system of claim 3, wherein the heat pump comprises therewithin a heat exchange between a portion of the refrigerant cooled by the heat pump and the cooled stream of fluid in thermal communication with the cold side heat exchanger and a portion of the refrigerant heated by the heat pump and the heated stream of fluid in thermal communication with the heated side heat exchanger of each of each of the plurality of washing and drying machines.

6. The system of claim 1, wherein the heating conduit comprises a closed loop extending between the heat pump and the heated side of the heat pump and the cooling conduit comprises a closed loop extending between the heat pump and the cold side of the heat exchanger, and wherein the closed loops of the heating conduit and the cooling conduit each comprise a plurality of branches in fluid communication with each heated side heat exchanger and cold side heat exchanger of the plurality of autonomous washing and drying machines.

7. The system of claim 6, further comprising at least one of a valve and a pump disposed along each one of the plurality of branches between each of the heating conduit and cooling conduit and corresponding ones of the cold side and heated side heat exchanger, wherein the at least one of the valve and the pump of each of the cold side and heated side are in operative communication with the controller for controlling a rate of fluid delivery to the heat exchanger.

8. The system of claim 1, wherein the heated side heat exchanger and cold side heat exchanger comprise coil-fin units, the coil-fin units comprising conduit in fluid communication with one of the heating conduit and cooling conduit.

9. The system of claim 1, wherein one of the one or more variable speed pumps is configured to adjust the fluid flow rate at least at the heated side heat exchanger wherein reducing a flow rate of the heated stream of fluid reduces air temperature in the inlet duct of the closed air loop.

10. The system of claim 9, wherein the fan disposed in the closed air loop is in operative communication with the controller, wherein increasing an operating speed of the fan increases air flow rate in the closed air loop and reduces air temperature in the inlet duct.

11. The system of claim 1, further comprising one or more auxiliary electrical heaters disposed at each one of the plurality of washing and drying machines, the one or more auxiliary electrical heaters being in operative communication with the controller and configured to at least one of directly heat air in the closed air loop and raise a temperature of an incoming heated stream of fluid disposed in the heating conduit.

12. The system of claim 1, wherein the heating conduit and the cooling conduit each comprise a loop comprising a delivery line and a return line, and wherein the delivery line of the heating conduit is configured to deliver heated fluid to the heated side heat exchanger, heated fluid being a range of between about 65 C-85 C, and the return line of the heating conduit comprises fluid in a range of between about 50-75 C, and wherein heated air from the heated side heat exchanger comprises a temperature in a range of between about 75-80 C and less than 15% relative humidity.

13. The system of claim 12, wherein the delivery line of the cooling conduit is configured to deliver cooled fluid to the cold side of the heat exchanger, cooled fluid being a range of between about 5 C-20 C, and the return line of the cooling conduit comprises fluid in a range of between about 15 C-35 C.

14. The system of claim 1, further comprising one or more insulated buffer tanks configured to hold and selectively disperse at least one of heated process water, cooled process water, heated fluid for introduction into the heated stream of fluid, and cooled fluid for introduction into the cooled stream of fluid.

15. The system of claim 1, wherein the cold side heat exchanger comprises one or more finned heat exchanger chambers having fins and being disposed in series, each of the one or more chambers being oriented such that the fins of the one or more chambers are angled relative to airflow and disposed higher that the condensate outlet such that an air path of process air moving in the closed air loop is upwards and vertical from the condensate outlet to the cold side heat exchanger.

16. The system of claim 1, wherein each washing and drying device is configured to pivot from a substantially upright position to a substantially inverted position, wherein at least one of the inlet duct and the exhaust duct extends from an orifice in rear end of the drum, and wherein, when the drum of the washing and drying device is disposed between the substantially upright and substantially inverted positions such that an axis of drum rotation is substantially horizontal, the at least one of the inlet duct and the exhaust duct comprises a duct length in a range of between about 50 percent longer to twice as long as a direct distance between the orifice and an air inlet to a first heat exchanger comprising one of the heated side heat exchanger and the cold side heat exchanger corresponding with the at least one of the inlet duct and exhaust duct, wherein the orifice is a corresponding one of an air inlet and an exhaust outlet.

* * * * *